US010959476B2

(12) United States Patent
Turner

(10) Patent No.: US 10,959,476 B2
(45) **Date of Patent: *Mar. 30, 2021**

(54) ARTICLES OF APPAREL INCORPORATING CUSHIONING ELEMENTS

(71) Applicant: NIKE, Inc., Beaverton, OR (US)

(72) Inventor: David Turner, Portland, OR (US)

(73) Assignee: NIKE, INC., Beaverton, OR (US)

( * ) Notice: Subject to any disclaimer, the term of this patent is extended or adjusted under 35 U.S.C. 154(b) by 383 days.

This patent is subject to a terminal disclaimer.

(21) Appl. No.: 15/596,471

(22) Filed: May 16, 2017

(65) Prior Publication Data

US 2017/0347742 A1 Dec. 7, 2017

Related U.S. Application Data

(60) Division of application No. 13/442,537, filed on Apr. 9, 2012, now abandoned, which is a continuation-in-part of application No. 13/189,716, filed on Jul. 25, 2011, now Pat. No. 9,386,812.

(51) Int. Cl.

| | |
|---|---|
| ***A42B 3/12*** | (2006.01) |
| ***A41D 13/015*** | (2006.01) |
| ***A41D 13/05*** | (2006.01) |

(52) U.S. Cl.

CPC ..... *A42B 3/125* (2013.01); *A41D 13/015* (2013.01); *A41D 13/0587* (2013.01)

(58) Field of Classification Search

CPC .. A41D 13/0587; A41D 13/015; A42B 3/125; B32B 3/26; B32B 3/266; B29C 2043/023; A63B 71/1225

USPC ..... 2/455; 297/452.33, 452.46; 428/316.6

See application file for complete search history.

(56) References Cited

U.S. PATENT DOCUMENTS

| | | | |
|---|---|---|---|
| 921,352 | A | 5/1909 | Blaker et al. |
| 1,282,411 | A | 10/1918 | Golembiowski et al. |
| 1,685,825 | A | 10/1928 | Mullins et al. |
| 1,910,810 | A | 5/1933 | Nash et al. |
| 1,924,677 | A | 8/1933 | Cadgene et al. |
| 2,266,886 | A | 8/1940 | McCoy et al. |
| 2,569,398 | A | 9/1951 | Burd et al. |
| 2,723,214 | A | 11/1955 | Meyer et al. |
| 2,738,834 | A | 3/1956 | Jaffe et al. |
| 2,751,609 | A | 6/1956 | Oesterling et al. |

(Continued)

FOREIGN PATENT DOCUMENTS

| | | | |
|---|---|---|---|
| CA | 892301 | A | 2/1972 |
| CA | 2063814 | A1 | 1/1991 |

(Continued)

OTHER PUBLICATIONS

"Fabric", Complete Textile Glossary, Calanese Acetate LLC, 2001. (Year: 2001).*

(Continued)

*Primary Examiner* — Jillian K Pierorazio

(74) *Attorney, Agent, or Firm* — Shook, Hardy & Bacon L.L.P.

(57) ABSTRACT

Cushioning elements for apparel may include a pair of material layers and a pad component that is located between and secured to the material layers. At least one surface of the pad component includes a plurality of elongate grooves. In addition, a plurality of elongate voids extend through the pad component.

20 Claims, 66 Drawing Sheets

(56) References Cited

U.S. PATENT DOCUMENTS 2,785,739 A 3/1957 McGregor, Jr. et al.
3,012,926 A 12/1961 Wintermute et al.
3,020,186 A 2/1962 Lawrence et al.
3,119,904 A 1/1964 Anson et al.
3,137,746 A 6/1964 Edwin et al.
3,233,885 A 2/1966 Propst et al.
3,258,800 A 7/1966 Robinsky et al.
3,285,768 A * 11/1966 Habib ..... A41D 31/285 428/160
3,293,671 A 12/1966 Griffin et al.
3,305,423 A 2/1967 Le Masson et al.
3,404,406 A 10/1968 Balliet et al.
3,441,638 A 4/1969 Ripon et al.
3,465,364 A 9/1969 Edelson et al.
3,471,865 A 10/1969 Molitoris et al.
3,484,974 A 12/1969 Culmone
3,500,472 A 3/1970 Castellani et al.
3,512,190 A 5/1970 Buff
3,515,625 A 6/1970 Sedlak et al.
3,679,263 A 7/1972 Cadiou et al.
3,722,355 A 3/1973 King
3,746,602 A 7/1973 Giuffrida et al.
3,746,605 A 7/1973 Dillon et al.
3,775,526 A 11/1973 Gilmore et al.
3,832,265 A 8/1974 Denommee
3,841,958 A * 10/1974 Delorme ..... B32B 17/10 428/117
3,843,970 A 10/1974 Marietta et al.
3,867,238 A 2/1975 Johannsen et al.
3,867,239 A 2/1975 Alesi et al.
3,882,547 A 5/1975 Morgan
3,911,185 A 10/1975 Wright, Jr. et al.
3,914,487 A 10/1975 Azoulay et al.
3,922,329 A 11/1975 Kim et al.
3,950,789 A 4/1976 Konz et al.
3,977,406 A 8/1976 Roth et al.
4,023,213 A 5/1977 Rovani et al.
4,070,719 A * 1/1978 Morgan ..... A47C 27/146 428/167
4,126,177 A 11/1978 Smith et al.
4,136,222 A 1/1979 Jonnes et al.
4,138,283 A 2/1979 Hanusa
4,146,933 A 4/1979 Jenkins et al.
4,190,696 A 2/1980 Fuoco et al.
4,197,342 A 4/1980 Bethe
4,249,268 A 2/1981 Berler et al.
4,249,302 A 2/1981 Crepeau et al.
4,255,552 A 3/1981 Schollenberger et al.
4,272,850 A * 6/1981 Rule ..... A41D 13/065 2/24
4,276,341 A 6/1981 Tanaka et al.
4,322,858 A 4/1982 Douglas
4,345,958 A 8/1982 Kuroda et al.
4,370,754 A 2/1983 Donzis et al.
4,384,369 A 5/1983 Prince
4,407,497 A 10/1983 Gracie et al.
4,415,622 A 11/1983 Kamat et al.
4,422,183 A 12/1983 Landi et al.
4,440,525 A 4/1984 Perla et al.
4,470,411 A * 9/1984 Hoyt, Jr. ..... A61D 9/00 602/62
4,482,592 A 11/1984 Kramer et al.
4,485,919 A 12/1984 Sandel et al.
4,493,865 A 1/1985 Kuhlmann et al.
4,507,801 A 4/1985 Kavanagh et al.
4,512,037 A 4/1985 Vacanti et al.
4,516,273 A 5/1985 Gregory et al.
4,525,875 A 7/1985 Tomczak et al.
4,534,354 A 8/1985 Bonner, Jr. et al.
4,538,301 A 9/1985 Sawatzki et al.
4,559,251 A 12/1985 Wachi et al.
4,573,456 A 3/1986 Spann
4,581,186 A 4/1986 Larson et al.
4,631,121 A 12/1986 Stewart et al.
4,642,814 A 2/1987 Godfrey
4,646,367 A 3/1987 El Hassen et al.
4,685,155 A 8/1987 Fingerhut et al.
4,688,269 A 8/1987 Maeshima et al.
4,692,199 A 9/1987 Kozlowski et al.
4,696,066 A 9/1987 Ball et al.
4,713,854 A 12/1987 Graebe et al.
4,718,214 A 1/1988 Waggoner
4,726,087 A 2/1988 Schaefer et al.
4,730,761 A 3/1988 Spano et al.
4,734,306 A 3/1988 Lassiter et al.
4,756,026 A 7/1988 Pierce, Jr. et al.
4,774,724 A 10/1988 Sacks
4,780,167 A 10/1988 Hill et al.
4,788,972 A 12/1988 Debusk et al.
4,809,374 A * 3/1989 Saviez ..... A47C 27/146 5/420
4,815,149 A 3/1989 Erhardt et al.
4,852,274 A 8/1989 Wilson et al.
4,856,393 A 8/1989 Braddon et al.
4,866,800 A * 9/1989 Bedford ..... A61G 5/1043 5/652.1
4,867,826 A 9/1989 Wayte et al.
4,884,295 A 12/1989 Cox et al.
4,963,936 A 10/1990 Carter
4,964,936 A 10/1990 Ferro
4,982,447 A 1/1991 Henson et al.
4,985,931 A 1/1991 Wingo, Jr. et al.
4,985,933 A 1/1991 Lemoine et al.
4,989,265 A 2/1991 Nipper et al.
4,991,230 A 2/1991 Vacanti et al.
5,007,111 A 4/1991 Adams et al.
5,020,156 A 6/1991 Neuhalfen
5,020,157 A 6/1991 Dyer et al.
5,029,341 A 7/1991 Wingo, Jr. et al.
5,030,501 A 7/1991 Colvin et al.
5,042,318 A 8/1991 Franz
5,048,123 A 9/1991 Monson et al.
5,048,125 A 9/1991 Libertini et al.
5,052,053 A 10/1991 Peart et al.
5,054,127 A 10/1991 Zevchak
5,060,313 A 10/1991 Neuhalfen et al.
5,071,698 A 12/1991 Scheerder et al.
5,129,295 A 7/1992 Geffros et al.
5,136,726 A 8/1992 Kellin et al.
5,146,621 A 9/1992 Hadar et al.
5,160,785 A 11/1992 Davidson, Jr. et al.
5,168,576 A 12/1992 Krent et al.
5,188,879 A 2/1993 Hill et al.
5,203,607 A 4/1993 Landi
5,214,797 A 6/1993 Tisdale et al.
5,232,762 A 8/1993 Ruby
5,233,767 A 8/1993 Kramer
5,274,846 A 1/1994 Kolsky et al.
5,289,830 A 3/1994 Levine et al.
5,322,730 A 6/1994 Ou et al.
5,325,537 A 7/1994 Marion et al.
5,325,552 A * 7/1994 Fong ..... A47C 27/05 5/724
5,334,082 A 8/1994 Barker
5,349,893 A 9/1994 Dunn et al.
5,353,455 A 10/1994 Loving et al.
5,360,653 A 11/1994 Ackley et al.
5,380,392 A 1/1995 Imamura et al.
5,399,418 A 3/1995 Hartmanns et al.
5,405,665 A 4/1995 Shukushima et al.
5,407,421 A 4/1995 Goldsmith et al.
5,423,087 A 6/1995 Krent et al.
5,427,563 A 6/1995 Manning
5,452,477 A 9/1995 Mann
5,454,743 A 10/1995 Simonson
5,459,896 A 10/1995 Raburn et al.
5,477,558 A 12/1995 Voelker et al.
5,484,448 A 1/1996 Steele et al.
5,496,610 A 3/1996 Landi et al.
5,530,966 A 7/1996 West et al.
5,534,208 A 7/1996 Barr et al.
5,534,343 A 7/1996 Landi et al.
5,536,246 A 7/1996 Saunders et al.

(56) References Cited

U.S. PATENT DOCUMENTS 5,539,934 A 7/1996 Ponder
5,551,082 A 9/1996 Stewart et al.
5,594,954 A 1/1997 Huang
5,601,895 A 2/1997 Cunningham et al.
5,614,301 A 3/1997 Katz et al.
5,621,914 A 4/1997 Ramone et al.
5,628,063 A 5/1997 Reed et al.
5,633,055 A 5/1997 Weder et al.
5,636,377 A 6/1997 Wiener et al.
5,640,712 A 6/1997 Hansen et al.
5,659,898 A 8/1997 Bell, Jr. et al.
5,660,572 A 8/1997 Buck et al.
5,675,844 A 10/1997 Guyton et al.
5,689,836 A 11/1997 Fee et al.
5,692,935 A 12/1997 Smith et al.
5,697,101 A 12/1997 Aldridge
5,717,997 A 2/1998 Garcia et al.
5,720,714 A 2/1998 Penrose et al.
5,727,252 A 3/1998 Oetting et al.
5,729,832 A 3/1998 Grilliot et al.
5,734,911 A 4/1998 Lai
5,738,925 A 4/1998 Chaput et al.
5,742,939 A 4/1998 Williams et al.
5,780,147 A 7/1998 Sugahara et al.
5,823,981 A 10/1998 Grim et al.
5,826,273 A 10/1998 Eckes et al.
5,860,163 A 1/1999 Aldridge
5,887,453 A 3/1999 Woods et al.
5,915,819 A 6/1999 Gooding
5,920,915 A 7/1999 Bainbridge et al.
5,938,878 A 8/1999 Hurley et al.
5,940,888 A 8/1999 Sher et al.
5,953,747 A 9/1999 Steely, Jr. et al.
5,957,692 A 9/1999 McCracken et al.
5,987,643 A 11/1999 Beutler et al.
6,005,222 A 12/1999 Hicks et al.
6,041,436 A 3/2000 Keen et al.
6,041,447 A 3/2000 Endler et al.
6,053,005 A 4/2000 Boitnott et al.
6,070,267 A 6/2000 McKewin et al.
6,070,273 A 6/2000 Sgro et al.
6,085,353 A 7/2000 Van Der Sleesen et al.
6,093,468 A 7/2000 Toms et al.
6,098,198 A 8/2000 Jacobs et al.
6,105,162 A 8/2000 Douglas et al.
6,139,928 A 10/2000 Sloot et al.
6,167,790 B1 1/2001 Bambara et al.
6,193,678 B1 2/2001 Brannon
6,219,852 B1 4/2001 Bain et al.
6,228,108 B1 5/2001 Lamb et al.
6,235,661 B1 5/2001 Khanamirian
6,253,376 B1 7/2001 Ritter
6,289,524 B1 9/2001 Wright et al.
6,295,654 B1 10/2001 Farrell
6,301,722 B1 10/2001 Nickerson et al.
6,317,888 B1 11/2001 McFarlane
6,374,409 B1 4/2002 Galy
6,408,446 B1 6/2002 Carrington
6,453,477 B1 9/2002 Bainbridge et al.
6,484,325 B1 11/2002 Lazarus et al.
6,485,448 B2 11/2002 Lamping et al.
6,508,776 B2 * 1/2003 Chiang ..... A61F 5/0104 602/5
6,519,781 B1 2/2003 Berns
6,553,994 B2 * 4/2003 Bard ..... A61F 5/01 128/845
6,584,616 B2 7/2003 Godshaw et al.
6,654,960 B2 * 12/2003 Cho ..... A63B 71/1225 2/22
6,654,962 B2 12/2003 DeMott
6,666,836 B1 12/2003 Islava
6,726,641 B2 4/2004 Chiang et al.
6,743,325 B1 6/2004 Taylor
6,817,039 B1 11/2004 Grilliot et al.
6,820,279 B2 11/2004 Lesosky
6,841,022 B2 1/2005 Tsukagoshi et al.
6,842,915 B2 1/2005 Turner et al.
6,851,124 B2 2/2005 Munoz et al.
6,936,021 B1 8/2005 Smith
6,968,573 B2 11/2005 Silver
6,969,548 B1 11/2005 Goldfine
6,982,115 B2 1/2006 Poulos et al.
7,007,356 B2 3/2006 Cudney et al.
7,018,351 B1 3/2006 Iglesias et al.
7,065,793 B1 6/2006 Wooten
7,114,189 B1 10/2006 Kleinert
7,135,007 B2 11/2006 Scott et al.
7,276,076 B2 10/2007 Bieberich
7,389,547 B1 6/2008 Wiens
7,506,384 B2 3/2009 Ide et al.
RE41,346 E 5/2010 Taylor
7,761,929 B1 7/2010 Mascia
7,827,704 B2 11/2010 Fox et al.
RE42,689 E 9/2011 Taylor
8,095,996 B2 1/2012 Turner
RE43,441 E 6/2012 Taylor
8,231,756 B2 7/2012 Kim
8,336,117 B2 12/2012 Carter et al.
RE43,994 E 2/2013 Taylor
8,438,669 B2 5/2013 Turner
8,499,987 B2 8/2013 Fidrych et al.
8,561,214 B2 10/2013 Turner
8,578,512 B2 11/2013 Moore et al.
8,621,674 B2 1/2014 Perreault et al.
8,683,618 B2 4/2014 Grogro et al.
8,719,965 B2 5/2014 Turner et al.
8,764,931 B2 7/2014 Turner
8,931,119 B2 1/2015 Gordon et al.
RE45,402 E 3/2015 Taylor
9,521,870 B2 12/2016 Turner
2002/0184925 A1 12/2002 McClellan et al.
2003/0220048 A1 11/2003 Toro et al.
2003/0236053 A1 12/2003 Martz
2004/0019950 A1 2/2004 Rast
2005/0009445 A1 1/2005 Bell et al.
2005/0066407 A1 3/2005 Delaney
2005/0081277 A1 4/2005 Matechen et al.
2005/0085162 A1 4/2005 Ott
2005/0161982 A1 7/2005 Cormier et al.
2005/0278817 A1 12/2005 Doheny
2006/0099884 A1 5/2006 Falla
2006/0137080 A1 6/2006 McCoy et al.
2006/0199456 A1 9/2006 Taylor
2006/0218692 A1 10/2006 Lamarque
2006/0234014 A1 10/2006 Liu et al.
2006/0260026 A1 11/2006 Doria et al.
2006/0277647 A1 12/2006 Dobkin
2007/0000005 A1 1/2007 Wang
2007/0022510 A1 2/2007 Chapuis et al.
2007/0106352 A1 5/2007 Carstens
2007/0179460 A1 8/2007 Adahan
2007/0185425 A1 8/2007 Einarsson et al.
2007/0186327 A1 8/2007 Hall et al.
2007/0186328 A1 8/2007 Bulian
2007/0250976 A1 11/2007 Beliveau
2008/0060113 A1 3/2008 Walsh
2008/0166524 A1 7/2008 Skaja et al.
2008/0264557 A1 10/2008 Kim
2008/0282439 A1 11/2008 Sarkies
2008/0290556 A1 11/2008 Kim
2009/0070911 A1 * 3/2009 Chang ..... A41D 13/0543 2/24
2010/0024100 A1 2/2010 Sokolowshi et al.
2010/0024101 A1 2/2010 Berner, Jr. et al.
2010/0117433 A1 * 5/2010 Cassaday ..... A47C 7/40 297/452.46
2010/0129573 A1 5/2010 Kim
2010/0192275 A1 8/2010 Riccelli
2010/0193117 A1 8/2010 Kim
2010/0205716 A1 8/2010 Kim
2010/0205722 A1 8/2010 Kim
2010/0206472 A1 8/2010 Kim
2010/0235960 A1 9/2010 Johnson
2010/0313759 A1 12/2010 Bones

(56) References Cited

U.S. PATENT DOCUMENTS

| | | | | |
|---|---|---|---|---|
| 2011/0006154 | A1 | 1/2011 | Maresko et al. | |
| 2011/0035864 | A1 | 2/2011 | Gordon et al. | |
| 2011/0061154 | A1 | 3/2011 | Turner et al. | |
| 2011/0209275 | A1* | 9/2011 | Berns ..... | A41D 13/0506 2/455 |
| 2011/0252549 | A1 | 10/2011 | Jourde et al. | |
| 2012/0084896 | A1 | 4/2012 | Wyner et al. | |
| 2012/0198594 | A1 | 8/2012 | Reay | |
| 2012/0226247 | A1 | 9/2012 | Danei et al. | |
| 2013/0025035 | A1 | 1/2013 | Turner | |
| 2013/0025036 | A1 | 1/2013 | Turner | |
| 2013/0025037 | A1 | 1/2013 | Turner | |
| 2013/0061377 | A1 | 3/2013 | Wyner et al. | |
| 2013/0160179 | A1 | 6/2013 | Shiue | |

FOREIGN PATENT DOCUMENTS

| | | | |
|---|---|---|---|
| CA | 2162723 | A1 | 11/1994 |
| CA | 2289622 | A1 | 11/1998 |
| CH | 638665 | A5 | 10/1983 |
| CN | 2225163 | Y | 4/1996 |
| CN | 2305870 | Y | 2/1999 |
| DE | 3119489 | A1 | 12/1982 |
| DE | 3530397 | A1 | 3/1987 |
| DE | 9102039 | U1 | 2/1991 |
| DE | 4128958 | C2 | 3/1994 |
| DE | 4336468 | A1 | 4/1995 |
| DE | 10200506060624 | A1 | 5/2007 |
| EP | 0083454 | A1 | 10/1988 |
| EP | 552304 | A1 | 7/1993 |
| EP | 595887 | A1 | 12/1998 |
| EP | 962156 | A1 | 12/1999 |
| EP | 1406142 | A2 | 4/2004 |
| EP | 2436279 | A2 | 4/2012 |
| FR | 2740303 | A1 | 4/1997 |
| FR | 2797153 | B1 | 2/2001 |
| GB | 832101 | A | 4/1960 |
| GB | 1274569 | A | 5/1972 |
| GB | 2120167 | A | 11/1983 |
| GB | 2177892 | A | 2/1987 |
| GB | 2233877 | A | 1/1991 |
| GB | 9014963 | | 1/1991 |
| GB | 2385256 | A | 8/2003 |
| JP | 1316235 | | 12/1989 |
| JP | 2508289 | B2 | 6/1994 |
| JP | H0790704 | A | 4/1995 |
| JP | 1053905 | A | 2/1998 |
| JP | 10337797 | A | 12/1998 |
| KR | 101023817 | B1 | 3/2011 |
| KR | 20120046625 | A | 5/2012 |
| WO | 1989/001657 | A1 | 2/1989 |
| WO | 9205717 | A1 | 4/1992 |
| WO | 9418861 | A1 | 9/1994 |
| WO | 1997023142 | A1 | 7/1997 |
| WO | 1997/033483 | A1 | 9/1997 |
| WO | 9733493 | A1 | 9/1997 |
| WO | 1997033403 | A1 | 9/1997 |
| WO | 1997036740 | A1 | 10/1997 |
| WO | 1999034972 | A1 | 7/1999 |
| WO | 1999035926 | A1 | 7/1999 |
| WO | 200050336 | | 8/2000 |
| WO | 0103530 | A1 | 1/2001 |
| WO | 0115892 | A1 | 3/2001 |
| WO | 0216124 | A1 | 2/2002 |
| WO | 02081202 | A1 | 10/2002 |
| WO | 20004019713 | A1 | 3/2004 |
| WO | 2006036072 | A1 | 4/2006 |
| WO | 2006088734 | A2 | 8/2006 |
| WO | 2009035888 | A2 | 3/2009 |
| WO | 2009/086580 | A1 | 7/2009 |
| WO | 2009/135171 | A2 | 11/2009 |
| WO | 2010076257 | A2 | 7/2010 |
| WO | 2010104868 | A2 | 9/2010 |
| WO | 2011091361 | A1 | 7/2011 |
| WO | 2013015913 | A1 | 1/2013 |
| WO | 2013/154969 | A1 | 10/2013 |

OTHER PUBLICATIONS

"Textile", Complete Textile Glossary, Calanese Acetate LLC, 2001. (Year: 2001).*

Notice of Allowance dated Mar. 26, 2018 in U.S. Appl. No. 134/485/39, 8 pages.

Office Action dated Sep. 4, 2018 in European Patent Application No. 13791865.2, 4 pages.

Office Action dated Oct. 15, 2018 in Canadian Patent Application No. 2,872,503, 5 pages.

Office Action dated Sep. 6, 2017 in European Patent Application No. 13724035.4, 6 pages.

Office Action dated Oct. 12, 2017 in European Patent Application No. 13791865.2, 3 pages.

Notice of Allowance dated May 28, 2019 in Canadian Patent Application No. 2,872,503, 1 page.

Communication under Rule 71(3) dated Jun. 19, 2019 in European Patent Application No. 13724035.4, 5 pages.

Joseph F. Annis & Paul Webb, "Development of a Space Activity Suit", in NASA Contractor Report NASA CR-1892; dated Nov. 1971; 139 pages.

Andrew Alderson, "A Triumph of Lateral Thought", in Chemistry & Industry, May 17, 1999; pp. 384-391.

Maria Burke, "A Stretch of the Imagination", New Scientist Magazine, vol. 154 issue 2085, Jul. 6, 1997 at p. 36 (available from research.dh.umu.se/dynamic/artiklar/shape/stretch.html, last accessed Nov. 11, 2013).

Joseph Hamill & Carolyn K. Bensel, "Biomechanical Analysis of Military Boots: Phase III", in United States Army Technical Report NATICK/TR-96.013; dated Mar. 11, 1996; 42 pages.

European Office Action dated Feb. 10, 2017 in European Patent Application No. 13791865.2, 4 pages.

Office Action dated May 9, 2018 in European Patent Application No. 13724035.4, 8 pages.

Intention to Grant received for European Patent Application No. 13791865.2, dated Apr. 22, 2020, 6 pages.

* cited by examiner

ARTICLES OF APPAREL INCORPORATING CUSHIONING ELEMENTS

CROSS-REFERENCE TO RELATED APPLICATIONS

This U.S. Patent Application is a divisional application which claims priority to U.S. patent application Ser. No. 13/442,537, filed Apr. 9, 2012, and entitled "Articles of Apparel Incorporated Cushioning Elements." U.S. patent application Ser. No. 13/442,537 is a continuation-in-part application and claims priority under 35 U.S.C. § 120 to U.S. patent application Ser. No. 13/189,716, filed Jul. 25, 2011, and entitled "Articles of Apparel Incorporating Cushioning Elements." The entirety of each of the aforementioned applications is incorporated by reference herein.

BACKGROUND OF THE INVENTION

Materials or elements that impart padding, cushioning, or otherwise attenuate impact forces are commonly incorporated into a variety of products. Athletic apparel, for example, often incorporates cushioning elements that protect the wearer from contact with other athletes, equipment, or the ground. More specifically, pads used in American football and hockey incorporate cushioning elements that provide impact protection to various parts of a wearer. Helmets utilized during American football, hockey, bicycling, skiing, snowboarding, and skateboarding incorporate cushioning elements that provide head protection during falls or crashes. Similarly, gloves utilized in soccer (e.g., by goalies) and hockey incorporate cushioning elements that provide protection to the hands of a wearer. Cushioning elements may also be incorporated into bicycling shorts. Apparel that is utilized for generally non-athletic purposes may also incorporate cushioning elements, such as apparel that is worn for motorcycle riding and knee protectors for gardening or construction work.

SUMMARY

Various cushioning elements that may be utilized in apparel and a variety of other products are disclosed below. In general, the cushioning elements include a pair of material layers and a pad component that is located between and secured to the material layers. At least one surface of the pad component includes a plurality of grooves. In some configurations, both surfaces include the grooves. Moreover, the grooves may be elongate and extend at least partially across the pad component. In addition, a plurality of elongate voids may extend through the pad component and from one surface to the other surface.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of cushioning elements that may be incorporated into a variety of products, including articles of apparel, such as shorts, pants, shirts, wraps, footwear, gloves, and helmets.

Apparel Configuration

Figure 1:
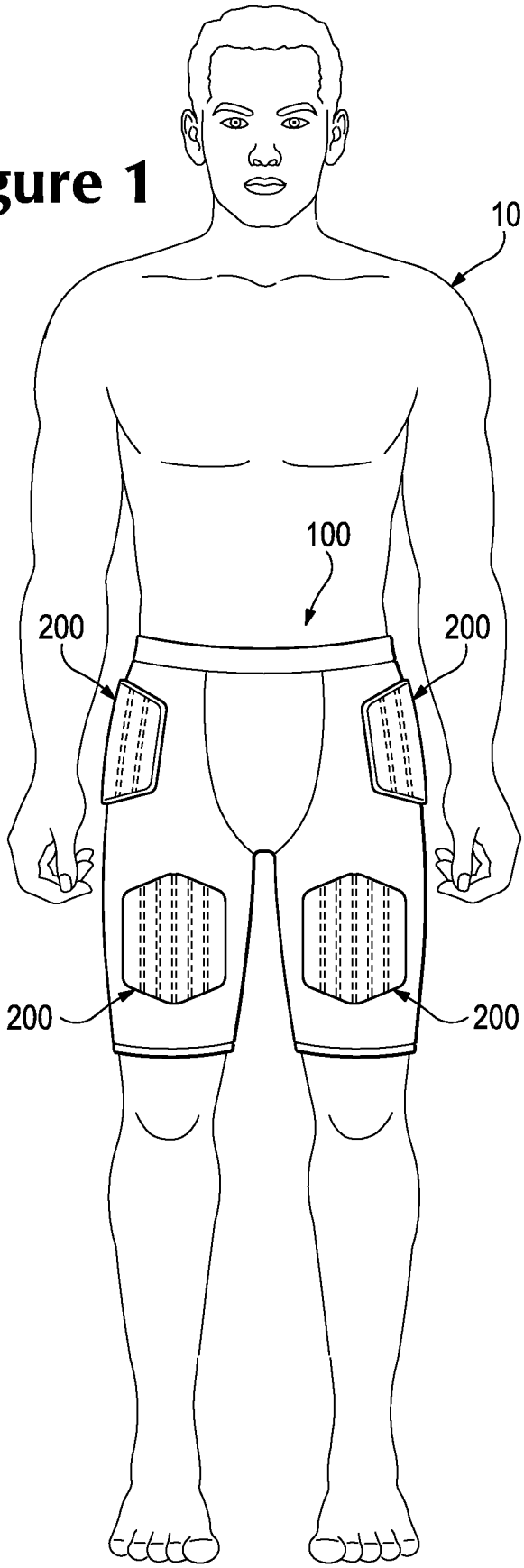
FIG. 1 is a front elevational view of an individual wearing an article of apparel.
Figure 2:
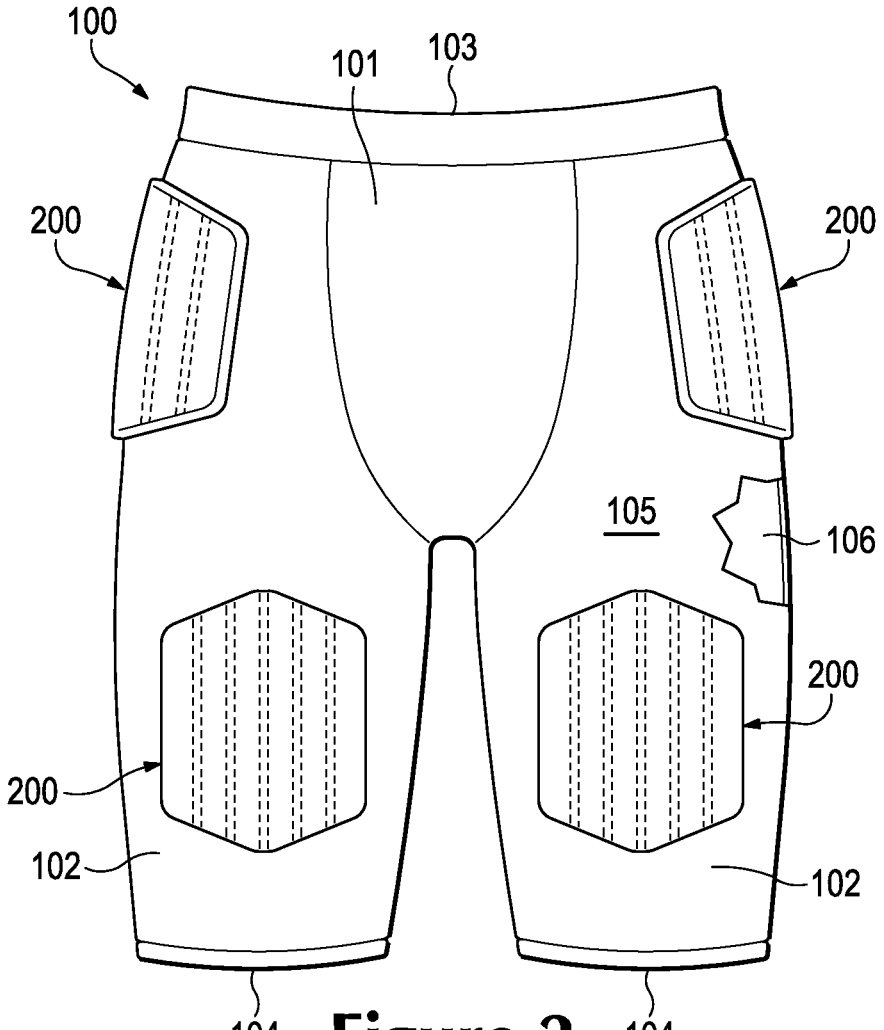
FIG. 2 is a front elevational view of the article of apparel.
Figure 3:
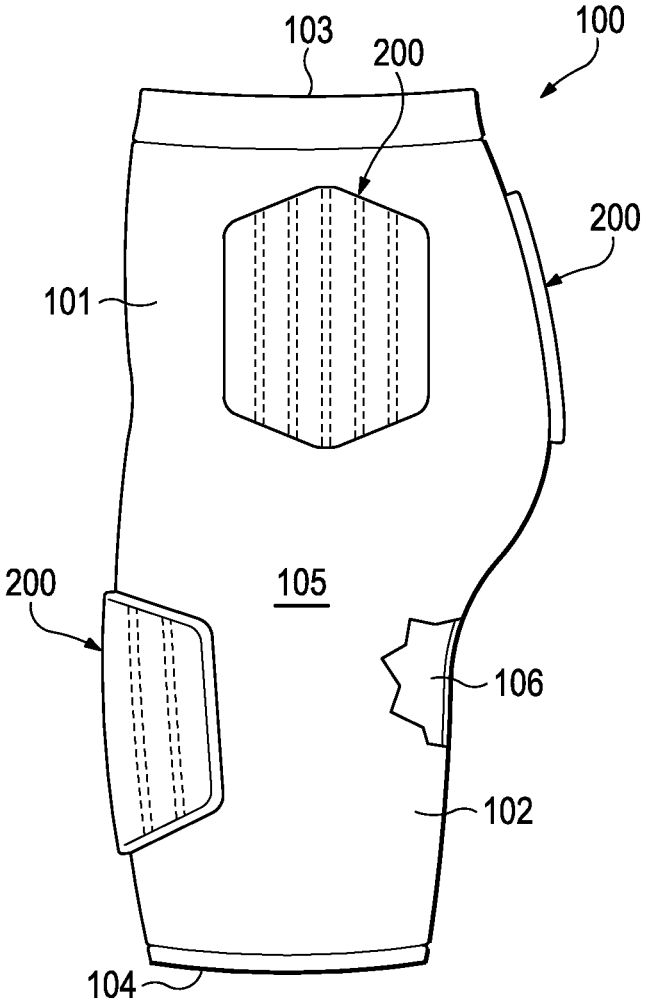
FIGS. 3 and 4 are side elevational views of the article of apparel.
Figure 4:
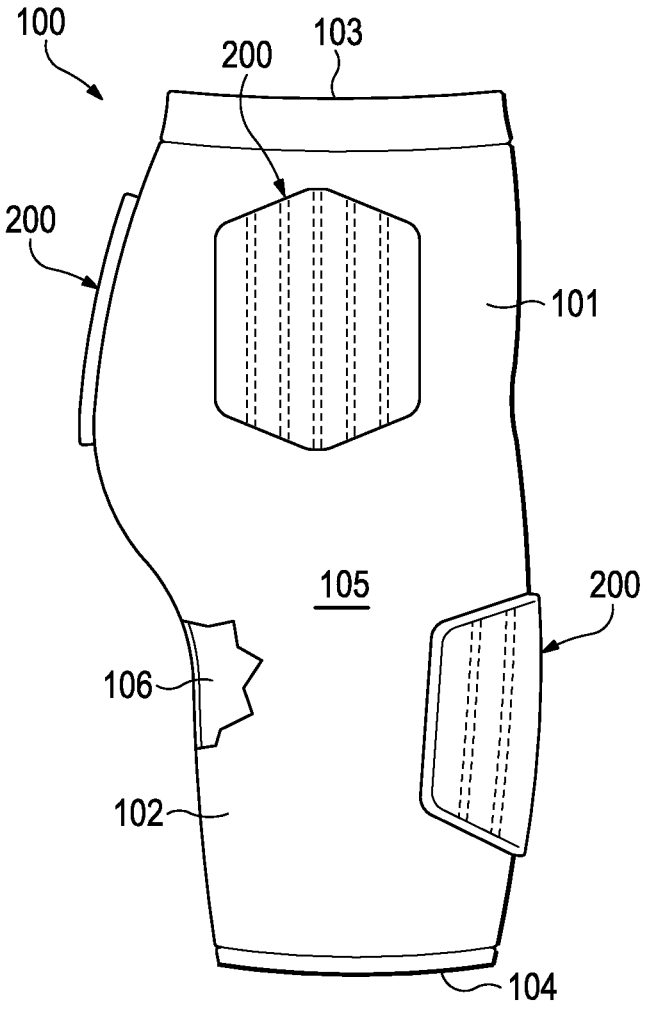
Figure 5:
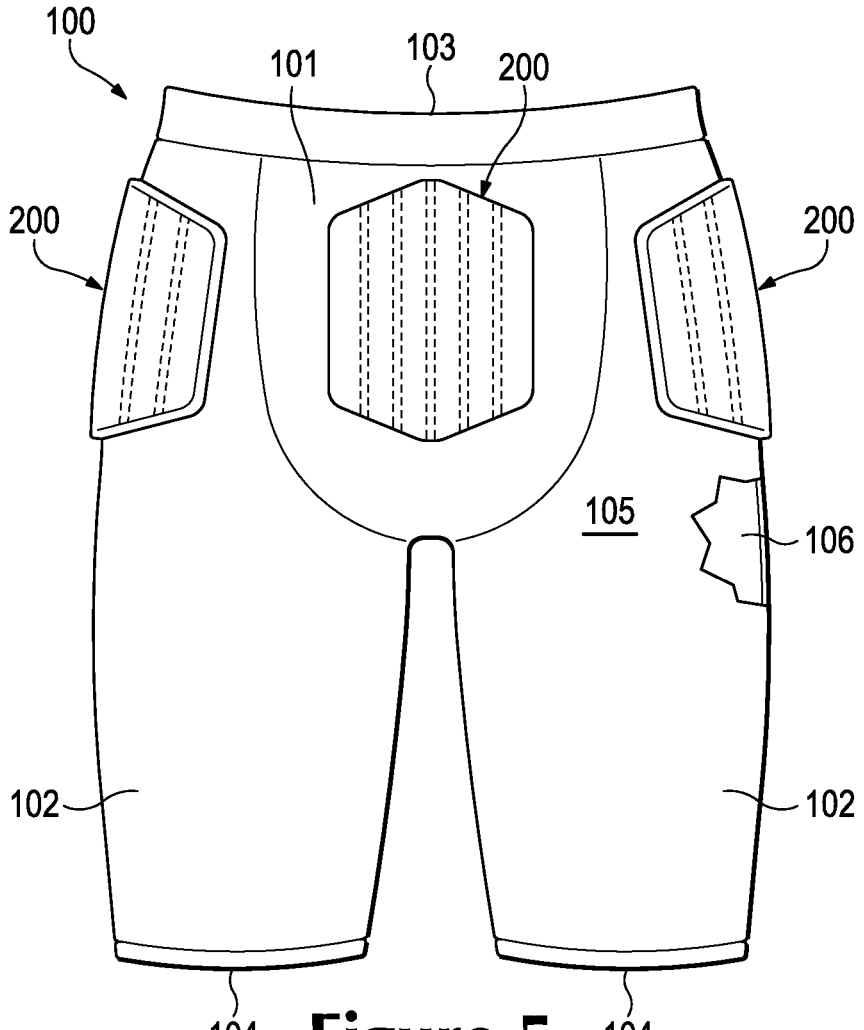
FIG. 5 is a rear elevational view of the article of apparel.
Figure 6:
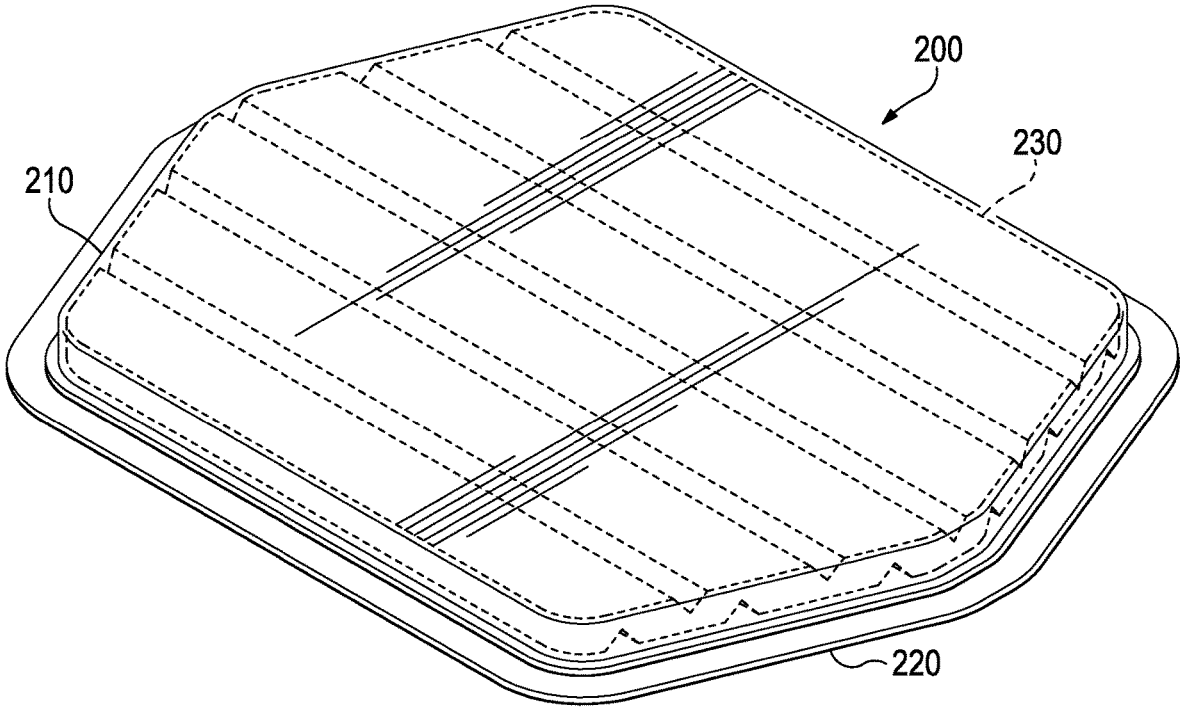
FIG. 6 is a perspective view of a first cushioning element.
Figure 7:
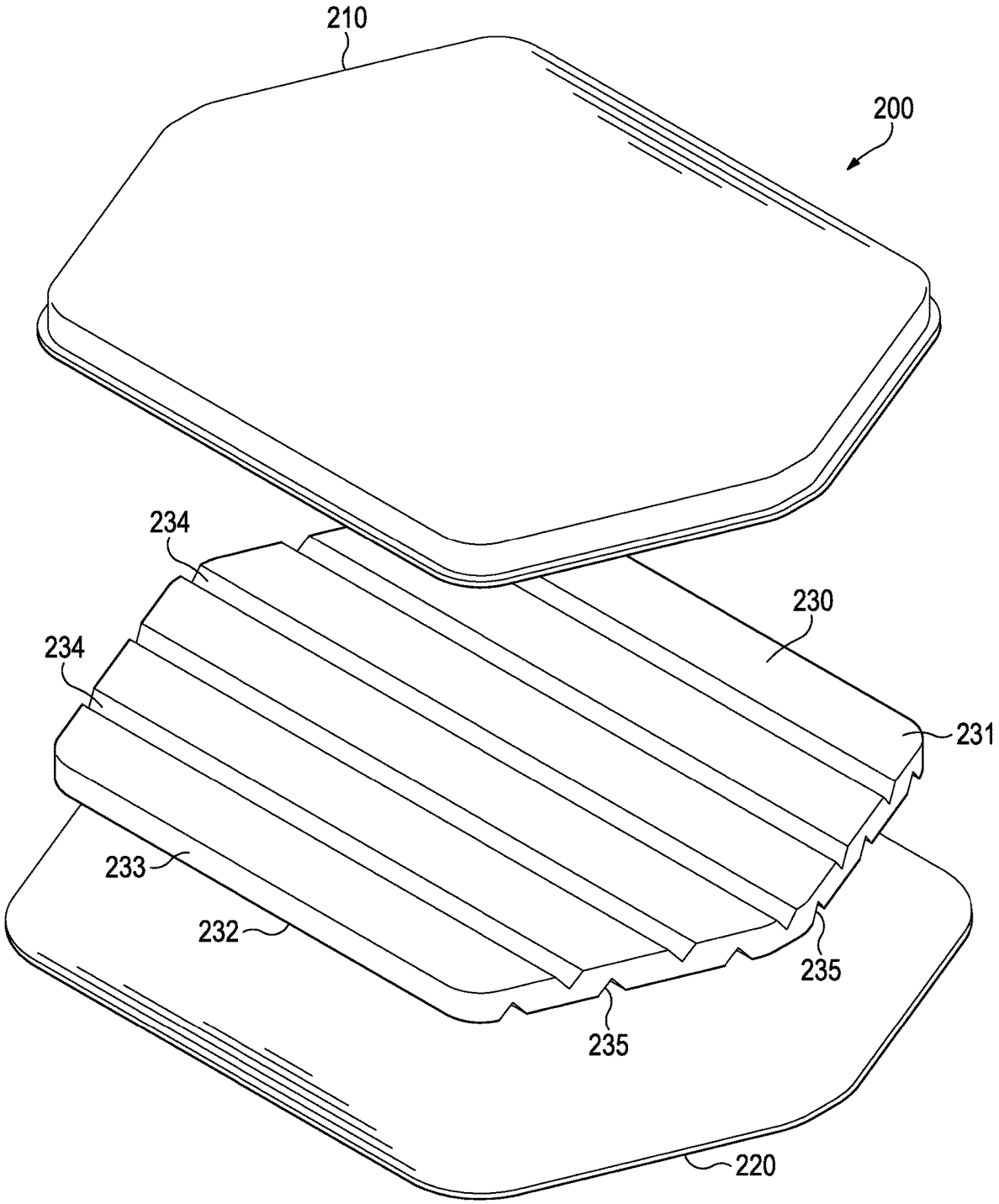
FIG. 7 is an exploded perspective view of the first cushioning element.
Figure 8:
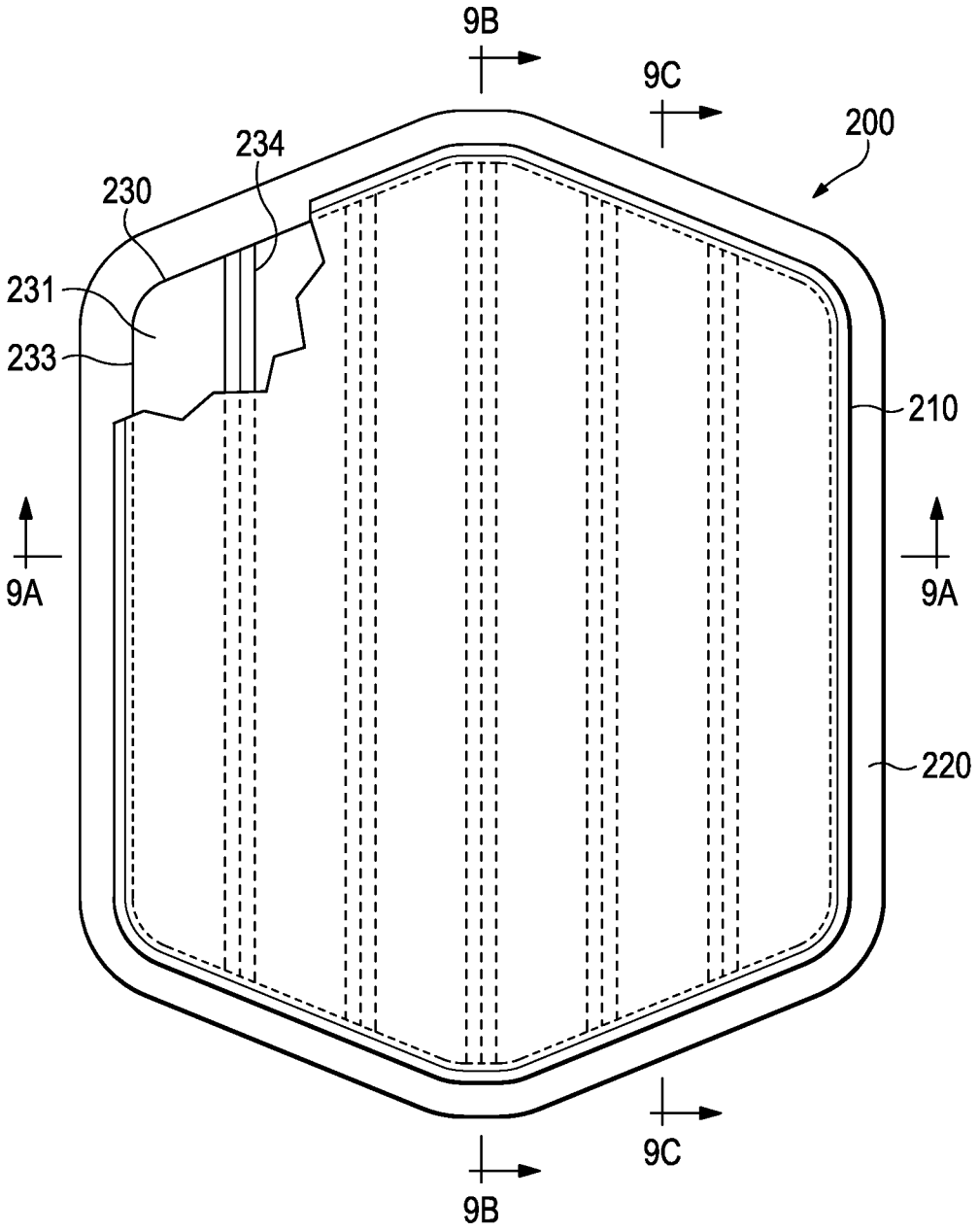
FIG. 8 is a top plan view of the first cushioning element.
Figure 9A:
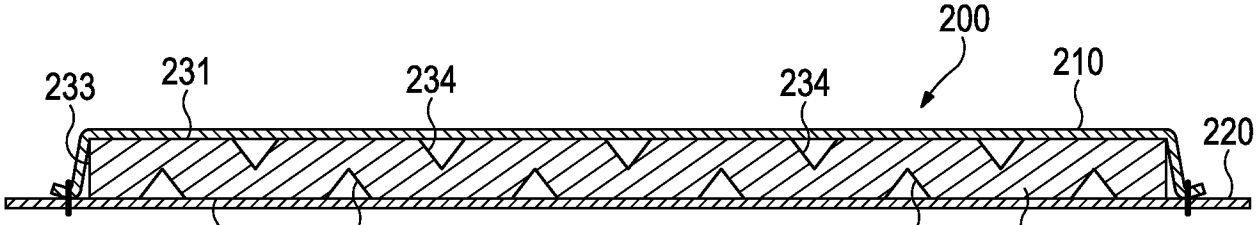
FIGS. 9A-9C are cross-sectional views of the first cushioning element, as defined by section lines 9A-9C in FIG. 8.
Figure 9B:
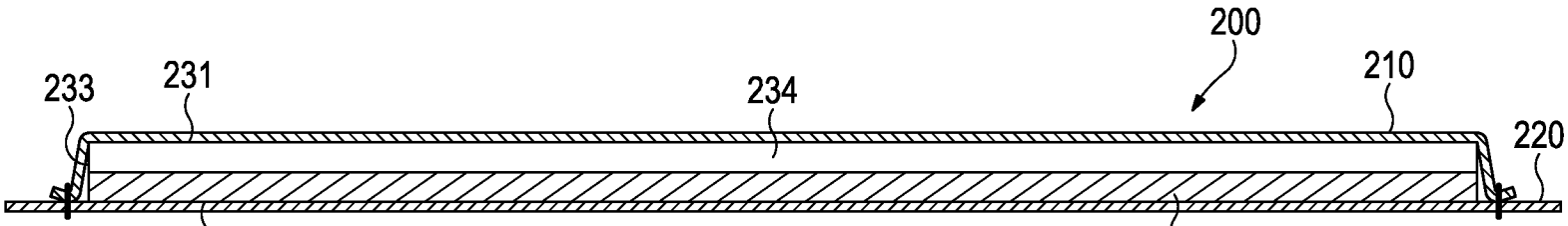
Figure 9C:
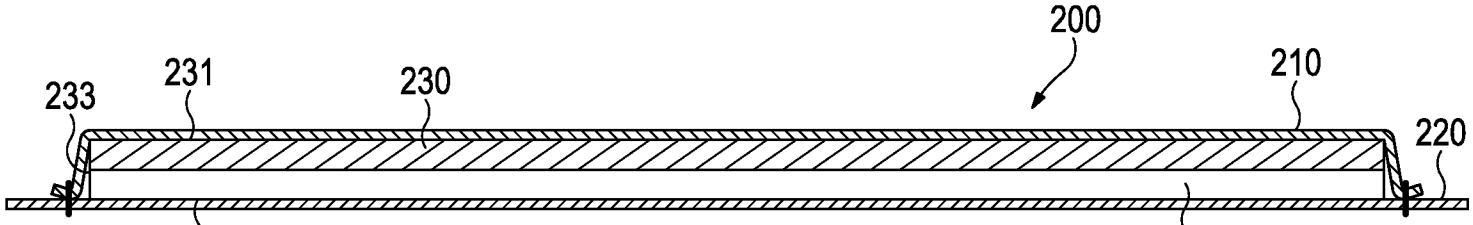

With reference to FIG. 1, a wearer or individual 10 is depicted as wearing an article of apparel 100 with the general configuration of a pair of shorts. Although apparel 100 may be worn under other articles of apparel, apparel 100 may be worn alone, may be exposed, or may be worn over other articles of apparel. Apparel 100 may also be worn in combination with other pieces of equipment (e.g., athletic or protective equipment). Although apparel 100 may be loose-fitting, apparel 100 is depicted as having a relatively tight fit of a compression garment. Accordingly, the configuration of apparel 100 and the manner in which apparel 100 is worn by individual 10 may vary significantly.

Apparel 100 is depicted individually in FIGS. 2-5 as including a pelvic region 101 and a pair of leg regions 102 that extend outward from pelvic region 101. Pelvic region 101 corresponds with a pelvic area of individual 10 and covers at least a portion of the pelvic area when worn. An upper area of pelvic region 101 defines a waist opening 103 that extends around a waist of individual 10 when apparel 100 is worn. Leg regions 102 correspond with a right leg and a left leg of individual 10 and cover at least a portion of the right leg and the left leg when worn. Lower areas of leg regions 102 each define a thigh opening 104 that extends around a thigh of individual 10 when apparel 100 is worn. Additionally, apparel 100 includes an exterior surface 105 that faces away from individual 10 when apparel 100 is worn, and apparel 100 includes an opposite interior surface 106 that faces toward individual 10 and may contact individual 10 when apparel 100 is worn.

A plurality of cushioning elements 200 are incorporated into various areas of apparel 100 to impart padding, cushioning, or otherwise attenuate impact forces. When apparel 100 is worn during athletic activities, for example, cushioning elements 200 may protect individual 10 from contact with other athletes, equipment, or the ground. With regard to apparel 100, cushioning elements 200 are located in both of pelvic region 101 and leg regions 102 and are positioned, more specifically, to protect the hips, thighs, and tailbone of individual 10. As described in greater detail below, cushioning elements 200 may be incorporated into a variety of different articles of apparel, and cushioning elements 200 may be positioned in various areas of the articles of apparel to protect specific portions (e.g., muscles, bones, joints, impact areas) of individual 10. Additionally, the shapes, sizes, and other properties of cushioning elements 200, as well as the materials and components utilized in cushioning elements 200, may vary significantly to provide a particular level of protection to the specific portions of individual 10.

Cushioning Element Configuration

An example configuration for cushioning element 200 is depicted in FIGS. 6-9B as having a generally elongate shape with pointed end areas, which is the shape depicted as being incorporated into apparel 100. Cushioning element 200 includes a first material layer 210, a second material layer 220, and a pad component 230. First material layer 210 and second material layer 220 cooperatively form an outer surface or covering for cushioning element 200. That is, first material layer 210 and second material layer 220 cooperatively form a pocket or void, in which pad component 230 is located. Whereas second material layer 220 is depicted as having a generally planar configuration, first material layer 210 extends over pad component 230 and also along sides of pad component 230 to join with second material layer 220 (e.g., through stitching, adhesive bonding, or thermal bonding). Although cushioning element 200 may be incorporated into apparel 100 in a variety of ways, first material layer 210 may be positioned exterior of second material element 220, such that cushioning element 200 protrudes outward from apparel 100. Alternately, second material layer 220 may be positioned exterior of first material element 210, such that cushioning element 200 protrudes inwardly.

Whereas first material layer 210 has a shape that covers pad component 230, second material layer 220 may have a larger size that forms additional portions of apparel 100. For example, second material layer 220 may extend into both pelvic region 101 and one of leg regions 102. That is, second material layer 220 may form one surface of cushioning element 200 and extend to other areas apparel 100 to form a covering for individual 10. In this configuration, first material layer 210 forms a portion of exterior surface 105, whereas second material layer 220 forms a portion of both exterior surface 105 and interior surface 106. More particularly, a portion of second material layer 220 that is secured to pad component 230 is located inward of first material layer 210 and forms a portion of interior surface 106. Another portion of second material layer 220 that is spaced from pad component 230 forms a portion of exterior surface 105, as well as interior surface 106. As such, second material layer 220 forms both a portion of a covering for pad component 230 and other portions of apparel 100.

A variety of materials may be utilized for first material layer 210 and second material layer 220, including various textiles, polymer sheets, leather, or synthetic leather, for example. Combinations of these materials (e.g., a polymer sheet bonded to a textile) may also be utilized for each of material layers 210 and 220. Although material layers 210 and 220 may be formed from the same material, each of material layers 210 and 220 may also be formed from different materials. With regard to textiles, material layers 210 and 220 may be formed from knitted, woven, non-woven, spacer, or mesh textile components that include rayon, nylon, polyester, polyacrylic, elastane, cotton, wool, or silk, for example. Moreover, the textiles may be non-stretch, may exhibit stretch in one direction, or may exhibit multi-directional stretch. Accordingly, a variety of materials are suitable for first material layer 210 and second material layer 220.

Pad component 230 is located between and secured to each of material layers 210 and 220. More particularly, pad component 230 has a first surface 231 secured to first material layer 210, an opposite second surface 232 secured to second material layer 220, and a side surface 233 that extends between surfaces 231 and 232. First surface 231 defines a plurality of first grooves 234 that extend throughout a length of pad component 230 and toward second surface 232. Similarly, second surface 232 defines a plurality of second grooves 235 that extend throughout the length of pad component 230 and toward first surface 231. First grooves 234 are aligned with second grooves 235. As utilized herein, "aligned" is defined as extending in a common direction and includes (a) parallel configurations for grooves 234 and 235 and (b) non-parallel configurations for grooves 234 and 235 that are offset between zero and thirty degrees. As such, when grooves 234 and 235 are aligned, they are generally oriented extend in the same direction. Additionally, grooves 234 and 235 are offset from each other. That is, first grooves 234 are located in areas of pad component 230 that are between areas where second grooves 235 are located. Moreover, each of grooves 234 and 235 are depicted as having a triangular, V-shaped, angled, or pointed configuration. Although pad component 230 is secured to material layers 210 and 220, one or both of surfaces 231 and 232 may also be unsecured to material layers 210 and 220. In either configuration, surfaces 231 and 232 generally face toward material layers 210 and 220.

Although features of pad component 230 and grooves 234 and 235 may vary considerably, as discussed in greater detail below, some examples of suitable configurations are discussed here. For example, pad component 230 may have a thickness (i.e., distance between surfaces 231 and 232) of ten millimeters. Given this thickness, grooves 234 and 235 may have a width of five millimeters and a depth of five millimeters. As such, grooves 234 and 235 may extend through approximately fifty percent of a thickness of pad component 230. Moreover, grooves 234 and 235 may be spaced by twenty millimeters. An advantage to the various dimensions discussed above relates to imparting a suitable degree flex, stretch, and breathability to cushioning element 200, as discussed below. These dimensions and percentages, however, are intended to merely be examples, and the dimensions and percentages may vary considerably from the specific numbers identified above.

A variety of materials may be utilized for pad component 230, including various polymer foam materials that return to an original shape after being compressed. Examples of suitable polymer foam materials for pad component 230 include polyurethane, ethylvinylacetate, polyester, polypropylene, and polyethylene foams. Moreover, both thermoplastic and thermoset polymer foam materials may be utilized. In some configurations of cushioning element 200, pad component 230 may be formed from a polymer foam material with a varying density, or solid polymer or rubber materials may be utilized. Fluid-filled chambers may also be utilized as pad component 230. Also, different pad component 230 may be formed from different materials, or may be formed from similar materials with different densities. As discussed in greater detail below, the polymer foam materials forming pad component 230 attenuate impact forces to provide cushioning or protection. By selecting thicknesses, materials, and densities for each of the various pad component 230, the degree of impact force attenuation may be varied throughout apparel 100 to impart a desired degree of cushioning or protection.

The compressible polymer foam materials forming pad component 230 attenuate impact forces that compress or otherwise contact cushioning element 200. When incorporated into apparel 100 or another article of apparel, for example, the polymer foam materials of pad component 230 may compress to protect a wearer from contact with other athletes, equipment, or the ground. Accordingly, cushioning element 200 may be utilized to provide cushioning or protection to areas of individual 10 or other wearers that are covered by cushioning element 200.

Figure 10A:
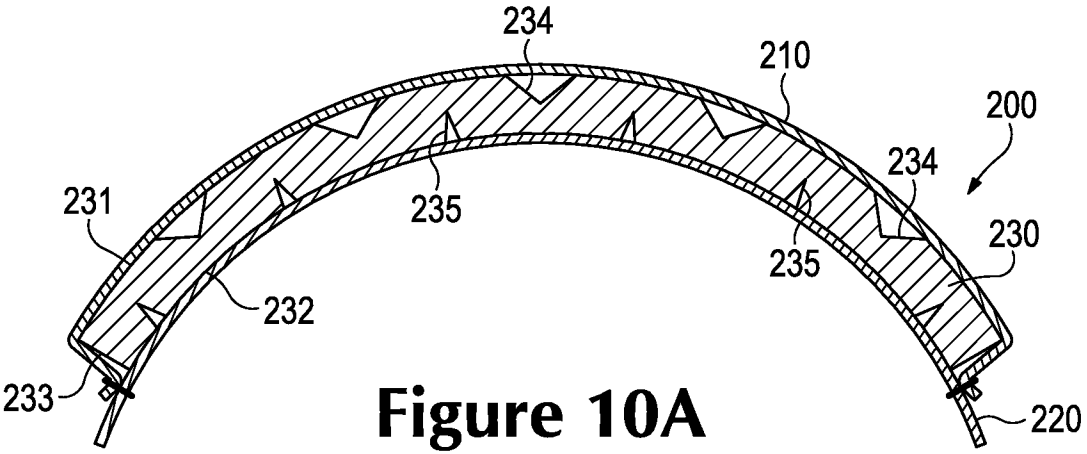
FIG. 10A is a cross-sectional view corresponding with FIG. 9A and depicting the first cushioning element in a flexed configuration.
Figure 10B:
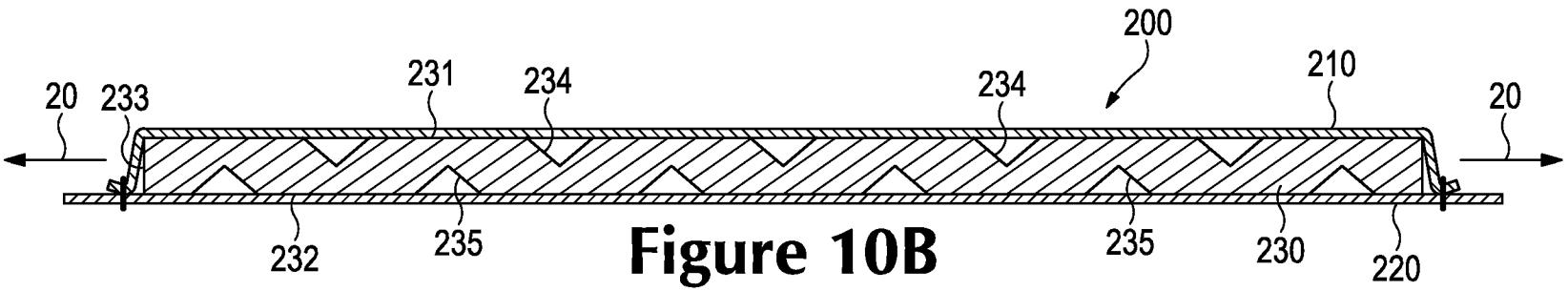
FIG. 10B is a cross-sectional view corresponding with FIG. 9A and depicting the first cushioning element in a stretched configuration.
Figure 10C:
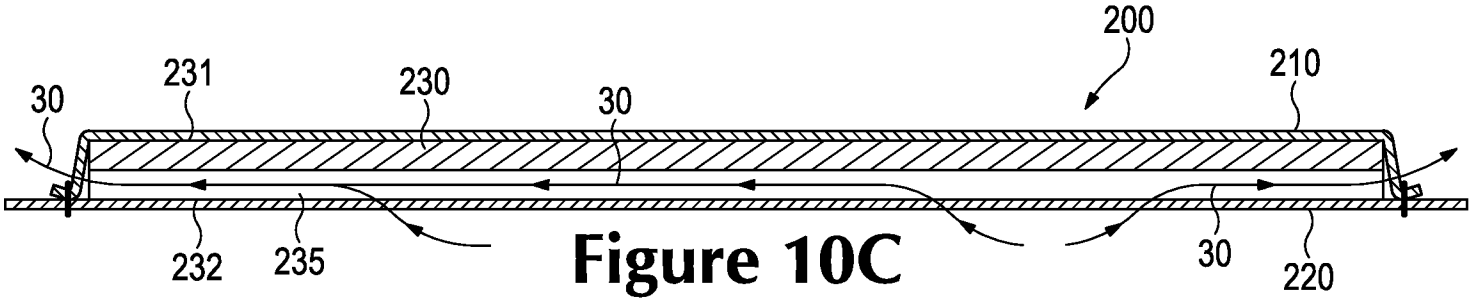
FIG. 10C is a cross-sectional view corresponding with FIG. 9C and depicting breathability of the first cushioning element.

In addition to attenuating impact forces, cushioning element 200 has an advantage of simultaneously providing one or more of flex, stretch, breathability, relatively low overall mass, and launderability. Referring to FIG. 10A, cushioning element 200 is depicted as being flexed. In this configuration, first grooves 234 effectively expand and second grooves 235 effectively collapse to impart flexibility. Referring to FIG. 10B, cushioning element 200 is depicted as being stretched by a force 20. In this configuration, the offset structure of grooves 234 and 235 permits pad component 230 to flatten or otherwise elongate due to the effects of force 20. An advantage to flex and stretch is that cushioning element 200 may better conform with contours of individual 10, and cushioning element 200 may expand, collapse, flatten, and elongate to facilitate movements of individual 10, while still conforming with the contours of individual 10 during the movements. Additionally, individual 10 may generate excess heat and perspire when wearing apparel 100 and engaging in athletic activities. Referring to FIG. 10C, the breathability of cushioning element 200 is depicted by various paths 30, along which heat and moisture may pass to exit cushioning element 200. The heat and moisture from individual 10 may, therefore, (a) pass through second material layer 220, (b) enter one of second grooves 235, (c) move to end areas of second groove 235, and (d) pass through first material layer 210, thereby exiting apparel 100. Furthermore, the materials and structure discussed above for cushioning element 200 (a) imparts a relatively low overall mass that does not add significant weight to individual 10 during the athletic activities and (b) permits laundering without significant shrinkage or warping, even when temperatures associated with commercial laundering processes are utilized. Accordingly, cushioning element 200 may simultaneously provide impact force attenuation, flex, stretch, breathability, relatively low overall mass, and launderability.

Manufacturing Process

Figure 11:
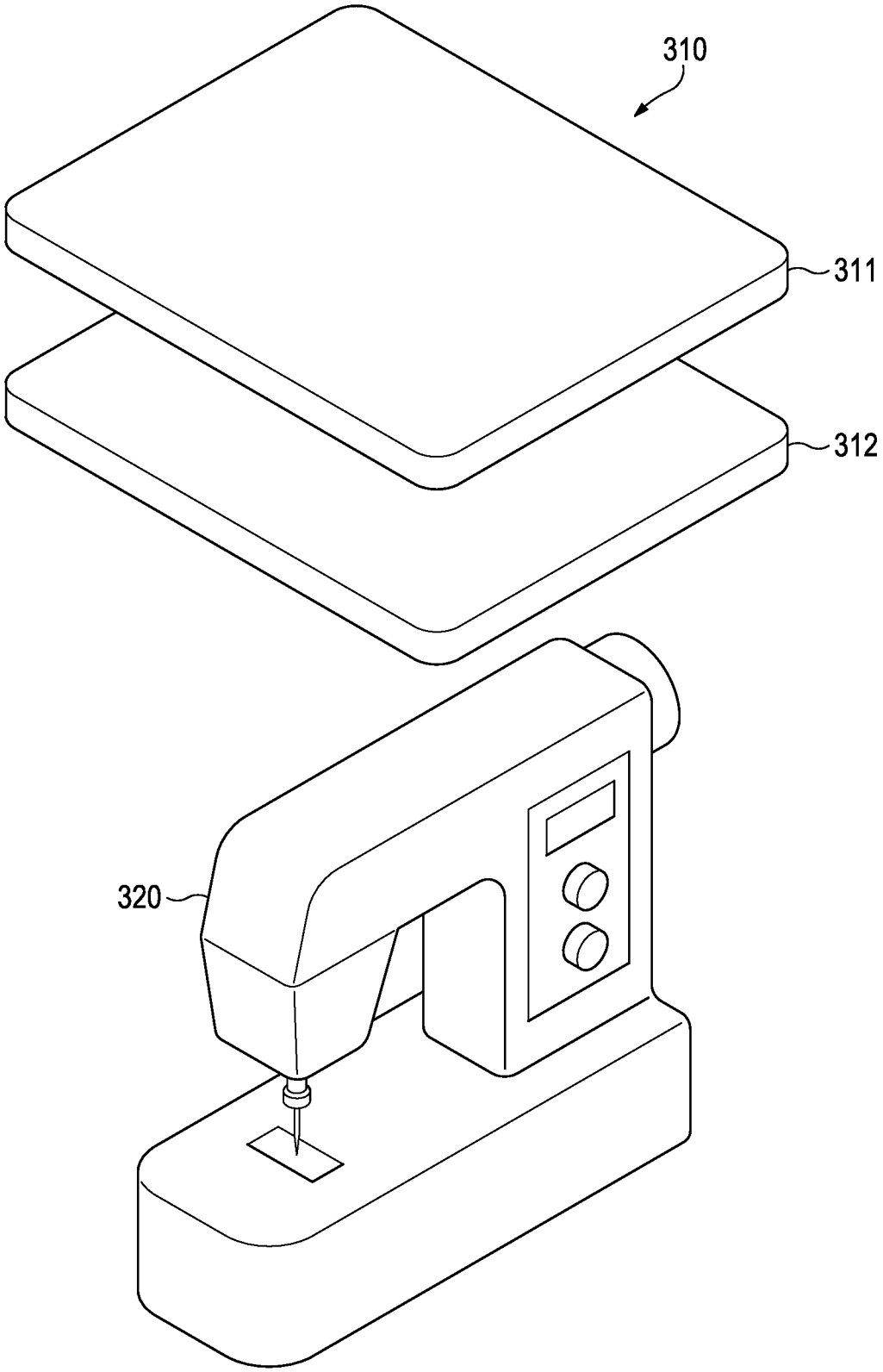
FIG. 11 is a perspective view of portions of a manufacturing apparatus utilized in a manufacturing process for the first cushioning element.

A variety of techniques may be utilized to manufacture cushioning element 200. With reference to FIG. 11, a manufacturing apparatus 300 is disclosed as including a press 310 and a sewing machine 320. Other elements, such as a mold, router, die cutter, or laser may also be utilized, but are not depicted here. A variety of other manufacturing apparatuses that operate in a similar manner may also be utilized. Accordingly, manufacturing apparatus 300 is only intended to provide an example of a manufacturing apparatus for the production of cushioning element 200.

Initially, the various components of cushioning element 200 are cut, shaped, or otherwise prepared. For example, material layers 210 and 220 may be cut to a particular shape using die cutting, laser cutting, or hand cutting processes. Whereas first material layer 210 has a shape that covers pad component 230 and extends alongside surface 233, second material layer 220 may have a larger size that forms additional portions of apparel 100. For example, second material layer 220 may extend into both pelvic region 101 and one of leg regions 102. That is, second material layer 220 may form one surface of cushioning element 200 and extend to other areas apparel 100 to form a covering for individual 10. Various processes may also be utilized to form pad component 230. For example, polymer resin with a blowing agent may be located in a mold having the shape of pad component 230. An advantage to this process is that a single process may be used to form the polymer foam material of pad component 230, as well as the various grooves 234 and 235.

As another example, a preformed layer of polymer foam may be obtained, and a router may be used to form grooves 234 and 235. In other processes, grooves 234 and 235 may be formed from a heated element that presses into a preformed layer of polymer foam, or a computer-controlled machine tool may be utilized. As yet further examples, a three-dimensional printer may be utilized to form pad component 230, or a polymer foam element having grooves 234 and 235 may be extruded and then cut to the shape of pad component 230.

Figure 12A:
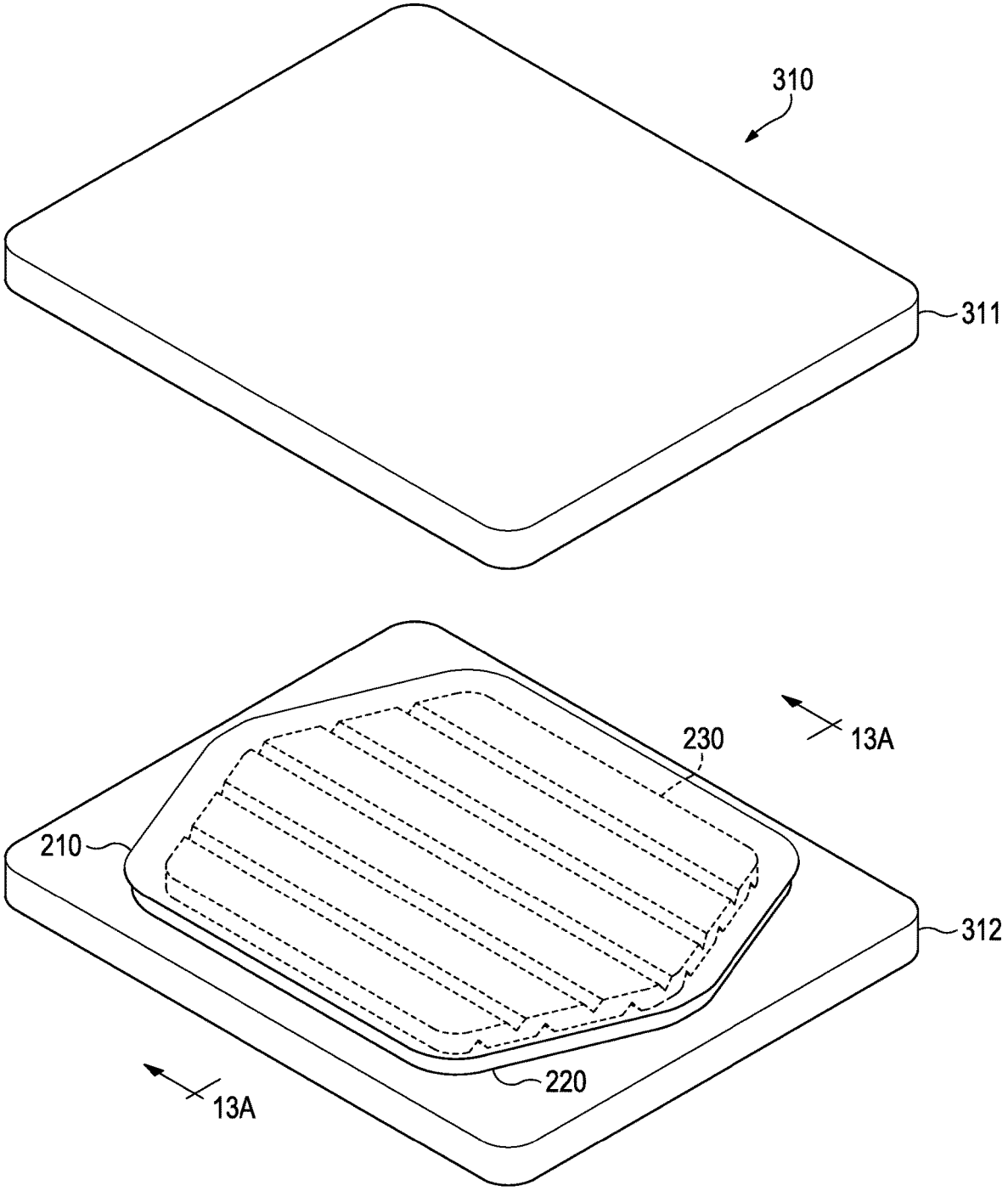
FIGS. 12A-12D are schematic perspective views of the manufacturing process.
Figure 12B:
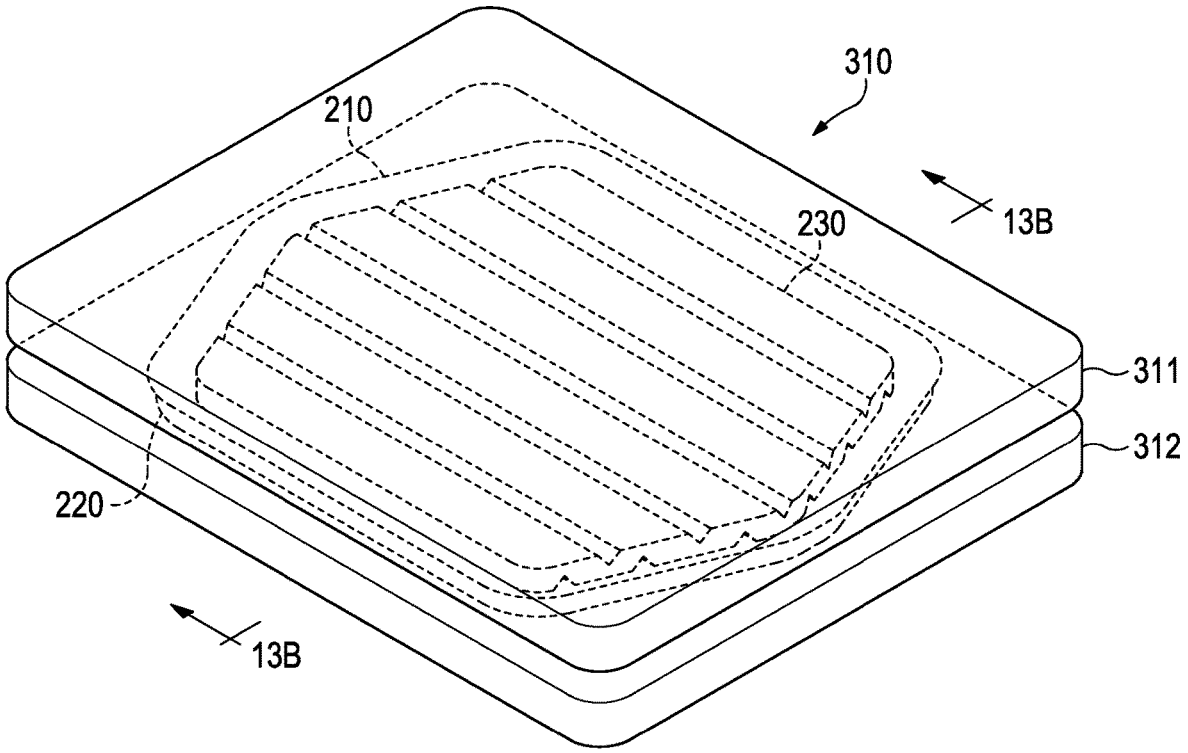
Figure 13A:
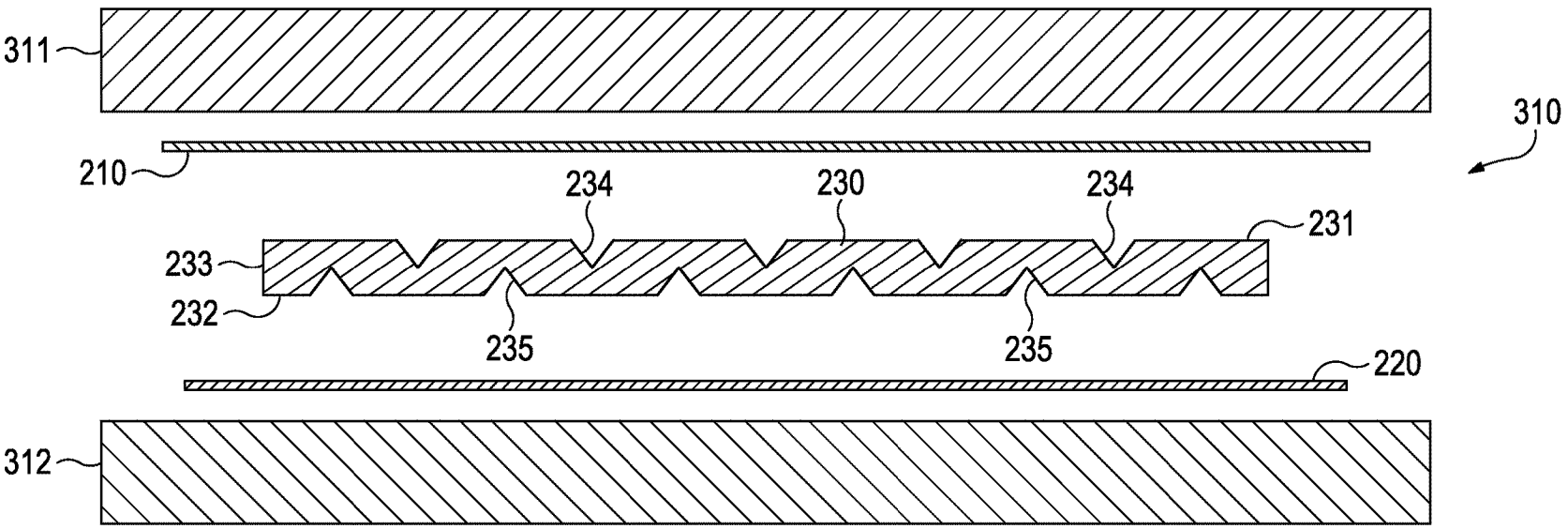
FIGS. 13A-13D are schematic cross-sectional views of the manufacturing process, as respectively defined by section lines 13A-13D in FIGS. 12A-12D.
Figure 13B:
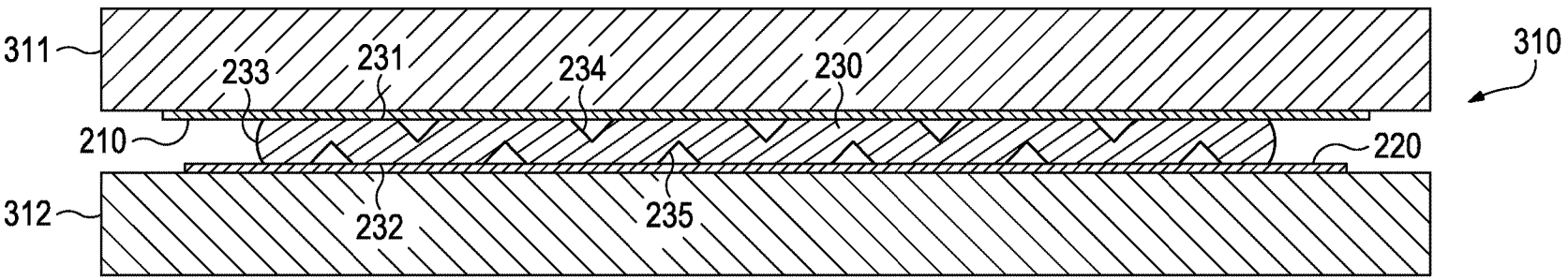

Once the various components of cushioning element 200 are cut, shaped, or otherwise prepared, the components may be placed between two platens 311 and 312 of press 310, as depicted in FIGS. 12A and 13A. More particularly, first material layer 210 may be located adjacent to platen 311, second material layer 220 may be located adjacent to platen 312, and pad component 230 may be located between layers 210 and 220. Following proper positioning, platens 311 and 312 close upon and compress first material layer 210, second material layer 220, and pad component 230, as depicted in FIGS. 12B and 13B. More particularly, platen 311 compresses first material layer 210 against first surface 231 of pad component 230, and platen 312 compresses second material layer 220 against second surface 232 of pad component 230.

Platens 311 and 312 effectively compress pad component 230 between material layers 210 and 220 to ensure bonding. As an example, an adhesive may be utilized to bond pad component 230 to each of material layers 210 and 220. At prior stages of the manufacturing process, an adhesive may be applied to either (a) areas of material layers 210 and 220 that are intended to bond with pad components 230 or (b) surfaces 231 and 232 of pad component 230. Although the adhesive may be applied to material layers 210 and 220, an advantage of applying the adhesive to surfaces 231 and 232 is that the adhesive is absent from areas of material layers 210 and 220 that are not intended to bond with pad component 230. As another example, heat may be utilized to bond pad component 230 to each of material layers 210 and 220. In configurations where pad component 230 is formed from a thermoplastic polymer foam material, heating and melting of pad component 230 at surfaces 231 and 232 may be utilized to bond pad component 230 to each of material layers 210 and 220. Similarly, material layers 210 and 220 may also incorporate a thermoplastic polymer material, or a thermoplastic bonding agent or thermally-activated adhesive may be utilized. In order to elevate the temperatures, various radiant heaters, radio frequency emitters, or other devices may be utilized. Alternately, press 310 may be heated such that contact with platens 311 and 312 raises the temperature of pad component 230 to a level that facilitates bonding.

One consideration at this stage of the manufacturing process relates to the method by which an adhesive, thermoplastic polymer material, or a thermoplastic bonding agent is applied to the components of cushioning element 200. As noted above, an advantage of applying an adhesive to surfaces 231 and 232 is that the adhesive is absent from areas of material layers 210 and 220 that are not intended to bond with pad component 230. A similar advantage applies to a thermoplastic polymer material or thermoplastic bonding agent. Moreover, applying the adhesive, thermoplastic polymer material, or thermoplastic bonding agent to surfaces 231 and 232 prior to the formation of grooves 234 and 235 may ensure that the bonding materials are absent from grooves 234 and 235. For example, when thermoplastic polymer sheets are utilized as the bonding material, the thermoplastic polymer sheets may be bonded or secured to opposite sides of a polymer foam member (i.e., the polymer foam member that forms pad component 230). Then, grooves 234 and 235 may be formed using a router or other process, which effectively removes portions of the thermoplastic polymer sheets located at grooves 234 and 235. As such, the thermoplastic polymer sheets are absent from grooves 234 and 235 and effectively limited to the areas of surfaces 231 and 232 that bond with layers 210 and 220. Accordingly, by selecting a particular order for the manner in which components of cushioning element 200 are applied, excess materials that may form unintended bonds or detract from the aesthetic properties of cushioning element 200 may be avoided.

Figure 12C:
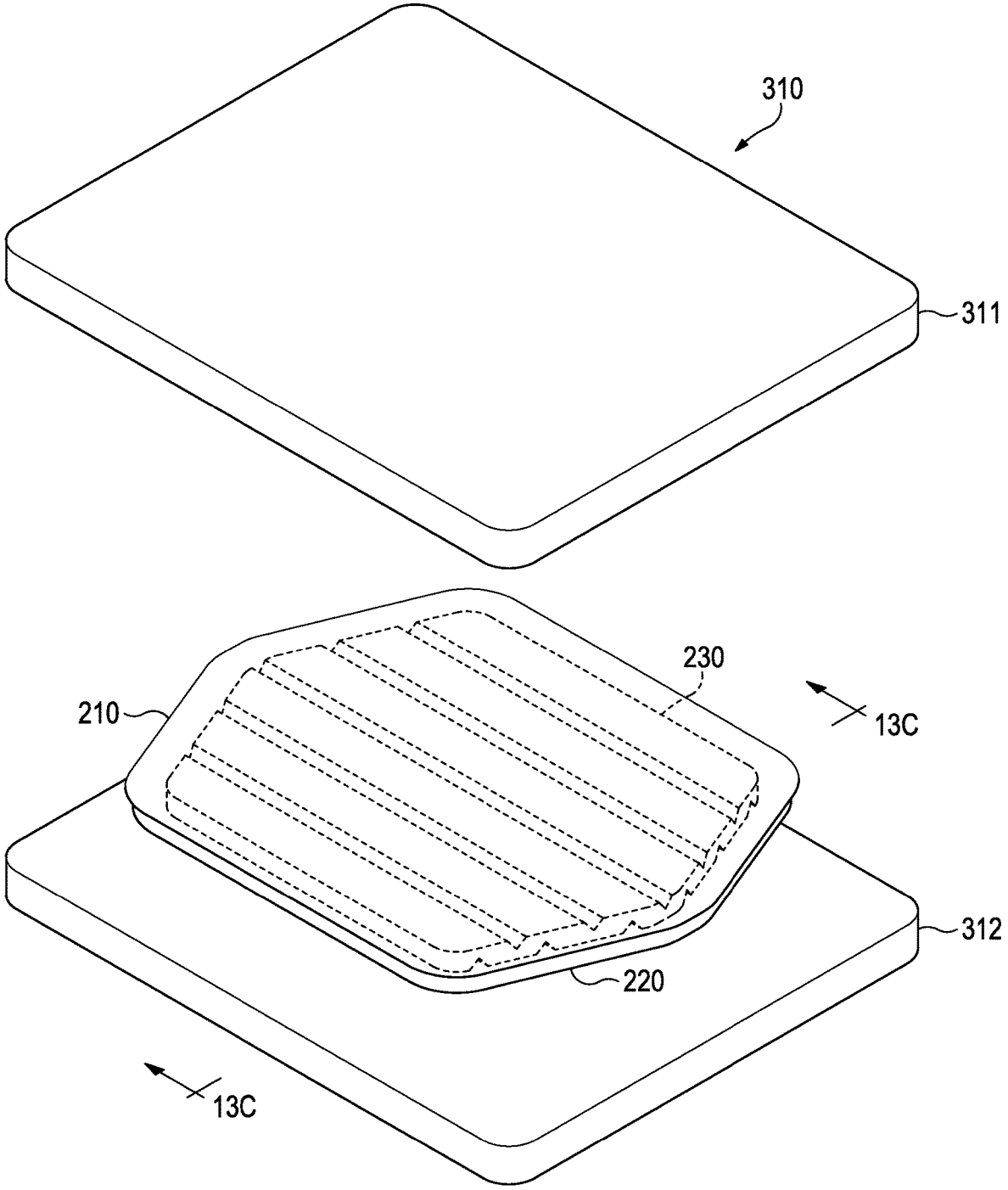
Figure 12D:
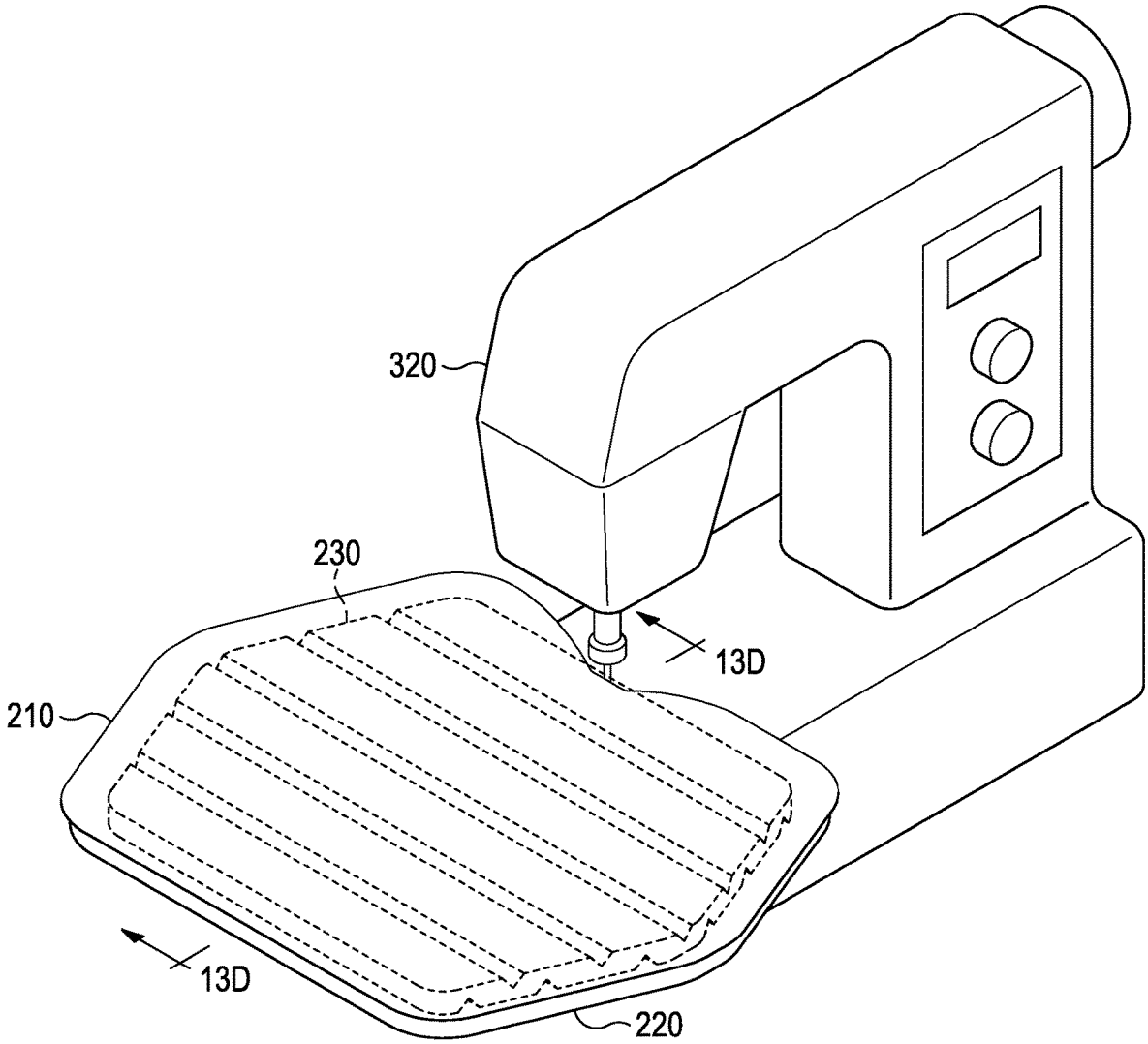
Figure 13C:
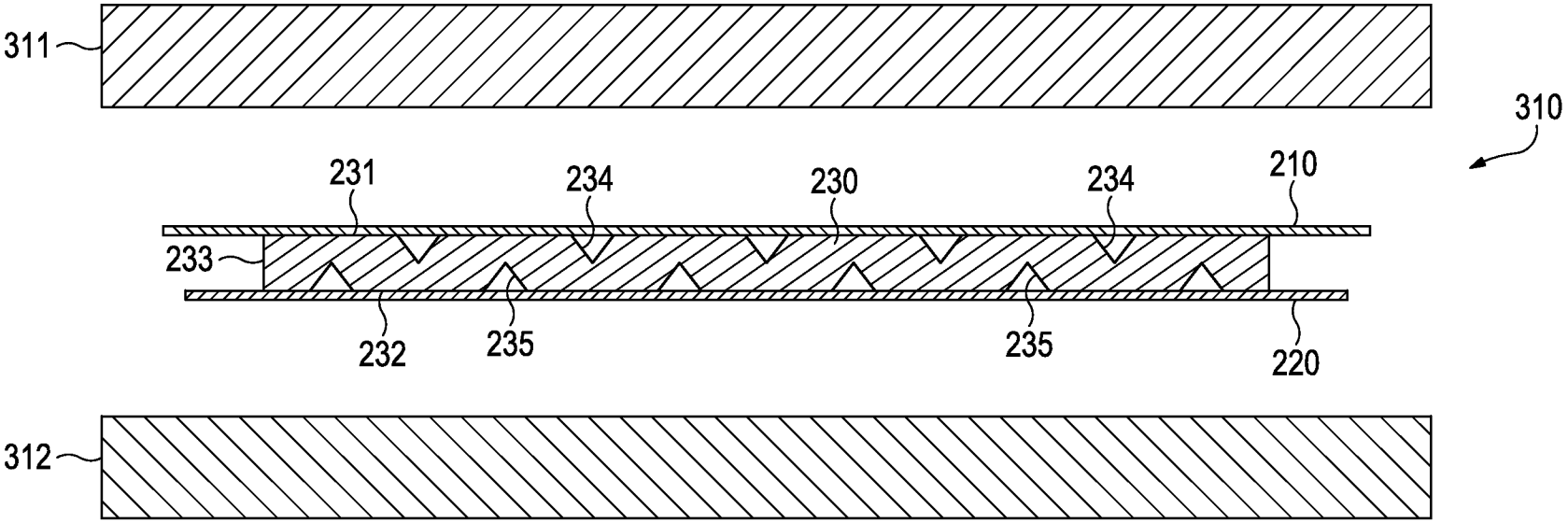
Figure 13D:
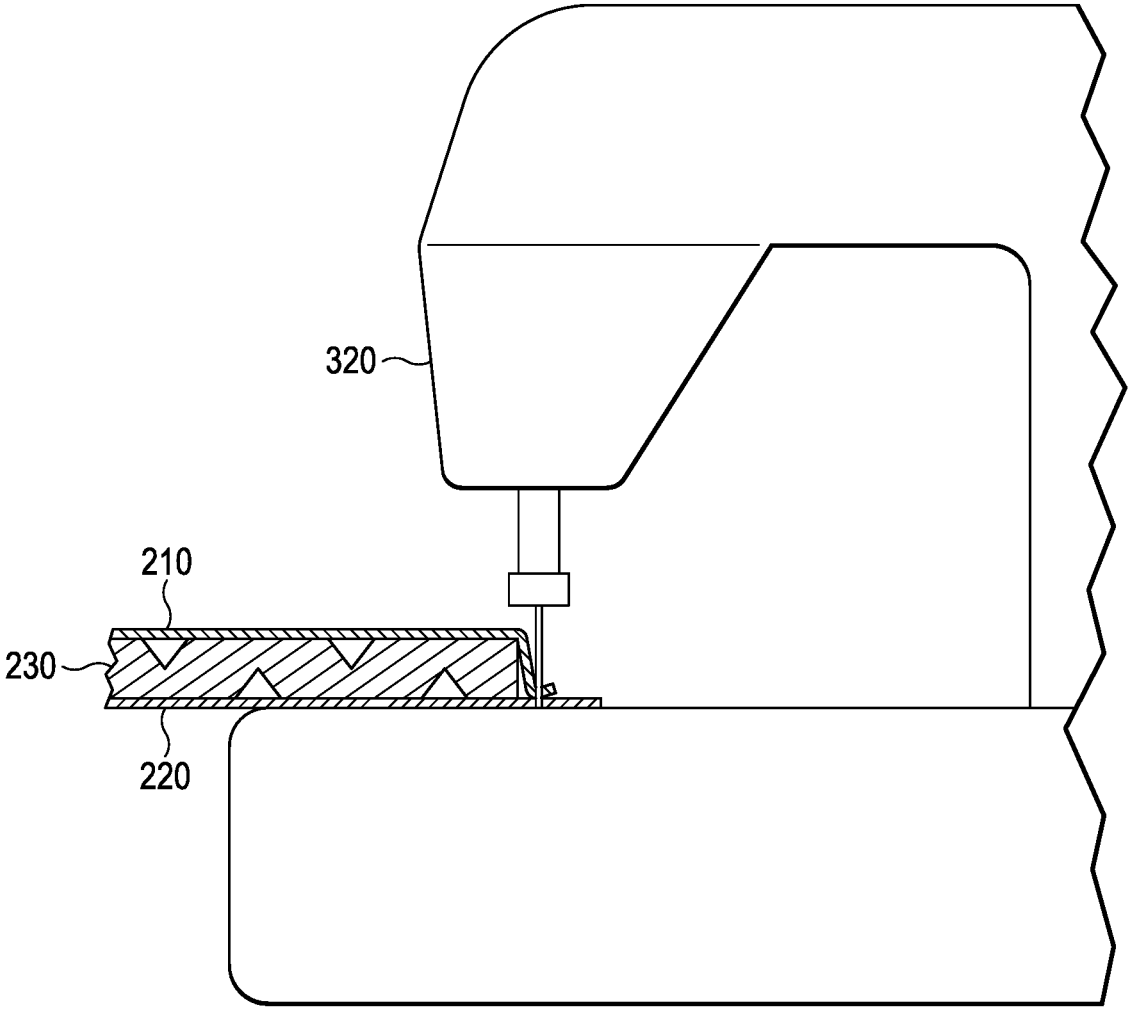

Following compression and bonding, platens 311 and 312 separate to expose the components of cushioning element 200, as depicted in FIGS. 12C and 13C. At this stage of the manufacturing process, first material layer 210 is unsecured to second material layer 220. Additional stitching, adhesive, or thermal bonding steps may now be utilized to join material layers 210 and 220 around the periphery of pad components 230. As an example, sewing machine 320 may be utilized to stitch material layers 210 and 220 together, as depicted in FIGS. 12D and 13D, thereby substantially completing the manufacture of cushioning element 200.

Further Cushioning Element Configurations

Aspects of cushioning element 200 may vary, depending upon the intended use for cushioning element 200 and the product in which cushioning element 200 is incorporated. Moreover, changes to the dimensions, shapes, and materials utilized within cushioning element 200 may vary the overall properties of cushioning element 200. That is, by changing the dimensions, shapes, and materials utilized within cushioning element 200, the compressibility, impact force attenuation, flex, stretch, breathability, and overall mass of cushioning element 200 may be tailored to specific purposes or products. A plurality of variations for cushioning element 200 are discussed below. Any of these variations, as well as combinations of these variations, may be utilized to tailor the properties of cushioning element 200 to an intended use. Moreover, any of these variations may be manufactured through the process or variations of the process discussed above.

Figure 14A:
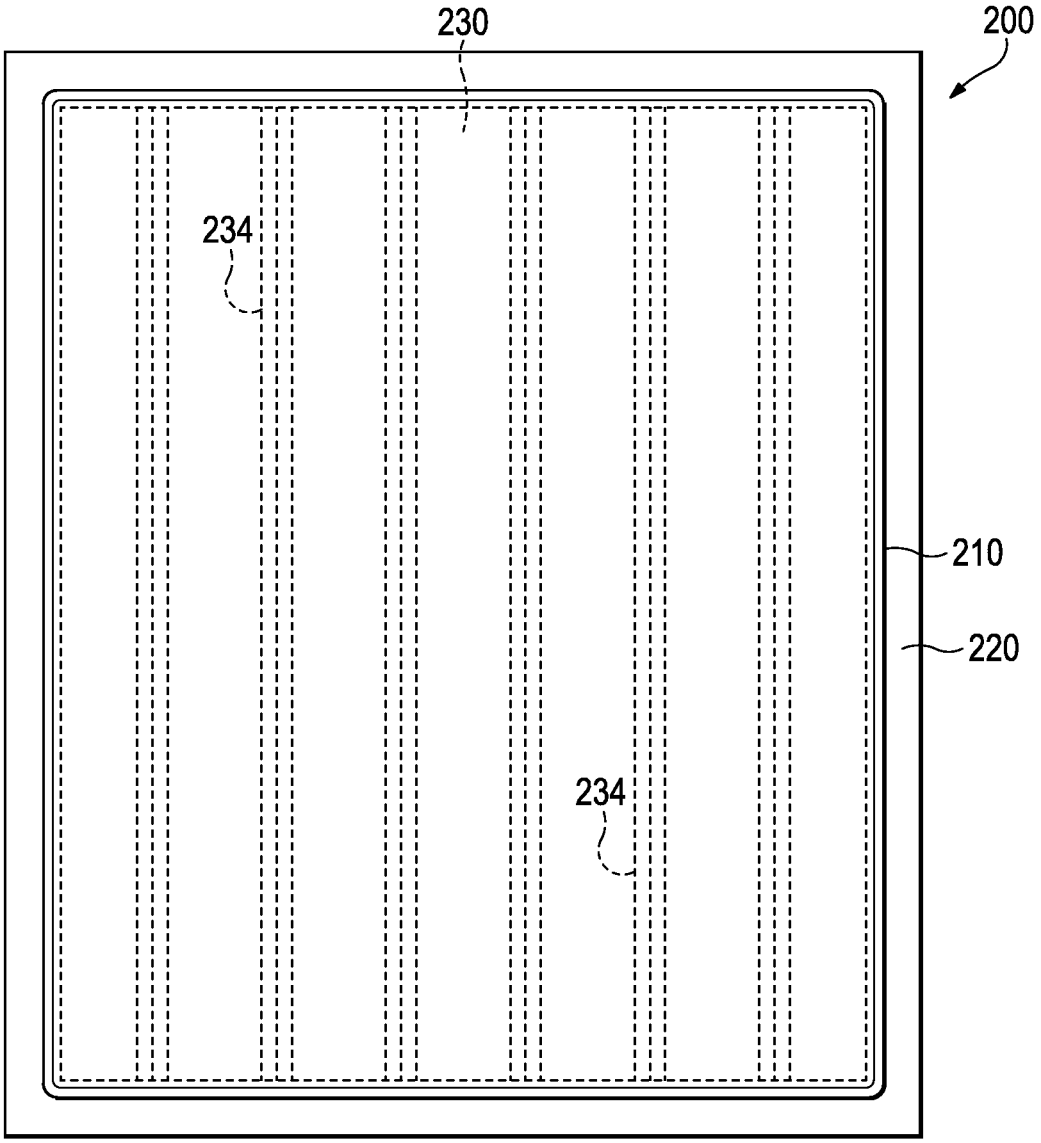
FIGS. 14A-14K are top plan views corresponding with FIG. 8 and depicting further configurations of the first cushioning element.
Figure 14B:
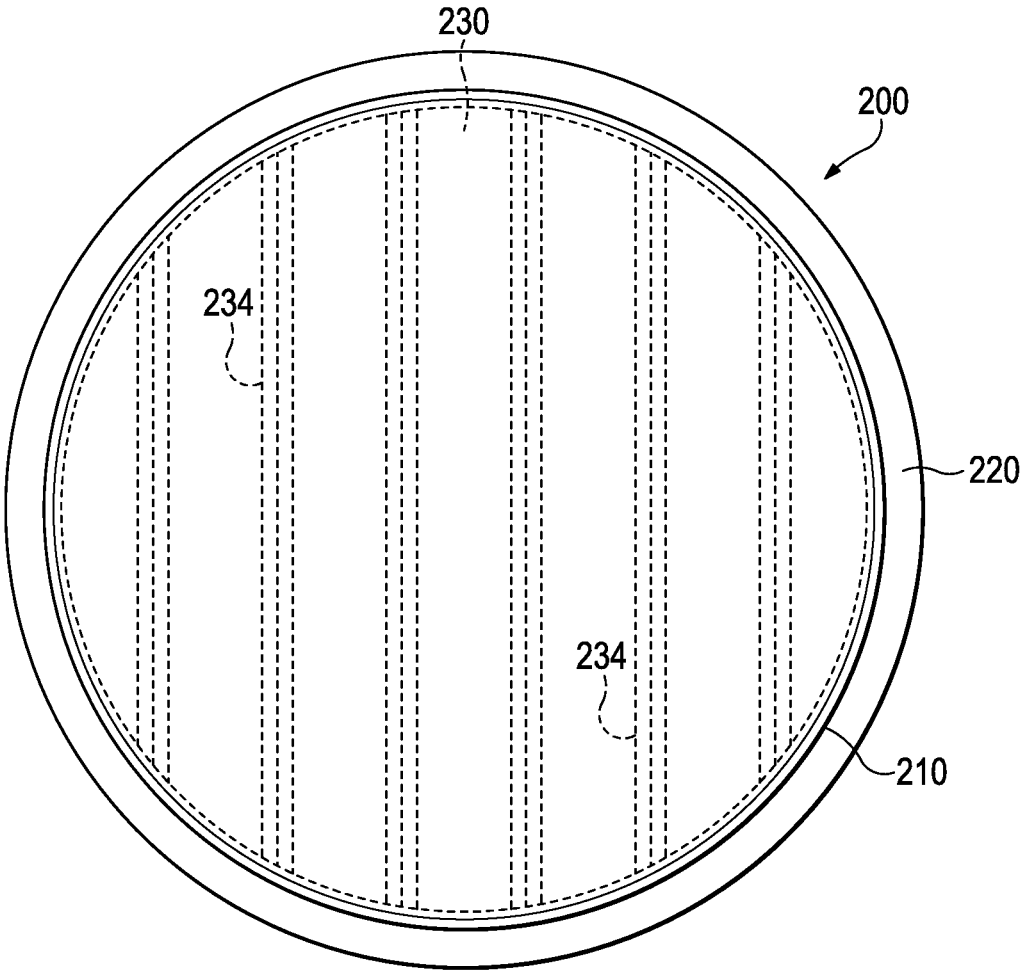
Figure 14C:
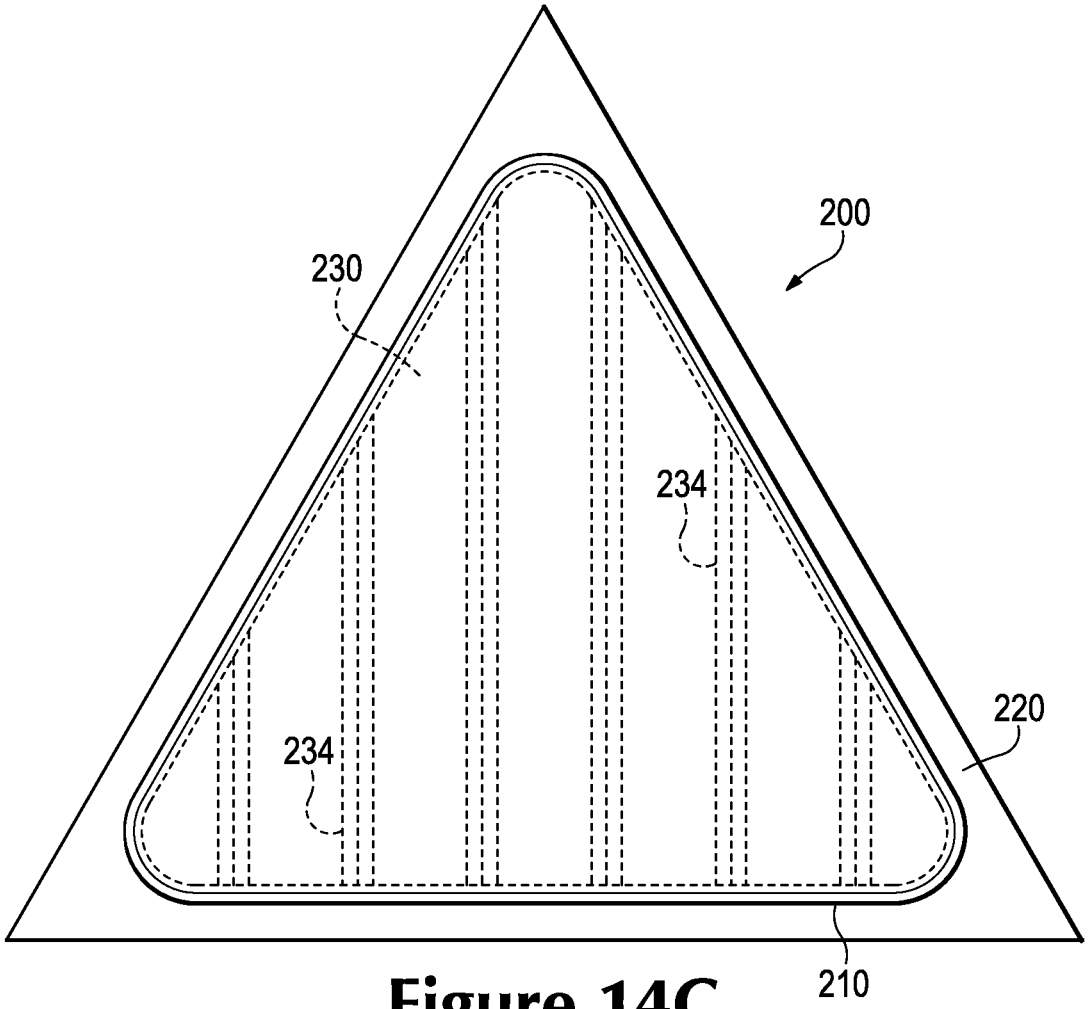
Figure 14D:
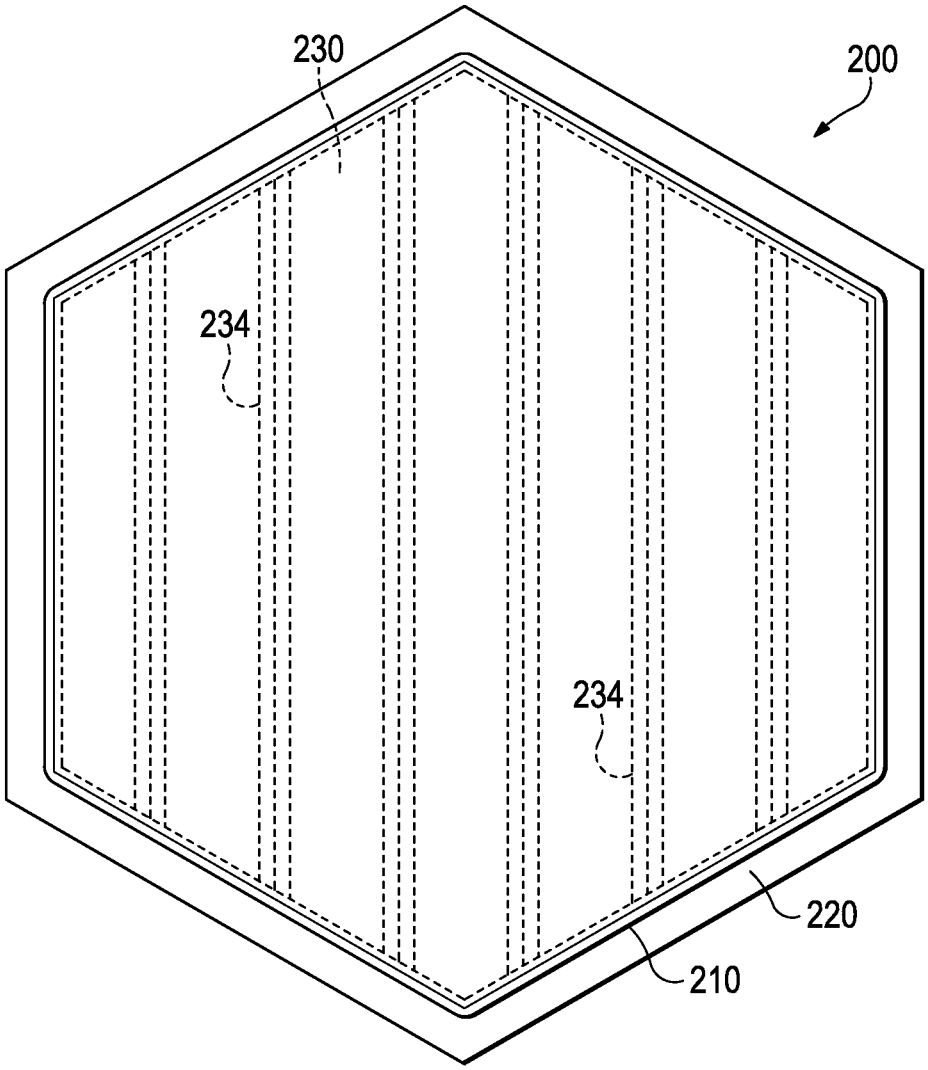
Figure 14E:
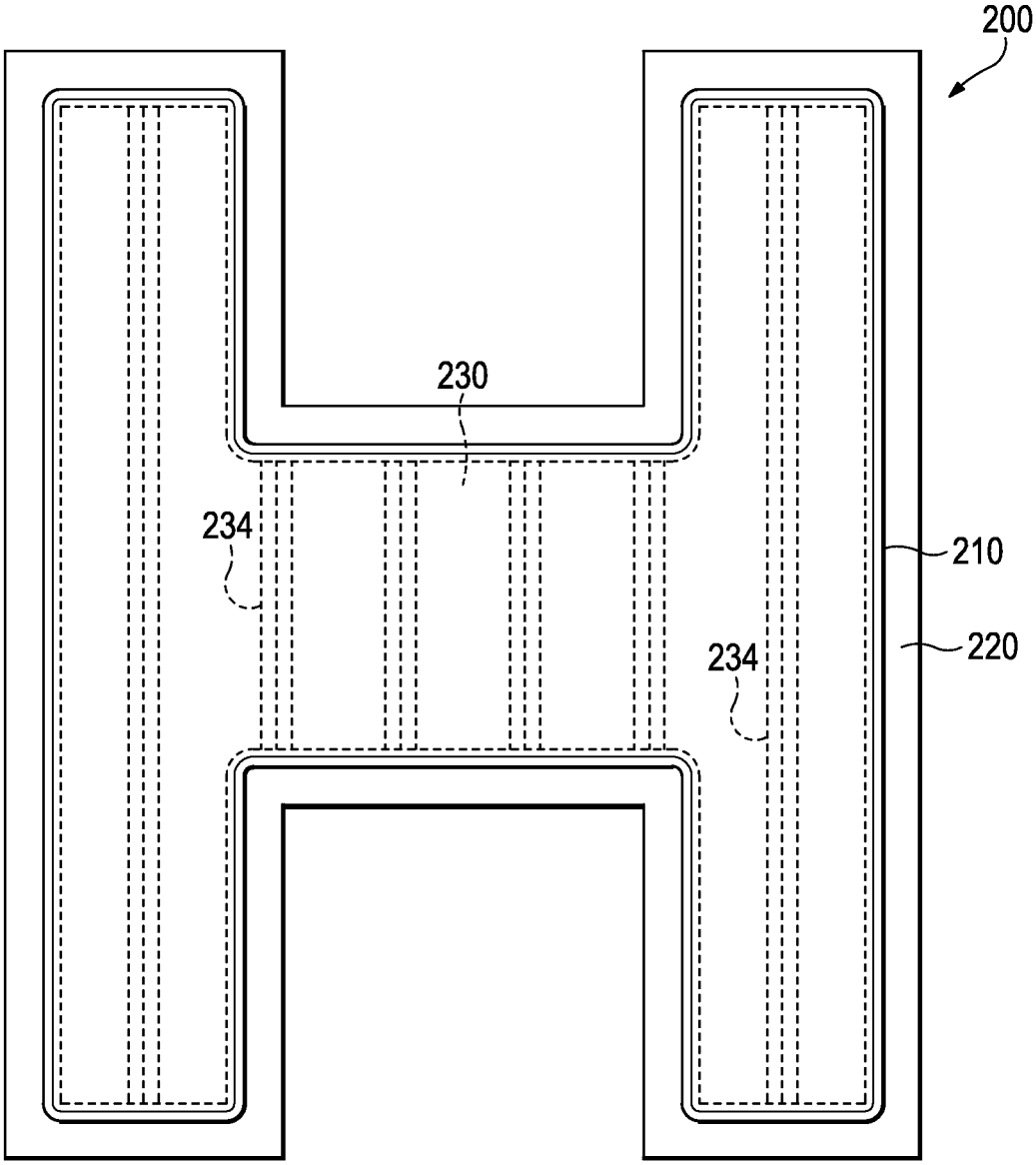
Figure 14F:
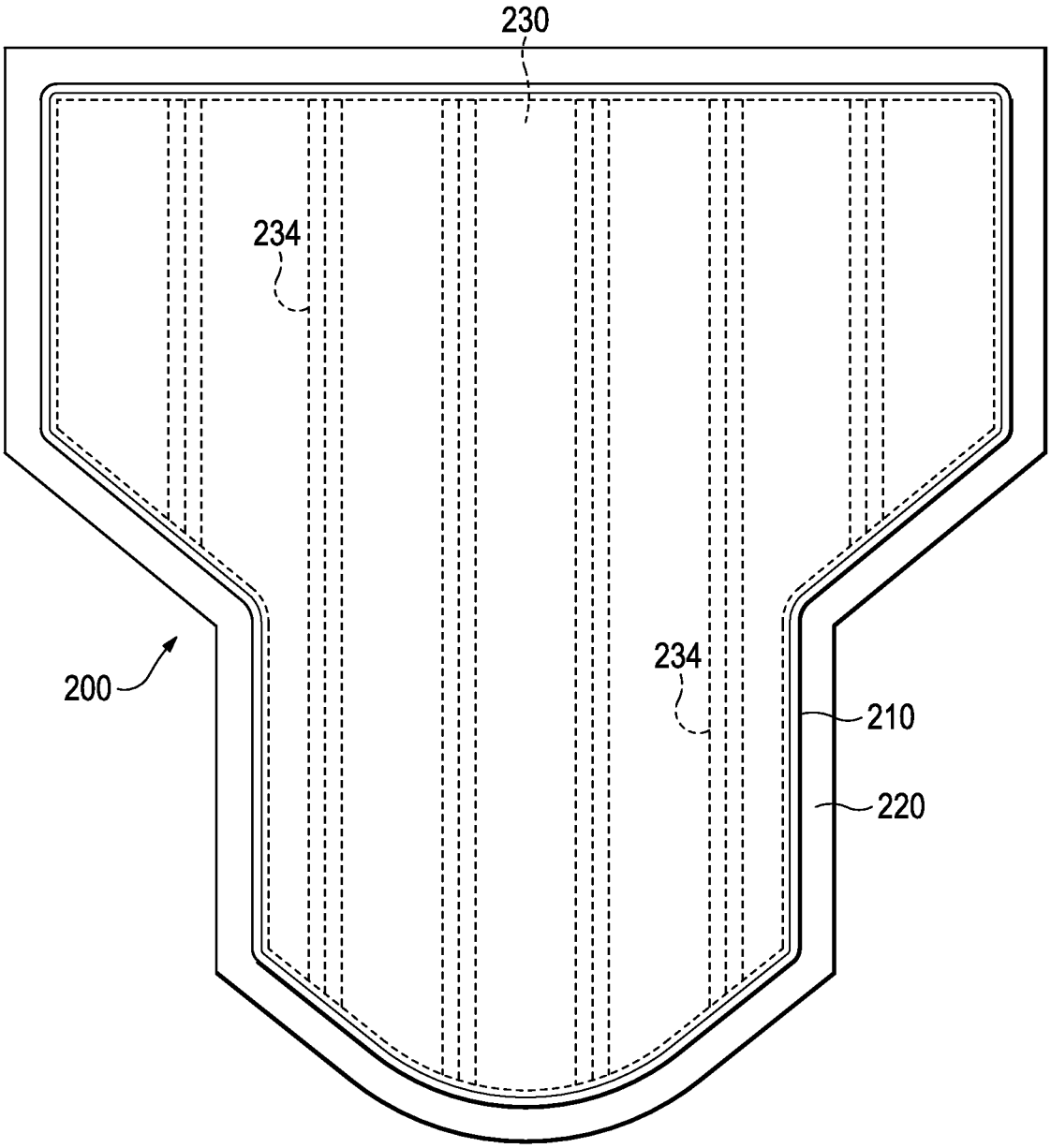
Figure 14G:
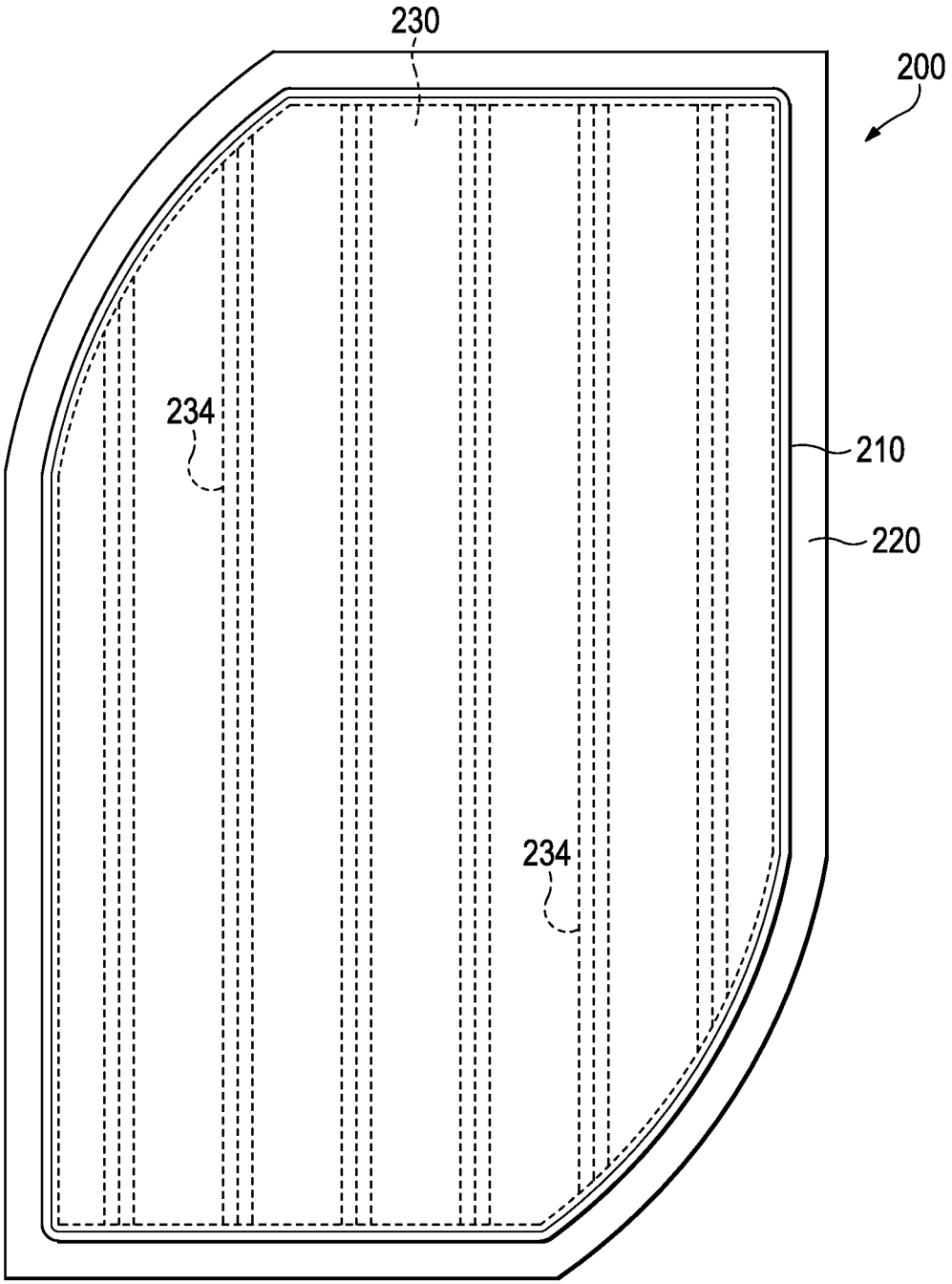
Figure 14H:
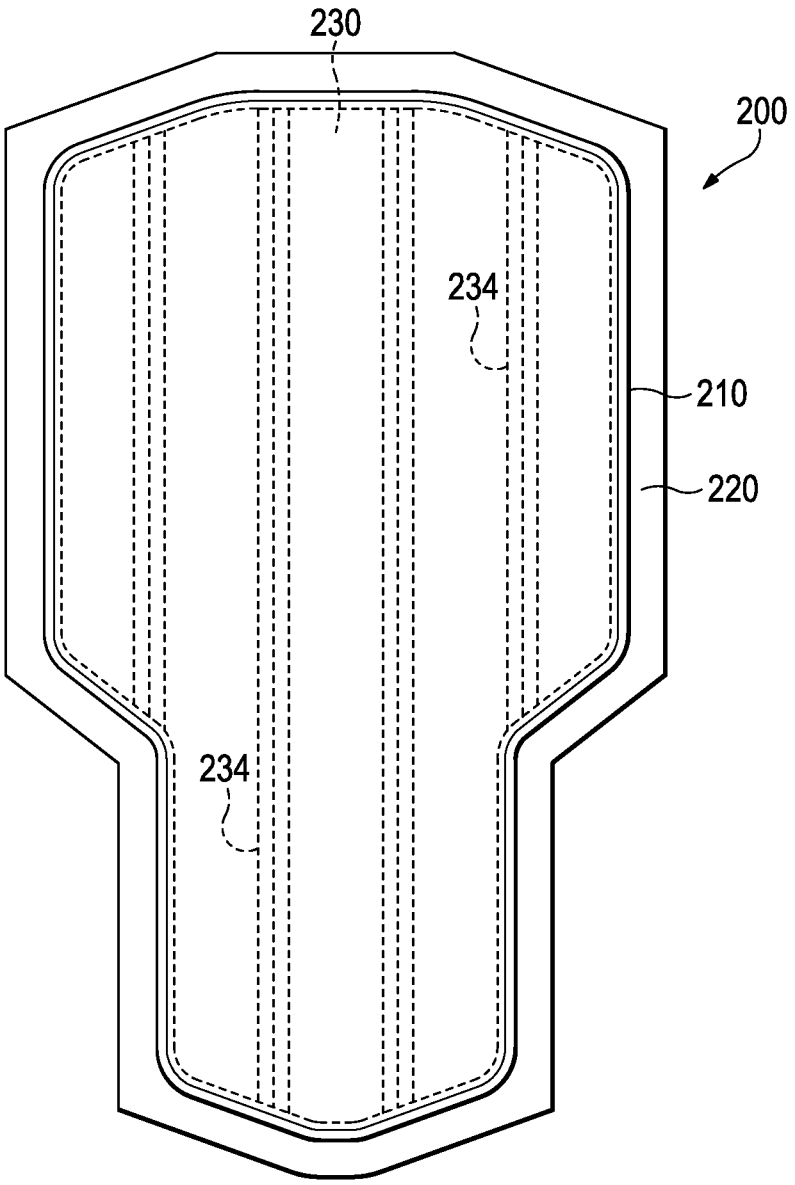
Figure 14I:
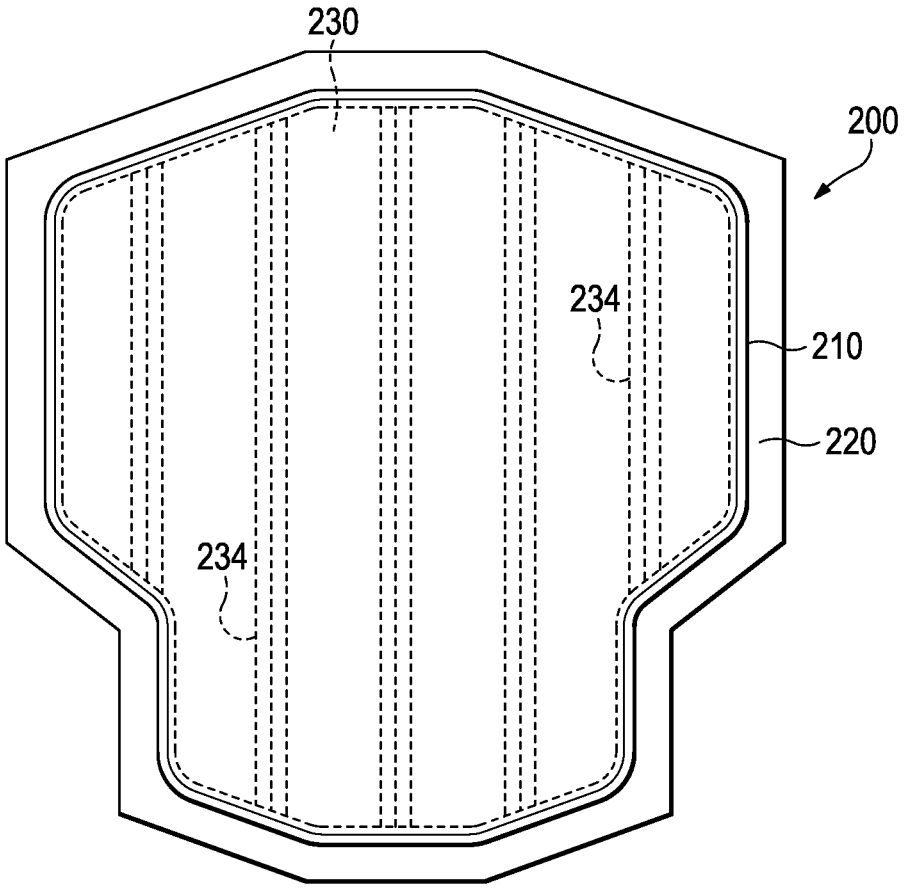

As discussed above, cushioning component 200 may have a generally elongate shape with pointed end areas. The overall shape of cushioning element 200 may, however, vary to include a variety of other shapes. Referring to FIG. 14A, cushioning element 200 exhibits a generally rectangular shape. In further configurations, cushioning element 200 may have a round, triangular, hexagonal, or H-shaped structure, as respectively depicted in FIGS. 14B-14E. Although any of these shapes may be utilized in apparel 100, various other shapes may also be utilized. As examples, FIG. 14F depicts a configuration of cushioning element 200 with a shape suitable for a hip pad, FIG. 14G depicts a configuration of cushioning element 200 with a shape suitable for a thigh pad, and FIG. 14H depicts a configuration of cushioning element 200 with a shape suitable for a tailbone pad. A configuration for cushioning element 200 that has a shape suitable for an elbow pad (e.g., for a shirt, jacket, or arm sleeve) is depicted in FIG. 14I.

Figure 14J:
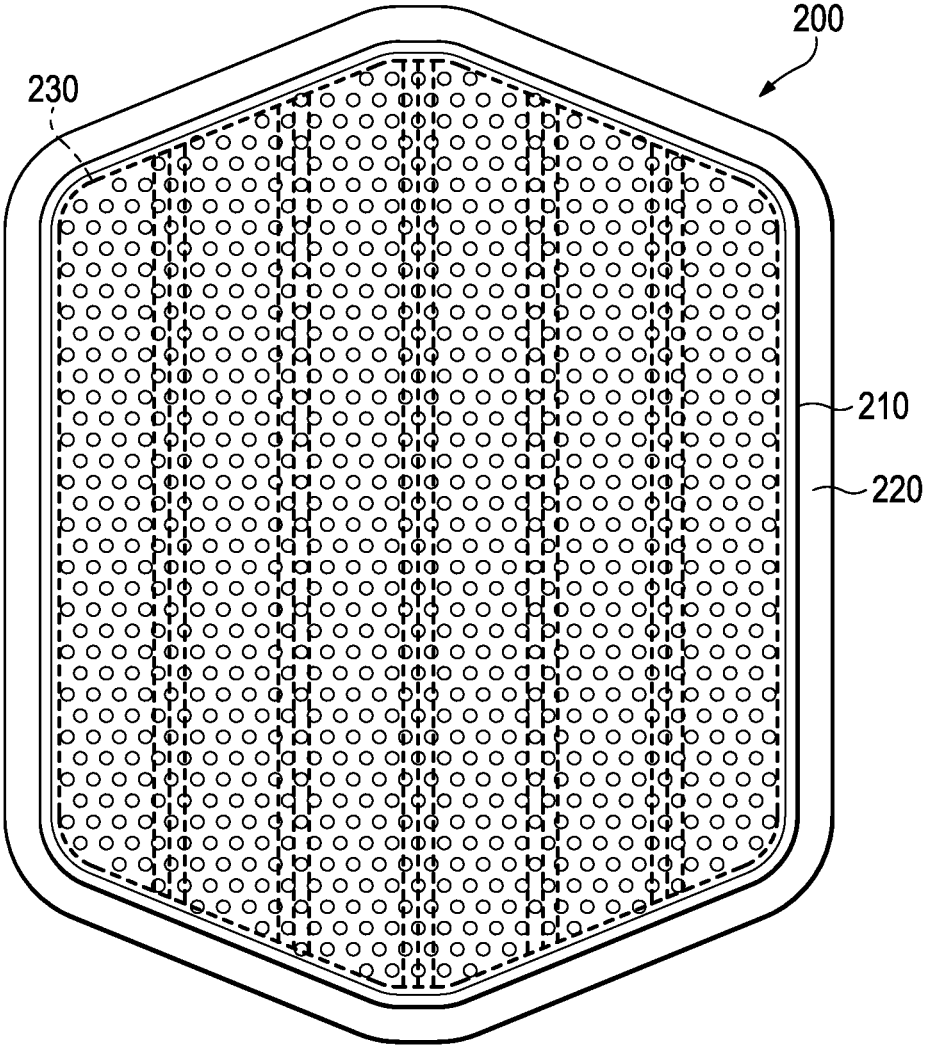
Figure 14K:
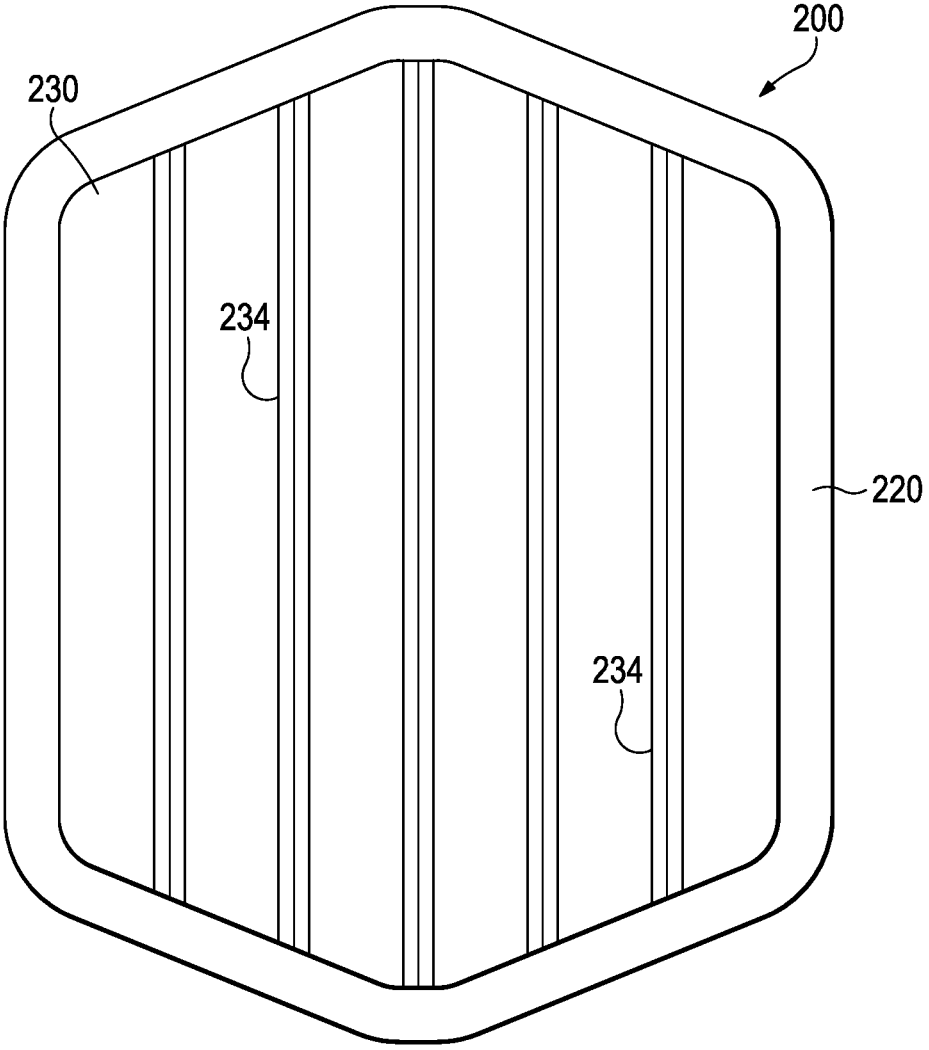

Various aspects relating to first material layer 210 and second material layer 220 may also vary significantly. As discussed above, material layers 210 and 220 may be formed from various textiles, polymer sheets, leather, synthetic leather, or combinations of materials, for example. Moreover, breathability may be enhanced when the materials are air-permeable. In general, textiles are permeable to both heat and moisture. Polymer sheets, leather, synthetic leather, or combinations of materials, however, may not exhibit significant permeability. As depicted in FIG. 14J, various perforations, holes, or apertures may be formed in one or both of material layers 210 and 220 to enhance breathability. In further configurations, as depicted in FIG. 14K, first material layer 210 may be entirely absent from cushioning element 200.

Figure 15A:
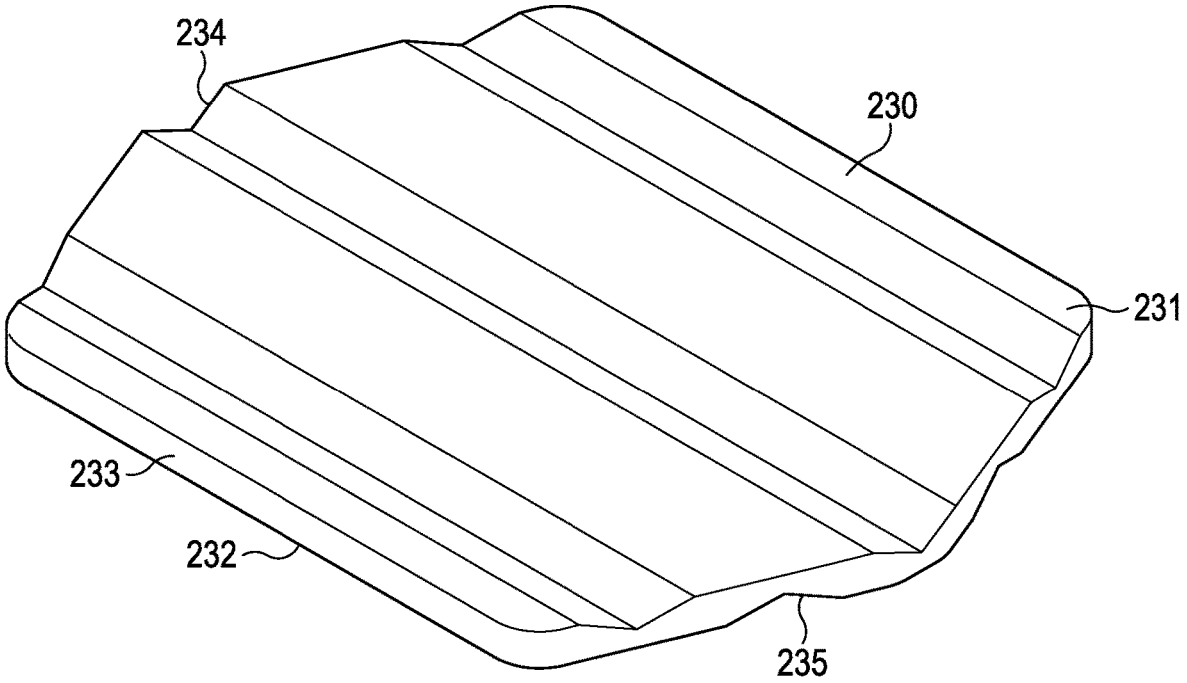
FIGS. 15A-15J are perspective views depicting further configurations of a first pad component from the first cushioning element.
Figure 15B:
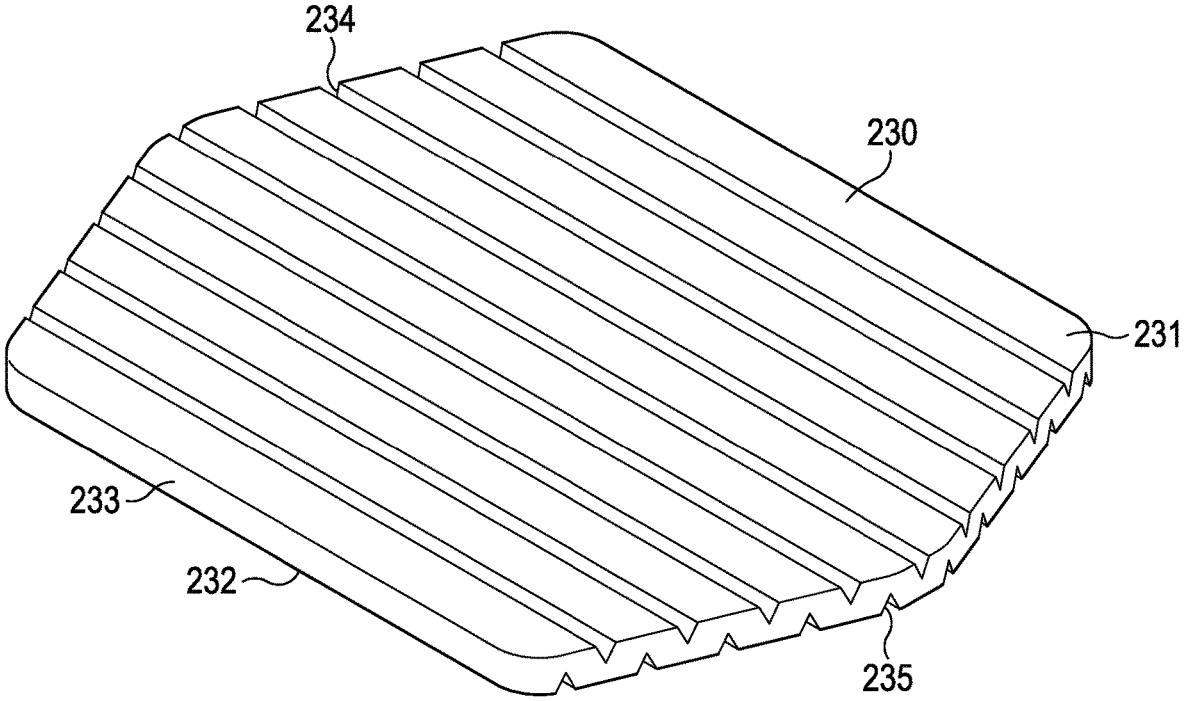
Figure 15C:
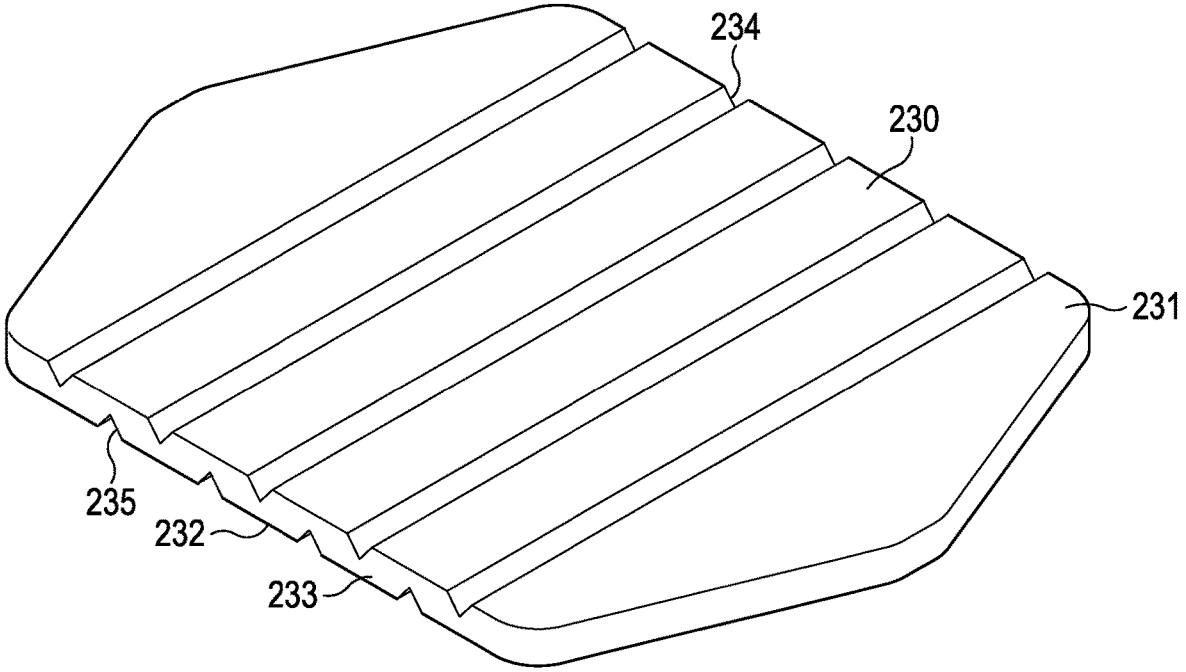
Figure 15D:
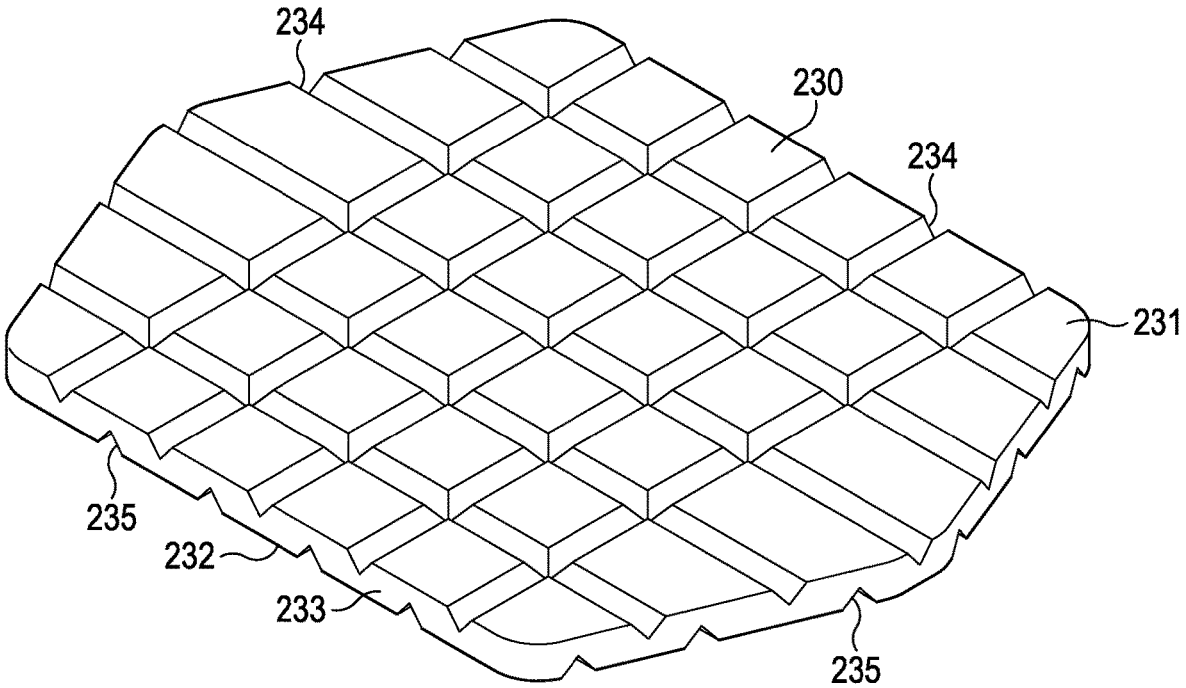
Figure 15E:
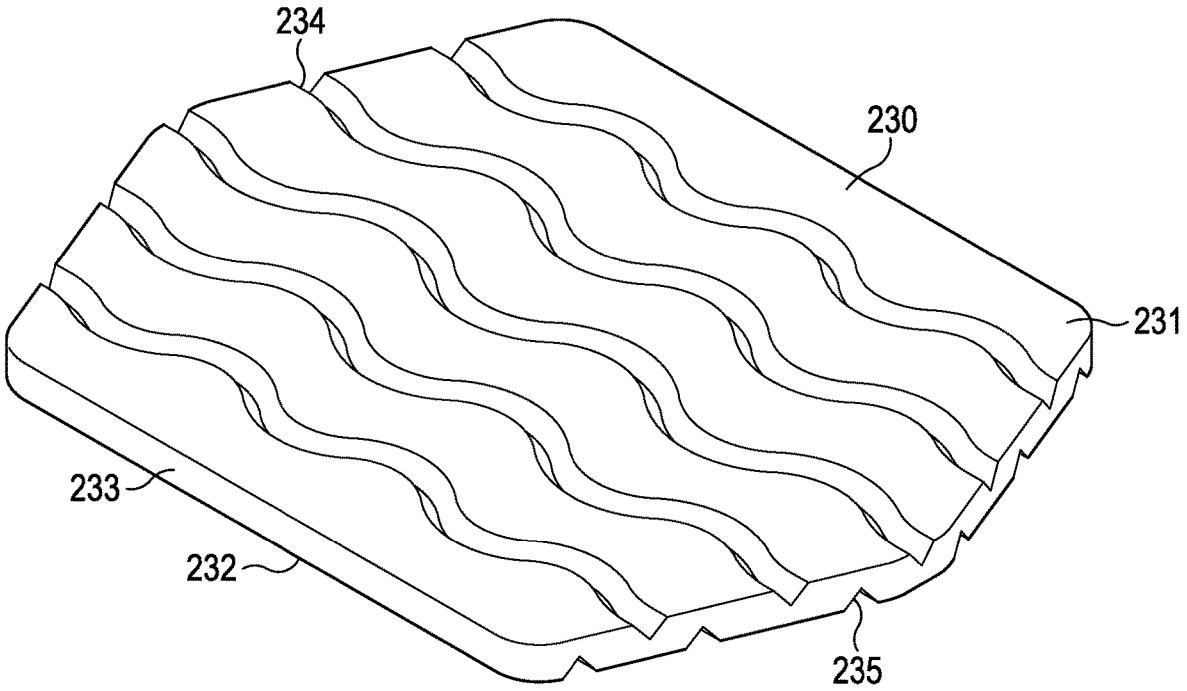
Figure 15F:
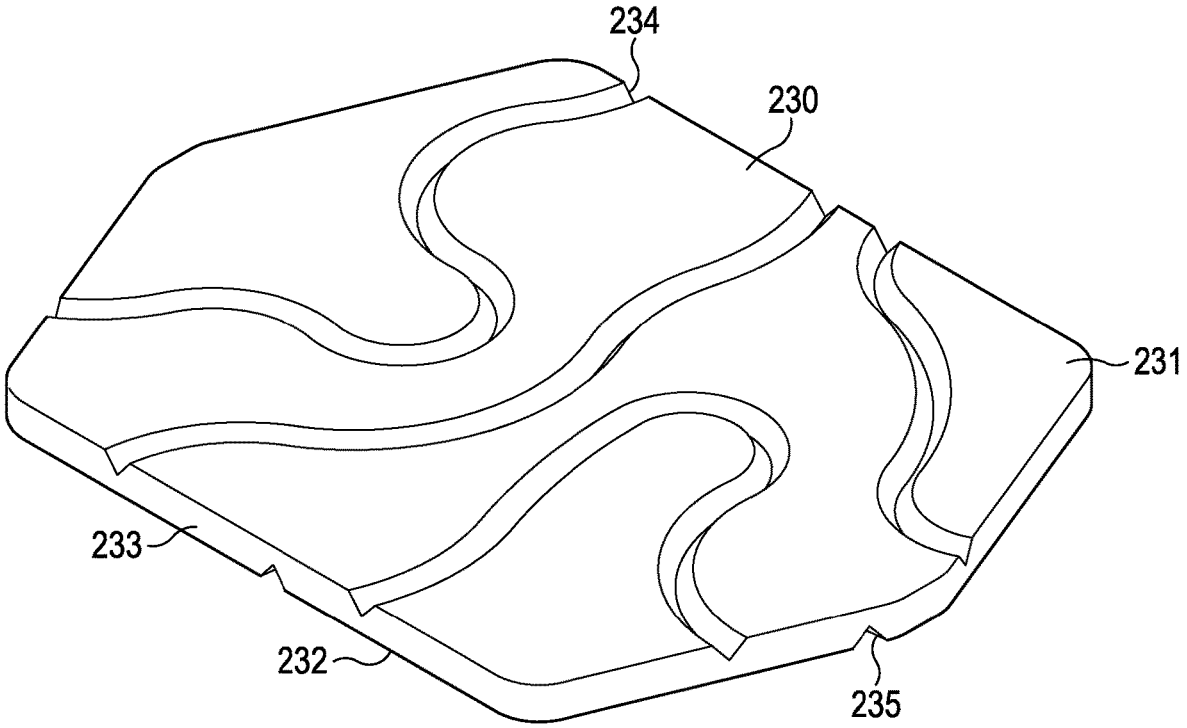
Figure 15G:
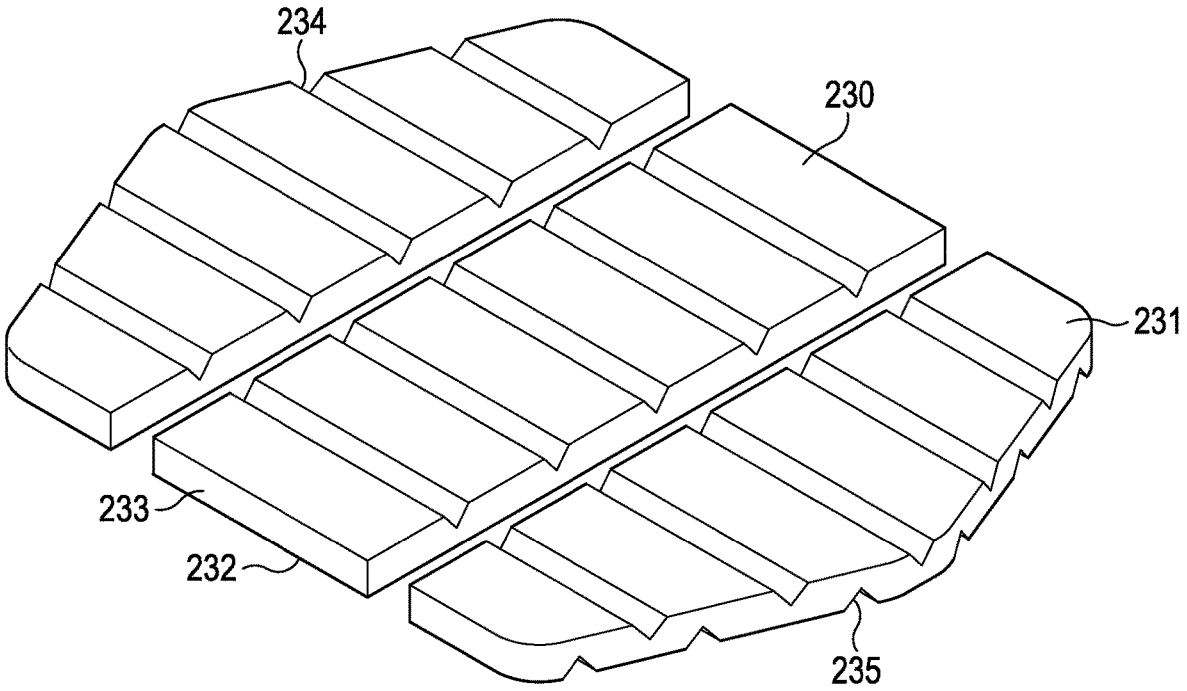

Aspects relating to pad component 230 may also vary to tailor cushioning element 200 to an intended use or enhance the properties of cushioning element 200. As an example, the configuration of grooves 234 and 235 may vary. Referring to FIGS. 15A and 15B, the width of grooves 234 and 235 and the spacing between grooves 234 and 235 are both increased and decreased from the configuration discussed above. Referring to FIG. 15C, grooves 234 and 235 extend across the width of pad component 230, rather than extending across the length. In order to impart flex and stretch in multiple directions, grooves 234 and 235 may have a crossed configuration extending across both the length and width of pad component 230, as depicted in FIG. 15D. Although grooves 234 and 235 may be linear, wavy or non-linear configurations are depicted in FIGS. 15E and 15F. In another configuration, pad component 230 may be segmented or otherwise formed from two or more separate elements. Referring to FIG. 15G, for example, pad component 230 includes three spaced sections, which may enhance the flex and breathability of cushioning element 200.

Figure 15H:
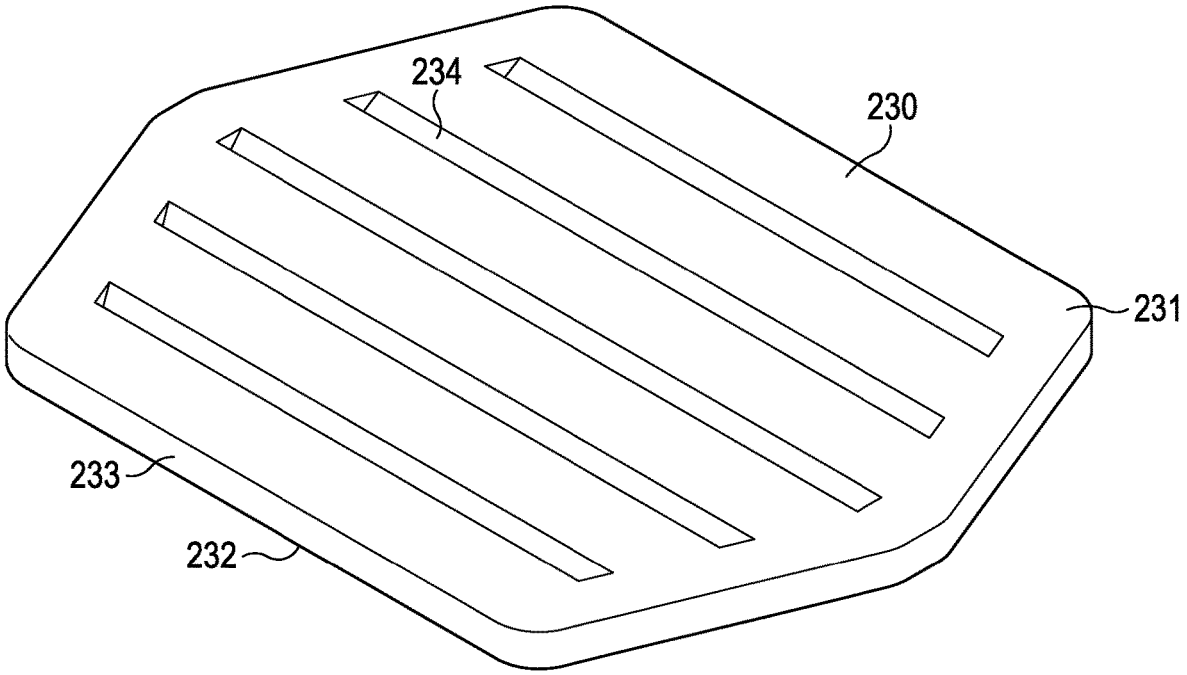
Figure 15I:
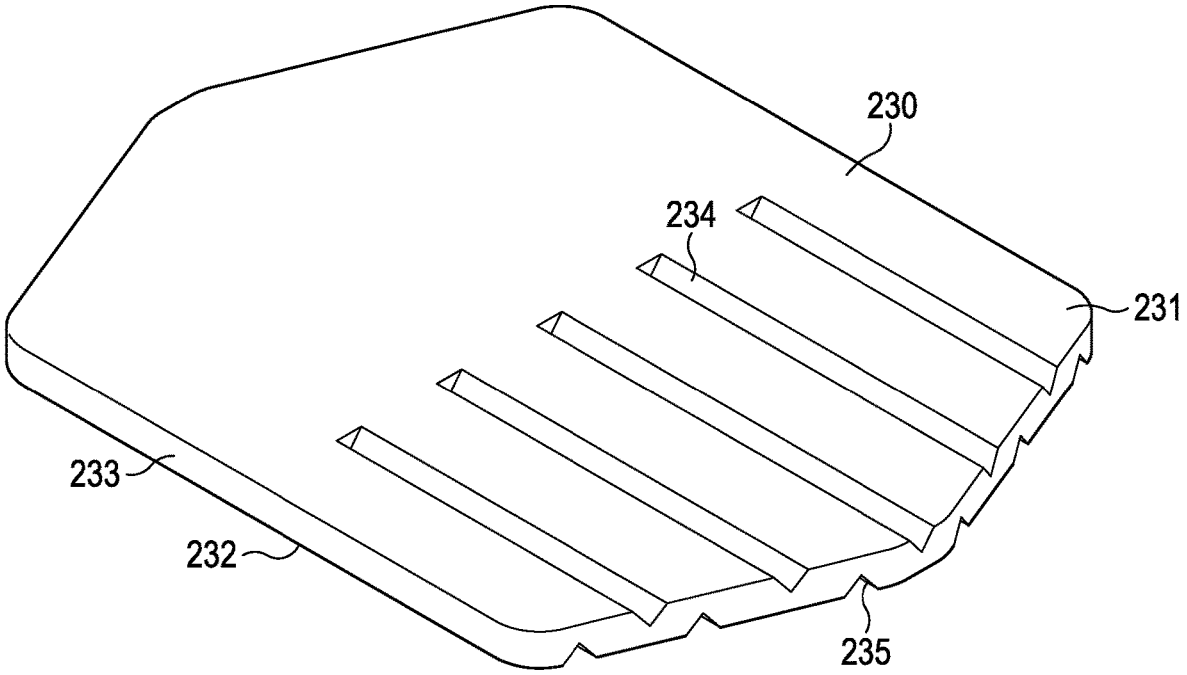
Figure 15J:
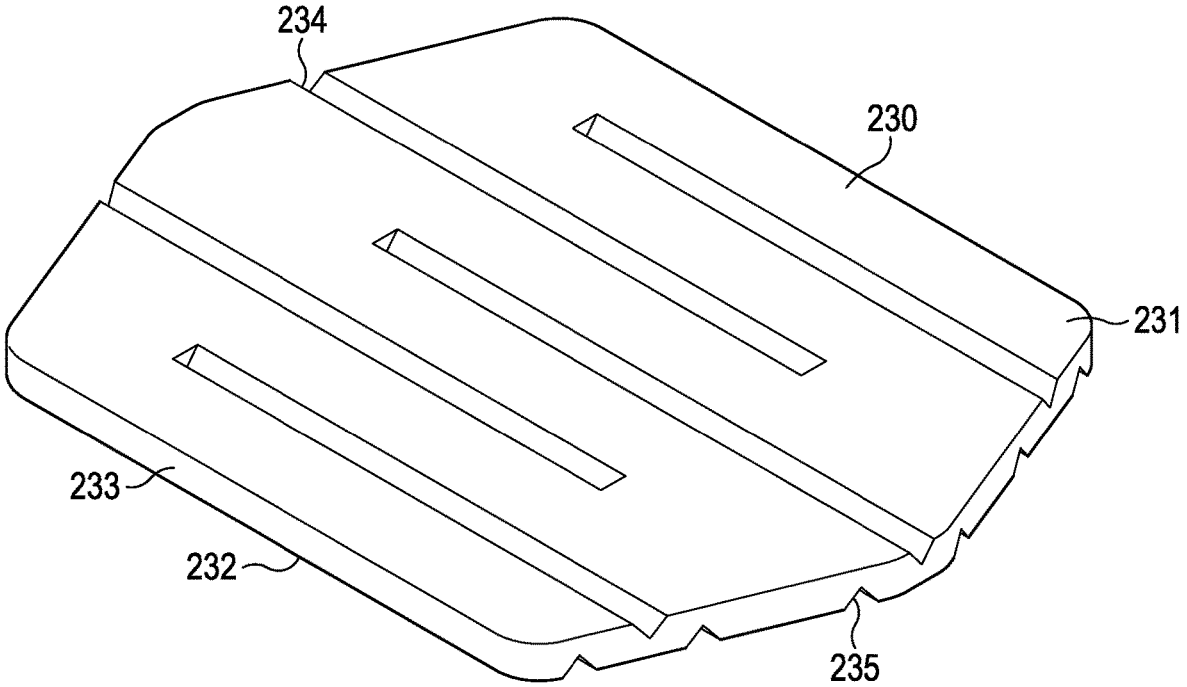

Although grooves 234 and 235 may extend entirely across pad component 230, grooves 234 and 235 may also extend only partially across pad component 230. Referring to FIG. 15H, for example, first grooves 234 extend across a majority of the length of pad component 230, but are spaced from peripheral areas of pad component 230. Second grooves 235 may have a similar configuration. In FIG. 151, grooves 234 and 235 are located in one region of pad component 230, but are absent from another region of pad component 230. Grooves 234 and 235 may also extend only partially across pad component 230 from opposite sides of pad component 230, as depicted in FIG. 15J. Accordingly, grooves 234 and 235 may have various configurations that extend at least partially across pad component 230.

Figure 16A:
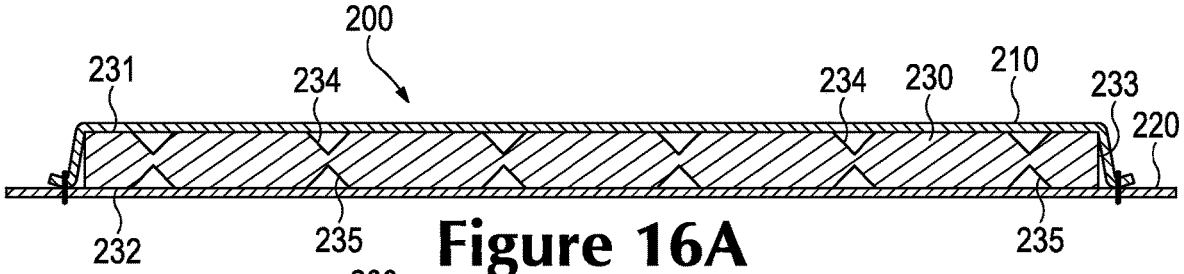
FIGS. 16A-16R are cross-sectional views corresponding with FIG. 9A and depicting further configurations of the first cushioning element.
Figure 16B:
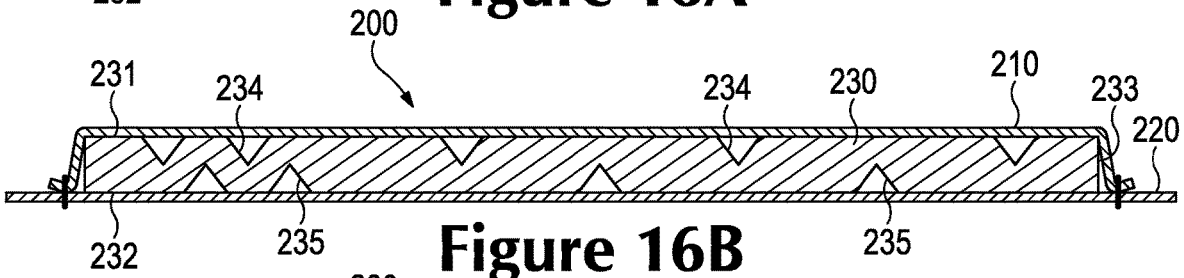
Figure 16C:
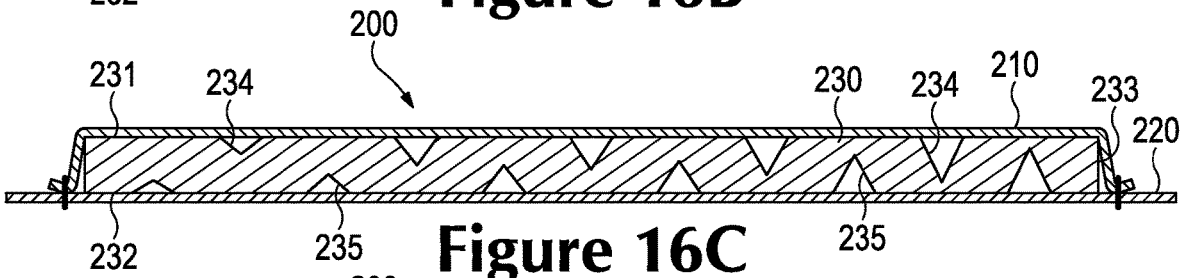
Figure 16D:
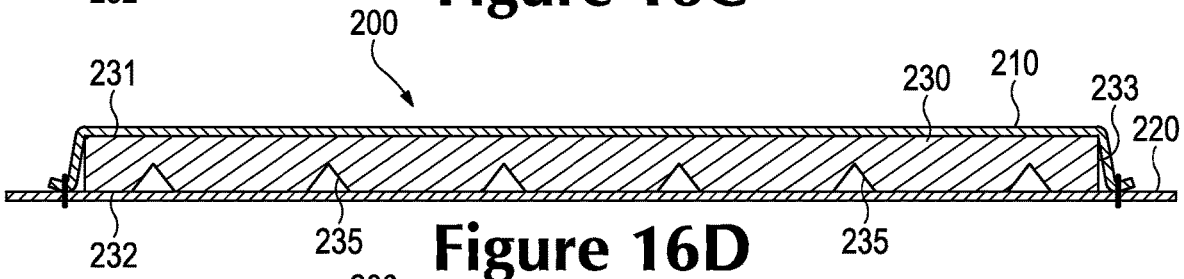

Various aspects relating to the relative size and locations of grooves 234 and 235 may also vary significantly. Referring to FIG. 16A, for example, grooves 234 and 235 are aligned across the thickness of pad component 230, rather than being offset. FIG. 16B depicts a configuration wherein the spacing of grooves 234 and 235 varies across the width of pad component 230, and FIG. 16C depicts a configuration wherein the depth of grooves 234 and 235 varies across the width of pad component 230. Although the depth of grooves 234 and 235 may extend through about fifty percent of the thickness of pad components 230, the depth of grooves 234 and 235 may range from five percent to ninety-five percent of the thickness of pad component 230 in different configurations. In some configurations, first grooves 234 may be absent from pad component 230, as depicted in FIG. 16D, but second grooves 235 may also be absent.

Figure 16E:
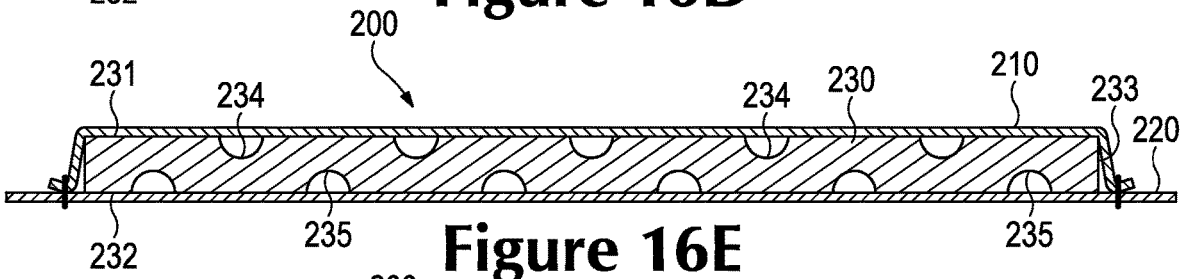
Figure 16F:
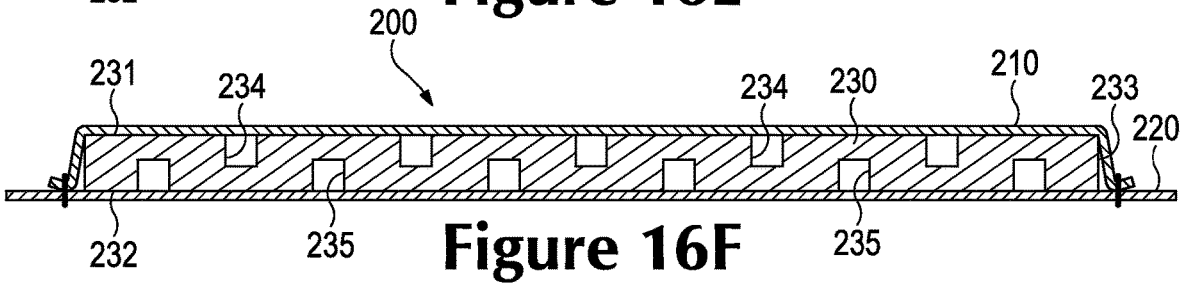
Figure 16G:
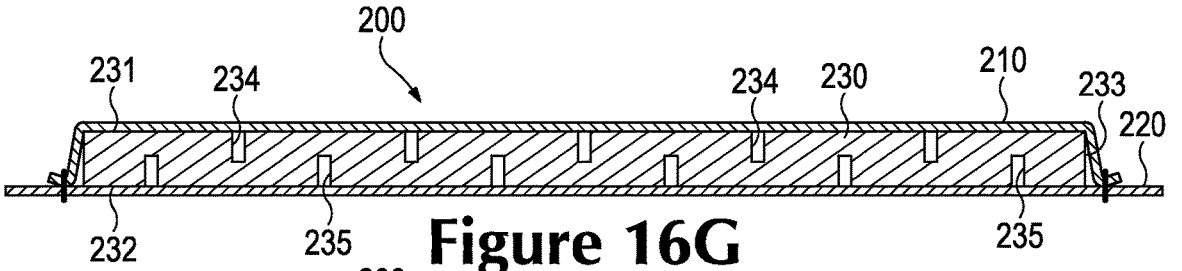
Figure 16H:
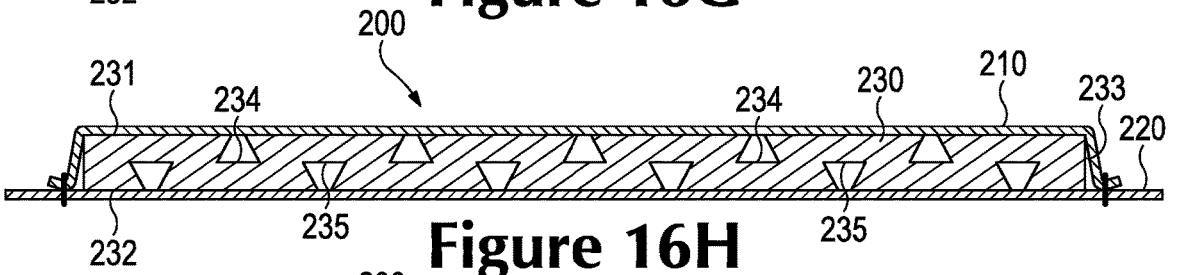
Figure 16I:
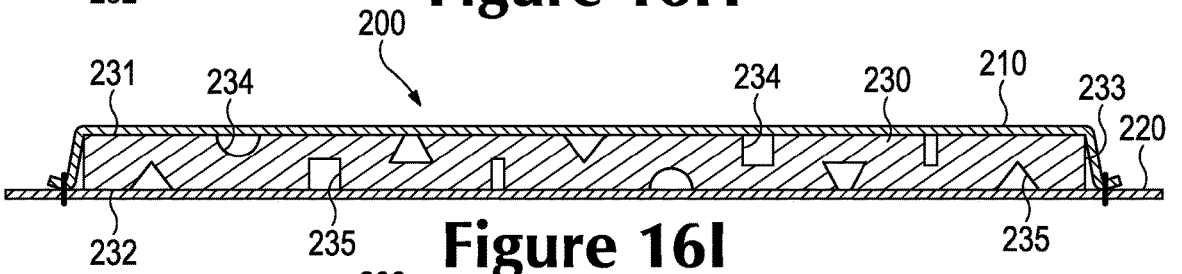

In many of the configurations discussed above, grooves 234 and 235 are depicted as having a triangular, angled, or pointed configuration. Referring to FIG. 16E, grooves 234 and 235 have rounded or semi-circular shapes. Grooves 234 and 235 may also be squared, elongate and rectangular, or dovetailed (i.e., increasing in width as depth increases), as depicted in FIGS. 16F-16H. Various different shapes for grooves 234 and 235 may also be utilized in combination, as depicted in FIG. 16I.

Figure 16J:
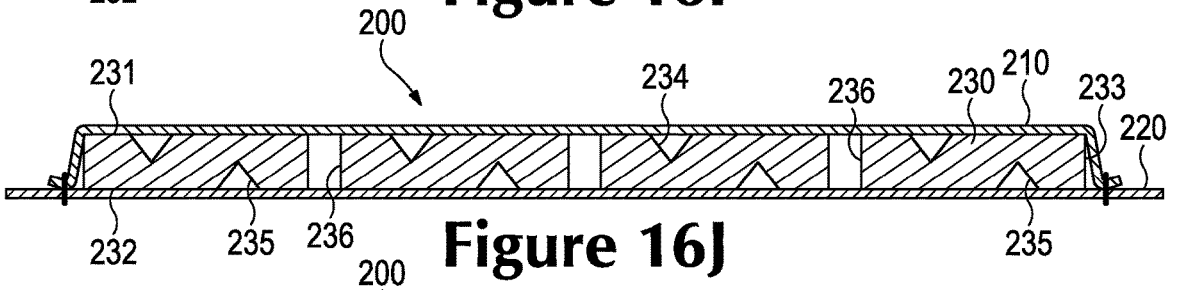
Figure 16K:
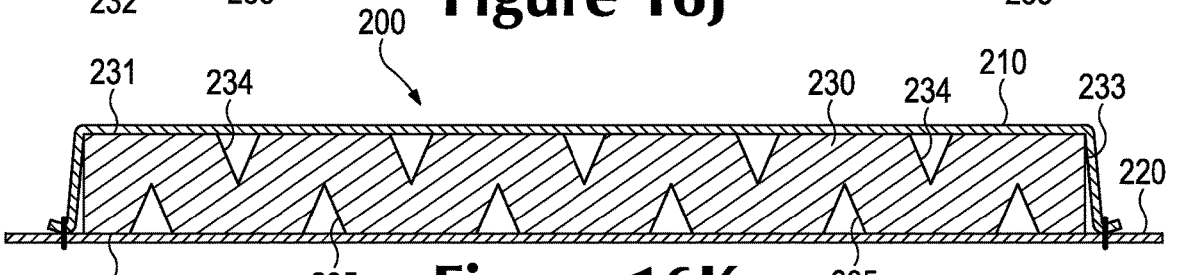
Figure 16L:
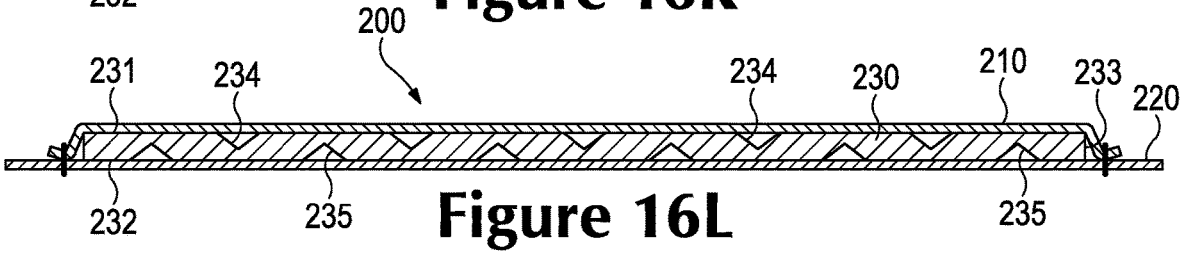
Figure 16M:
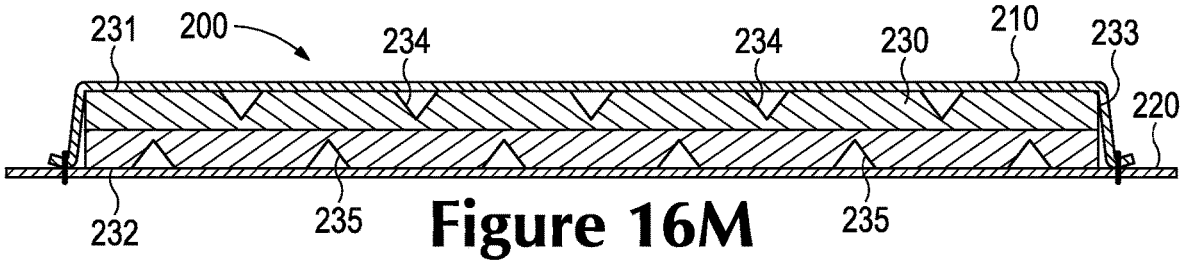
Figure 16N:
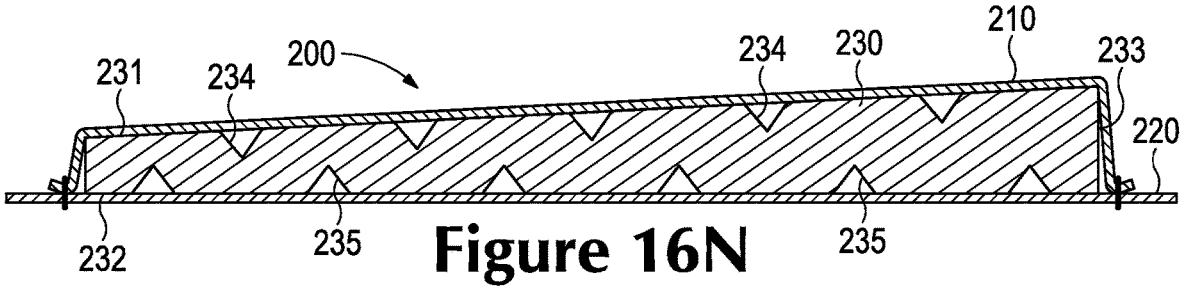
Figure 16O:
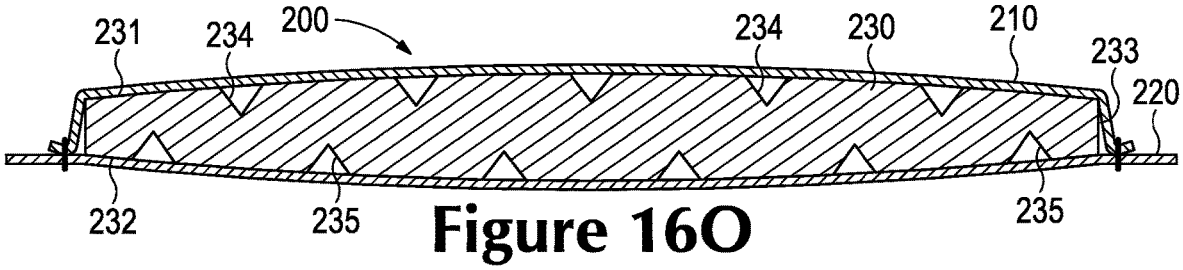
Figure 16P:
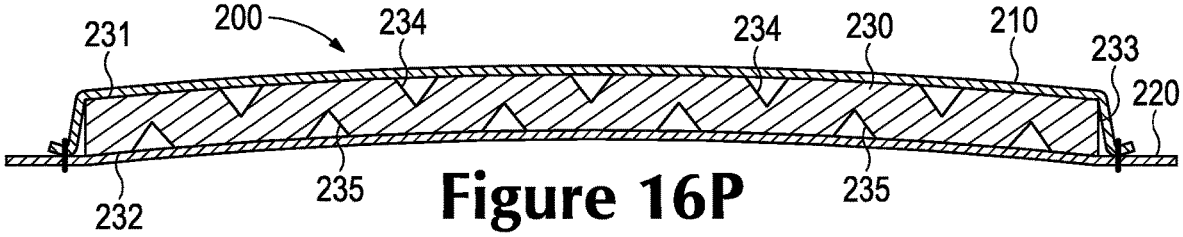

Various additional features may be incorporated into pad component 230. Referring to FIG. 16J, various apertures 236 extend through pad component 230, which may enhance the breathability of cushioning element 200. In some configurations, a greater thickness may be desired, as in FIG. 16K, or a lesser thickness may be desired, as in FIG. 16L. Pad component 230 may also have a layered configuration, as depicted in FIG. 16M. As an example, the layers may be different types or polymer foam or densities of polymer foam, or the layers may be different materials, such as polymer foam and rubber. Although the thicknesses of pad component 230 may be constant, pad component 230 may also have varying or tapered thicknesses, as depicted in FIG. 16N. In some configurations of cushioning element 200, a central area of pad component 230 may have greater thickness than a peripheral area of pad component 230, as depicted in FIG. 160. Additionally, pad component 230 may have a rounded or contoured shape, as depicted in FIG. 16P.

Figure 16Q:
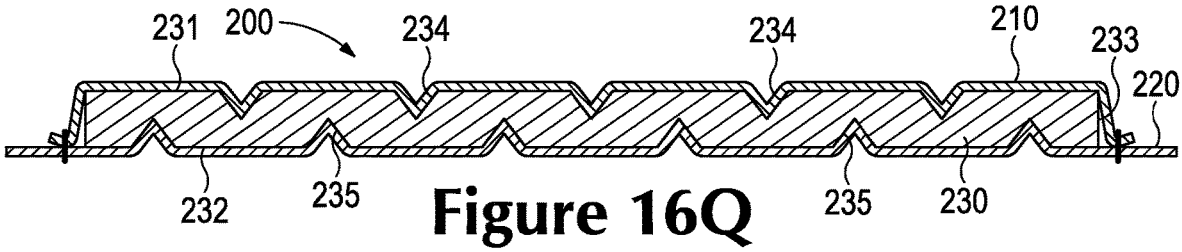

In each of the configurations discussed above, material layers 210 and 220 were absent from grooves 234 and 235. That is, material layers 210 and 220 are not depicted as extending into grooves 234 and 235. Referring to FIG. 16Q, however, material layers 210 and 220 extend into grooves 234 and 235 and are secured to surfaces within grooves 234 and 235. In addition to enhancing flex, stretch, and breathability, this configuration may also present a unique or appealing aesthetic to apparel 100.

Figure 16R:
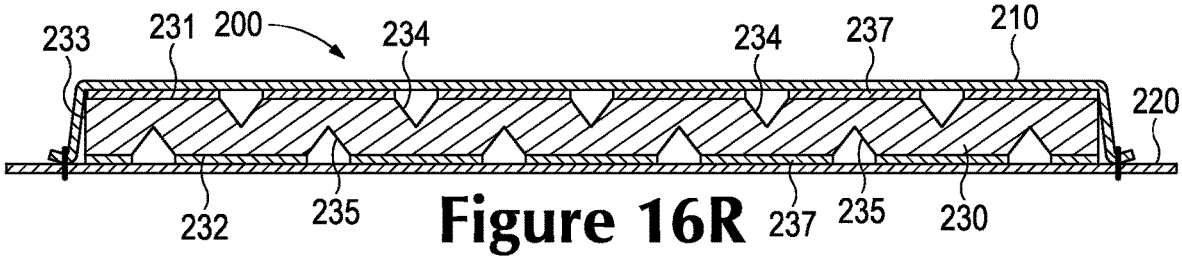

In the manufacturing process discussion above, it was noted that various bonding agents (e.g., adhesives, thermoplastic polymer sheets) may be utilized to bond layers 210 and 220 to pad component 230. Moreover, various methods may be employed to ensure that the bonding agents are limited to the areas of surfaces 231 and 232 that bond with layers 210 and 220. Referring to FIG. 16R, a bonding agent 237 is located between pad component 230 and layers 210 and 220. Moreover, bonding agent 237 is limited to the areas of surfaces 231 and 232 that bond with layers 210 and 220, thereby being absent from side surface 233 and the area within grooves 234 and 235.

Based upon the above discussion, various properties of cushioning element 200 may vary. Depending upon the specific type of apparel or location in the apparel, the properties may impart different degrees of impact force attenuation, flex, stretch, breathability, or other characteristics. As such, the variations discussed above may be utilized individually or in combination to impart particular characteristics to cushioning element 200.

Further Apparel Configurations

Figure 17A:
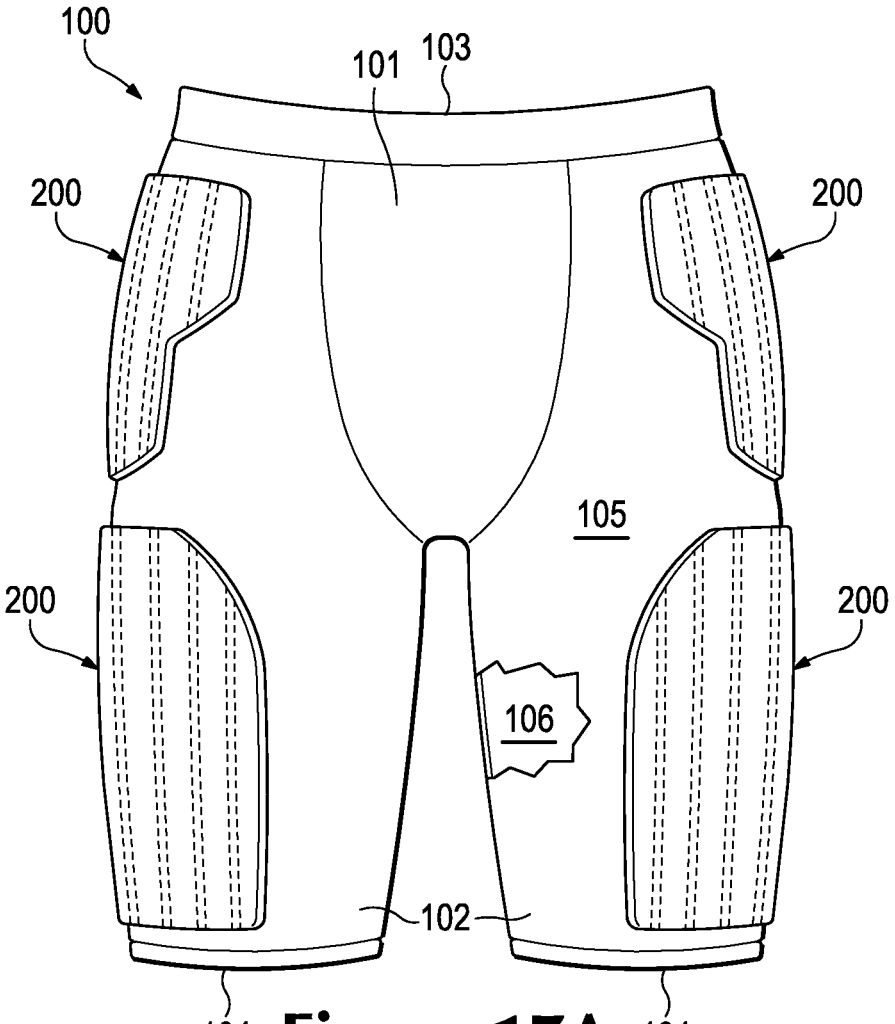
FIGS. 17A-17G are elevational views of further articles of apparel incorporating the cushioning element.
Figure 17B:
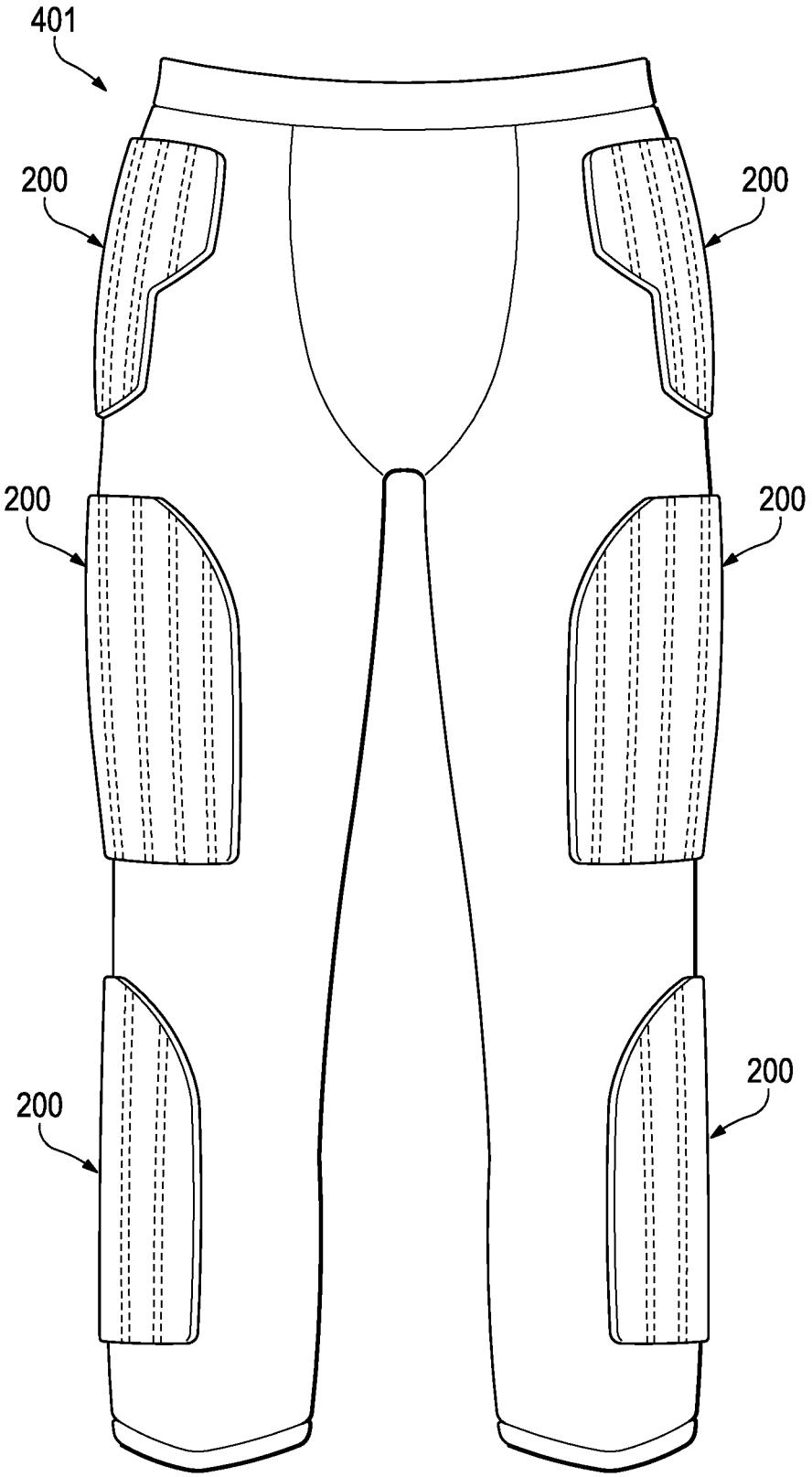
Figure 17C:
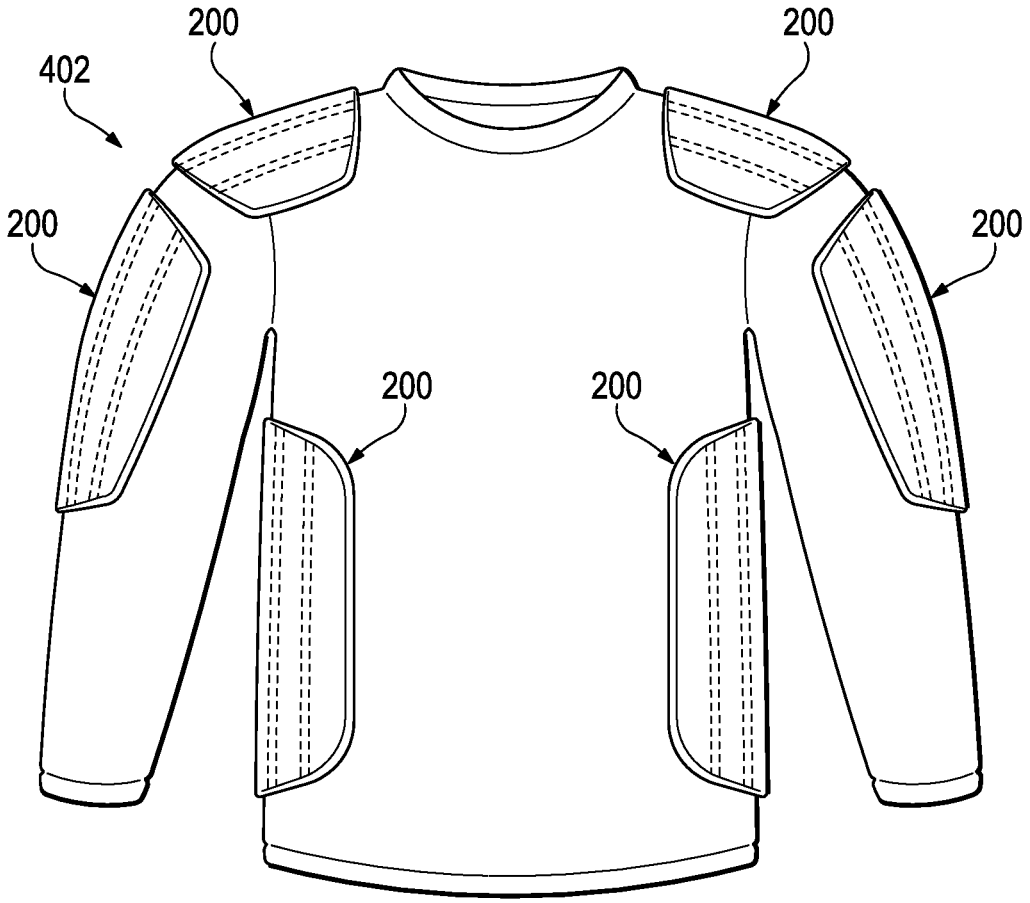

Apparel 100 is depicted as having the general configuration of a pair of shorts. Another shorts configuration is depicted in FIG. 17A and includes the shapes of cushioning elements depicted in FIGS. 14F and 14G. In addition to shorts, the concepts discussed in relation to apparel 100 may be applied to other types of apparel. FIG. 17B, for example, depicts a pair of pants 401 that includes various cushioning elements 200. Referring to FIG. 17C, a shirt 402 is depicted as including various cushioning elements 200 in locations that correspond with the sides, arms, and shoulders of a wearer. Although apparel 402 is depicted as a long-sleeved shirt, apparel 402 may have the configuration of other shirt-type garments, including short-sleeved shirts, tank tops, undershirts, jackets, and coats, for example.

Figure 17D:
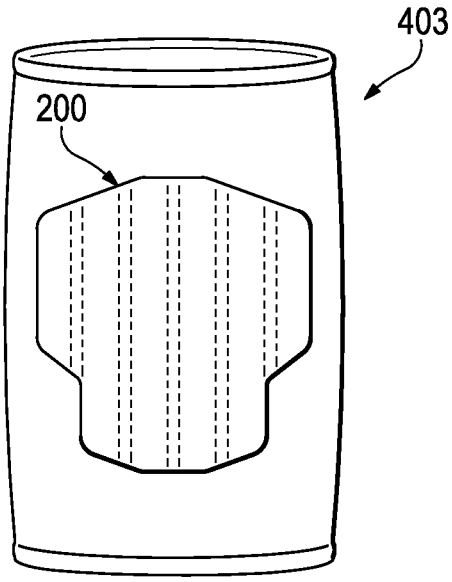
Figure 17E:
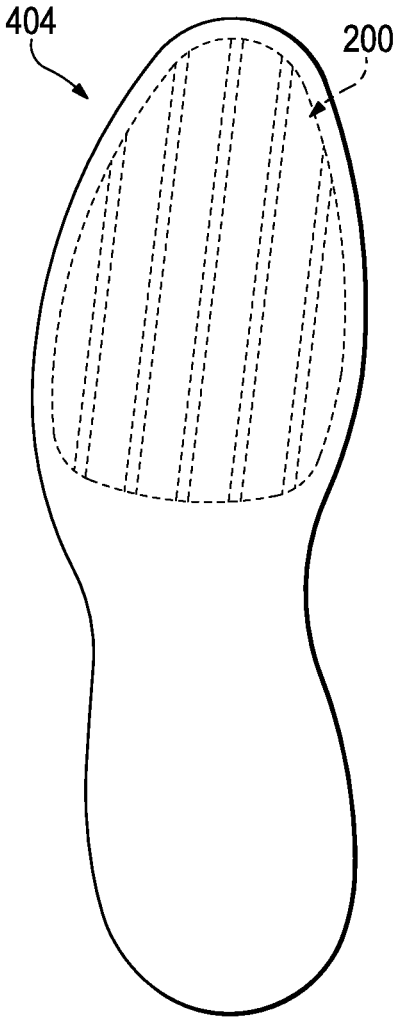
Figure 17F:
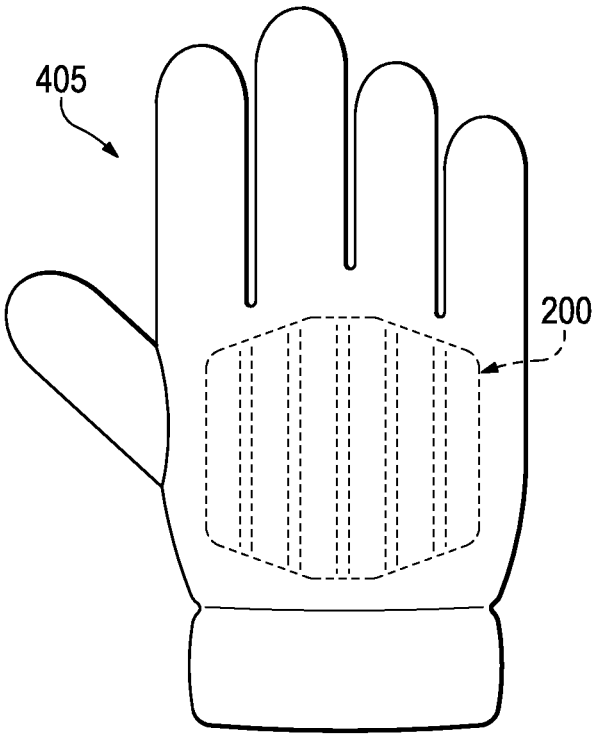
Figure 17G:
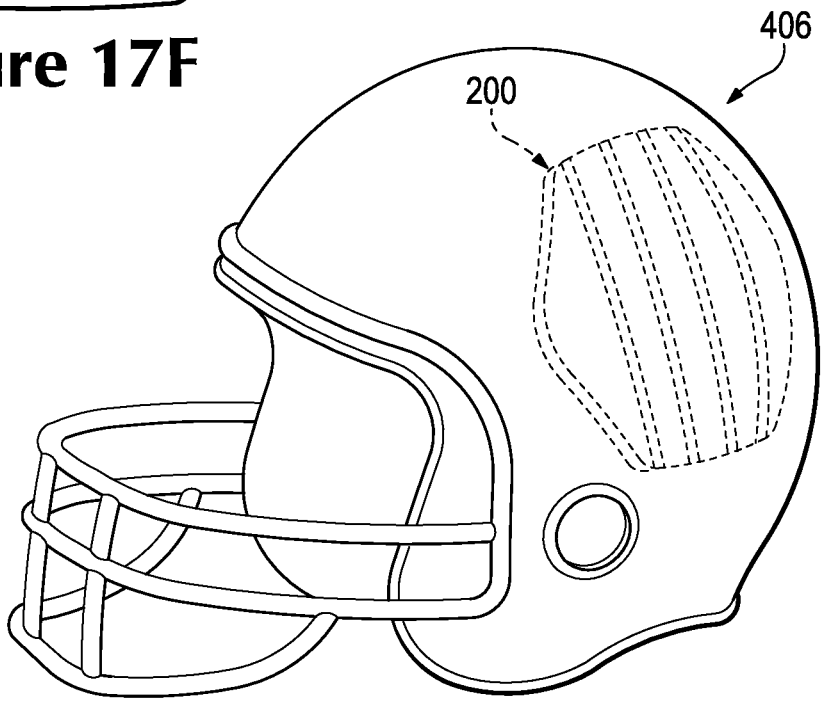

Cushioning elements 200 may also be incorporated into apparel that covers other areas of the wearer, such as hats, wraps, footwear, socks, gloves, and helmets, for example. As an example, a wrap 403 with one cushioning element 200 is depicted in FIG. 17D. Wrap 403 has a generally cylindrical configuration that may be placed upon an arm or a leg of a wearer. When, for example, the elbow is sore or injured, cushioning element 200 of wrap 403 may be located over the elbow to assist with protecting the elbow during athletic activities. As another example, a sockliner 404 that incorporates a cushioning element 200 is depicted in FIG. 17E. Sockliner 404 may be located within an article of footwear to cushion a lower surface of the foot. Additionally, one or more cushioning elements 200 may be incorporated into a glove 405, as depicted in FIG. 17F, to impart protection to a hand of the wearer. One or more cushioning elements 200 may also be incorporated into a helmet 406, as depicted in FIG. 17G, to impart protection to a head of the wearer. In addition to attenuating impact forces, cushioning elements 200 in these configurations may also simultaneously provide one or more of flex, stretch, breathability, a relatively low overall mass, and launderability.

Second Cushioning Element Configuration

Figure 18:
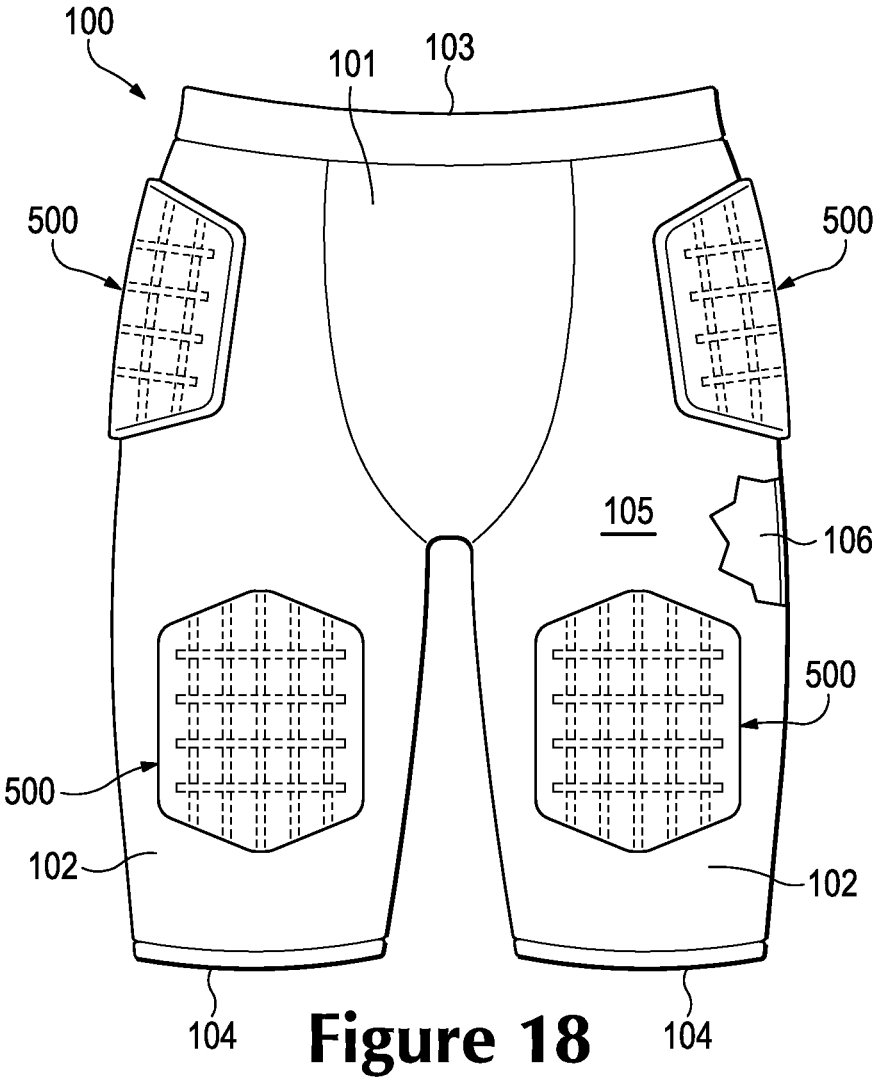
FIG. 18 is a front elevational view of another configuration of the article of apparel.

With reference to FIG. 18, a plurality of cushioning elements 500 are incorporated into various areas of apparel 100. In effect, cushioning elements 500 are depicted as replacing the various cushioning elements 200 discussed above. As with cushioning elements 200, cushioning elements 500 impart padding, cushioning, or otherwise attenuate impact forces. When apparel 100 is worn during athletic activities, for example, cushioning elements 500 may protect individual 10 from contact with other athletes, equipment, or the ground. With regard to apparel 100, cushioning elements 500 are located in both of pelvic region 101 and leg regions 102 and are positioned, more specifically, to protect the hips, thighs, and tailbone of individual 10. Although shown with apparel 100, cushioning elements 500 may be incorporated into a variety of different articles of apparel, such as any of pants 401, shirt 402, wrap 403, sockliner 404, glove 405, and helmet 406. Cushioning elements 500 may be positioned in various areas of the articles of apparel to protect specific portions (e.g., muscles, bones, joints, impact areas) of individual 10. Additionally, the shapes, sizes, and other properties of cushioning elements 500, as well as the materials and components utilized in cushioning elements 500, may vary significantly to provide a particular level of protection to the specific portions of individual 10.

Figure 19:
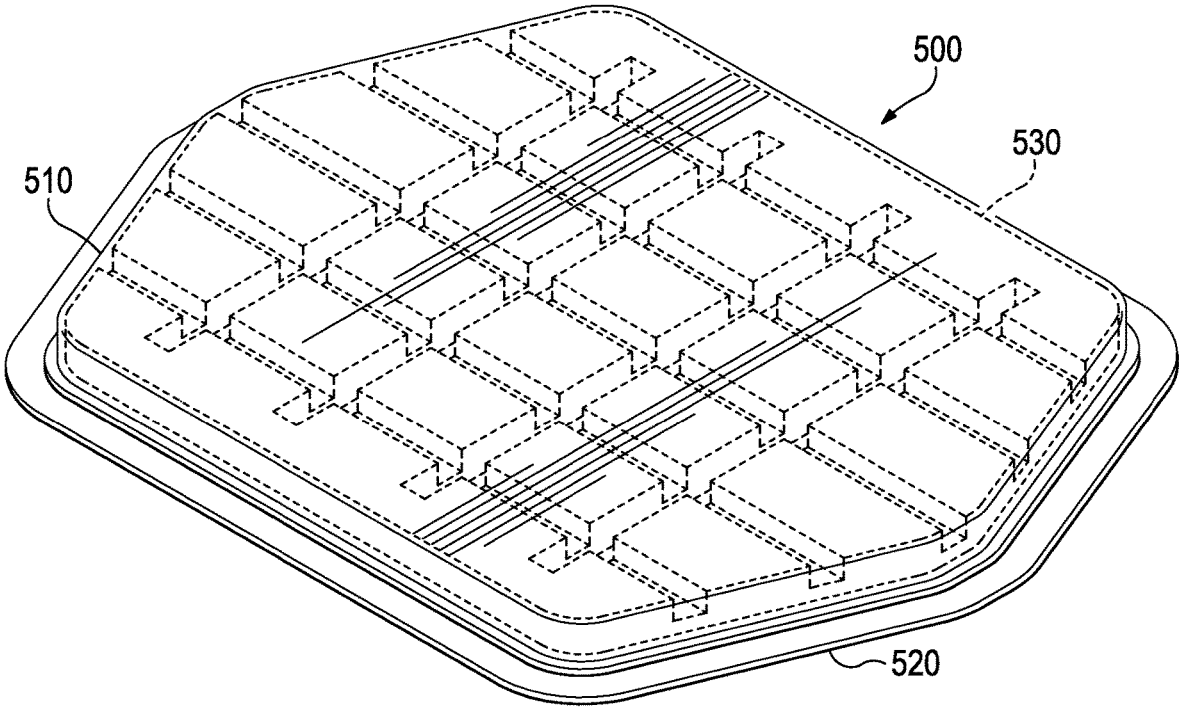
FIG. 19 is a perspective view of a second cushioning element.
Figure 20:
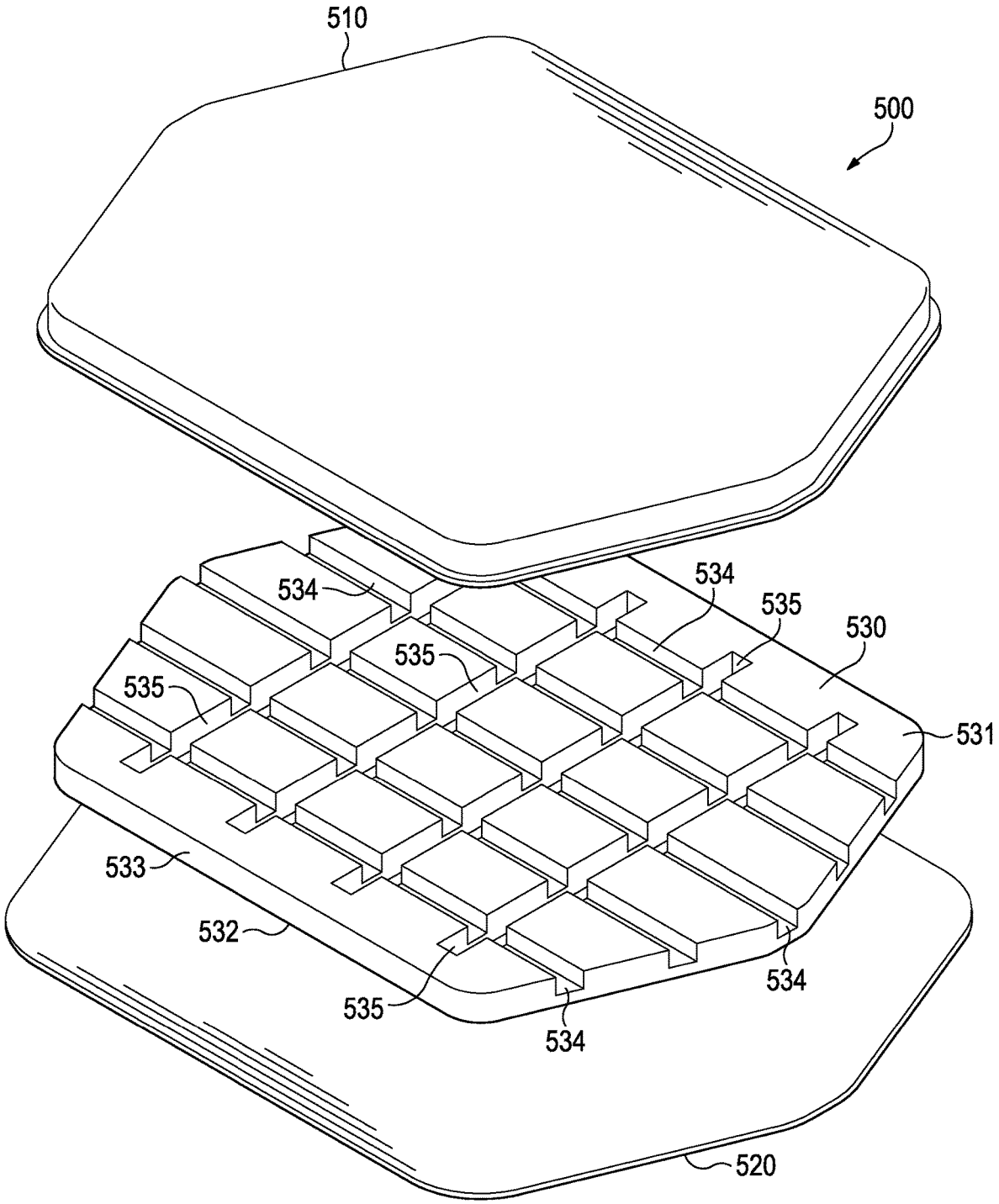
FIG. 20 is an exploded perspective view of the second cushioning element.
Figure 21:
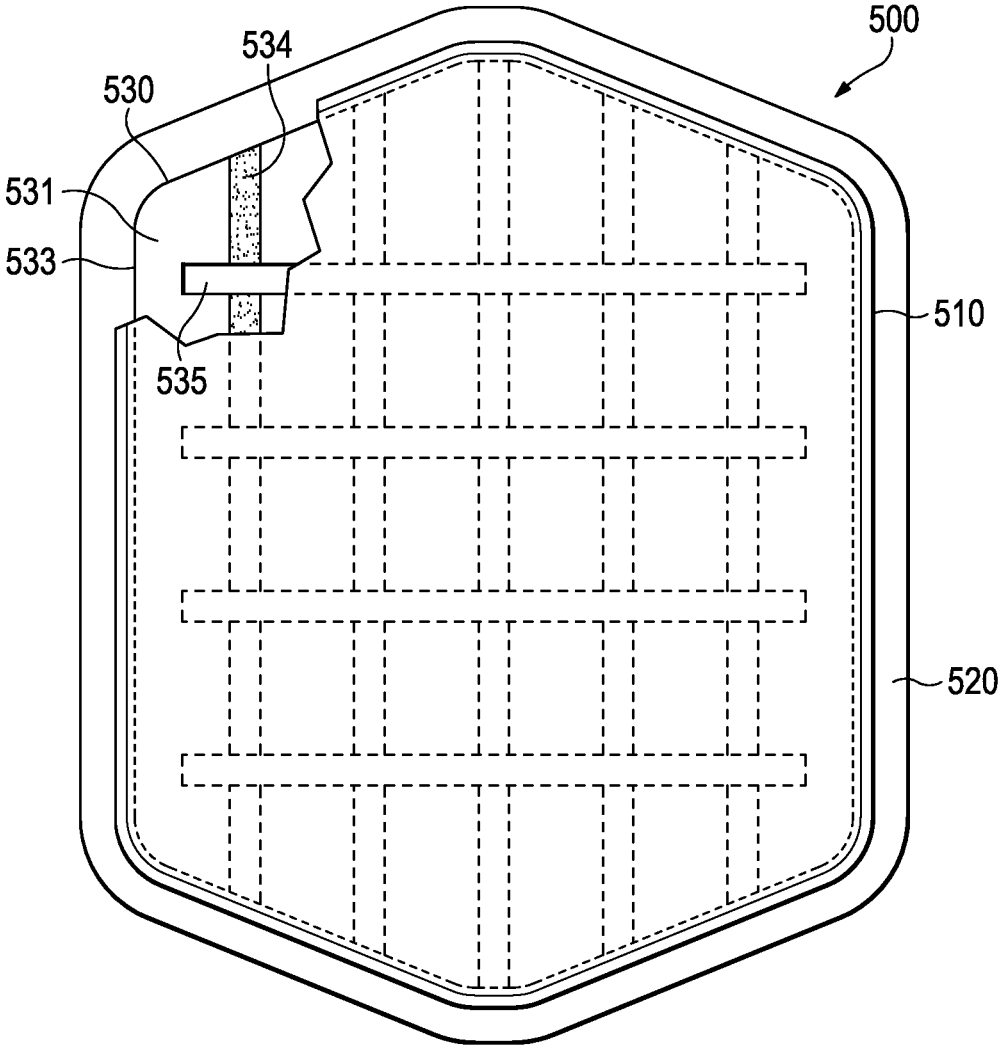
FIG. 21 is a top plan view of the second cushioning element.

An example configuration for cushioning element 500 is depicted in FIGS. 19¬21 as having a generally elongate shape with pointed end areas, which is the shape depicted as being incorporated into apparel 100. As alternatives to this shape, cushioning element 500 may exhibit any of the shapes depicted in FIGS. 14A-141, as well as any other practical shape. The primary components of each cushioning element 500 include a first material layer 510, a second material layer 520, and a pad component 530. First material layer 510 and second material layer 520 cooperatively form an outer surface or covering for cushioning element 500. That is, first material layer 510 and second material layer 520 cooperatively form a pocket or void, in which pad component 530 is located. Whereas second material layer 520 is depicted as having a generally planar configuration, first material layer 510 extends over pad component 530 and also along sides of pad component 530 to join with second material layer 520 (e.g., through stitching, adhesive bonding, or thermal bonding). Although cushioning element 500 may be incorporated into apparel 100 in a variety of ways, first material layer 510 may be positioned exterior of second material element 520, such that cushioning element 500 protrudes outward from apparel 100. Alternately, second material layer 520 may be positioned exterior of first material element 510, such that cushioning element 500 protrudes inwardly and toward individual 10.

Whereas first material layer 510 has a shape that covers pad component 530, second material layer 520 may have a larger size that forms additional portions of apparel 100. For example, second material layer 520 may extend into both pelvic region 101 and one of leg regions 102. That is, second material layer 520 may form one surface of cushioning element 500 and extend to other areas apparel 100 to form a covering for individual 10. In this configuration, first material layer 510 forms a portion of exterior surface 105, whereas second material layer 520 forms a portion of both exterior surface 105 and interior surface 106. More particularly, a portion of second material layer 520 that is secured to pad component 530 is located inward of first material layer 510 and forms a portion of interior surface 106. Another portion of second material layer 520 that is spaced from pad component 530 forms a portion of exterior surface 105, as well as interior surface 106. As such, second material layer 520 forms both a portion of a covering for pad component 530 and other portions of apparel 100.

A variety of materials may be utilized for first material layer 510 and second material layer 520, including various textiles, polymer sheets, leather, or synthetic leather, for example. Combinations of these materials (e.g., a polymer sheet bonded to a textile) may also be utilized for each of material layers 510 and 520. Although material layers 510 and 520 may be formed from the same material, each of material layers 510 and 520 may also be formed from different materials. With regard to textiles, material layers 510 and 520 may be formed from knitted, woven, non-woven, spacer, or mesh textile components that include rayon, nylon, polyester, polyacrylic, elastane, cotton, wool, or silk, for example. Moreover, the textiles may be non-stretch, may exhibit stretch in one direction, or may exhibit multi-directional stretch. Accordingly, a variety of materials are suitable for first material layer 510 and second material layer 520.

Figure 22:
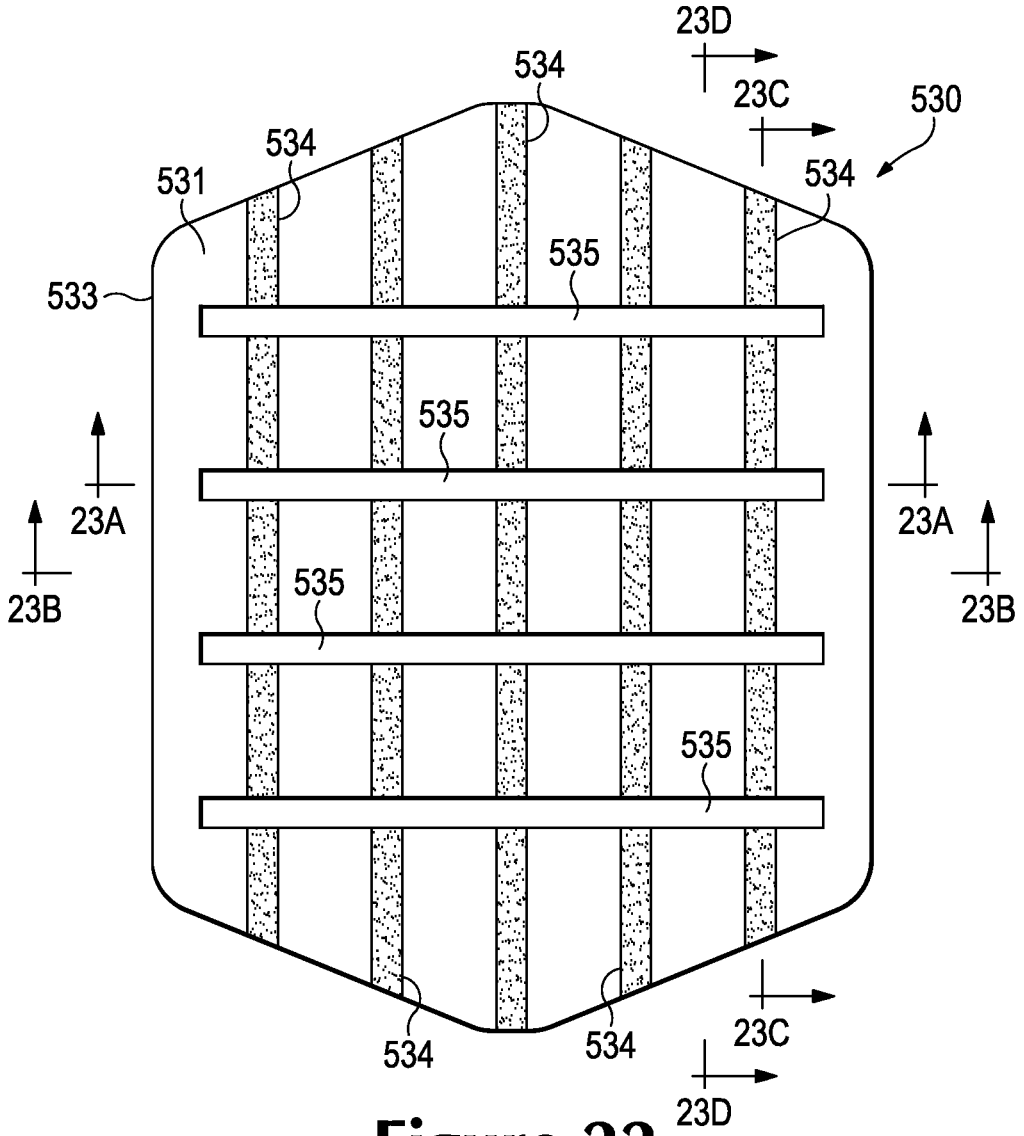
FIG. 22 is a top plan view of a second pad component from the second cushioning element.
Figure 23A:
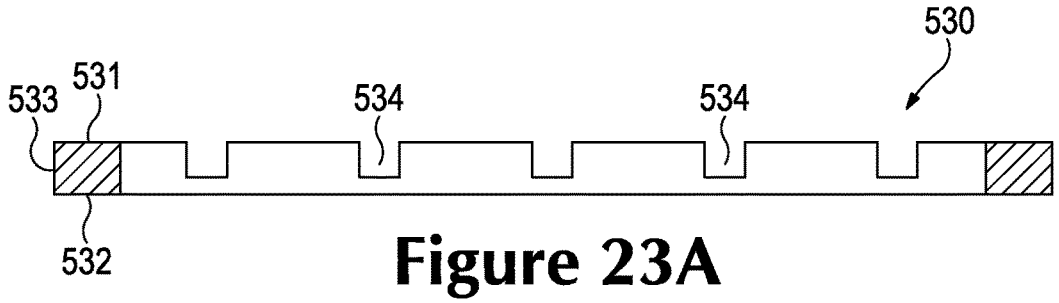
FIGS. 23A-23D are cross-sectional views of the second pad component, as defined by section lines 23A-23D in FIG. 22.
Figure 23B:
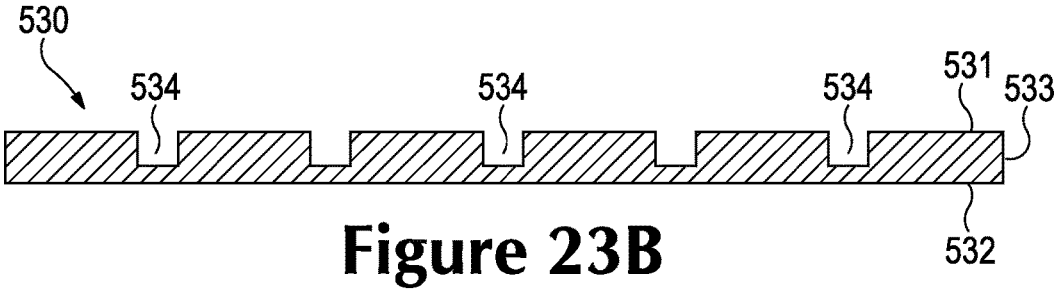
Figure 23C:
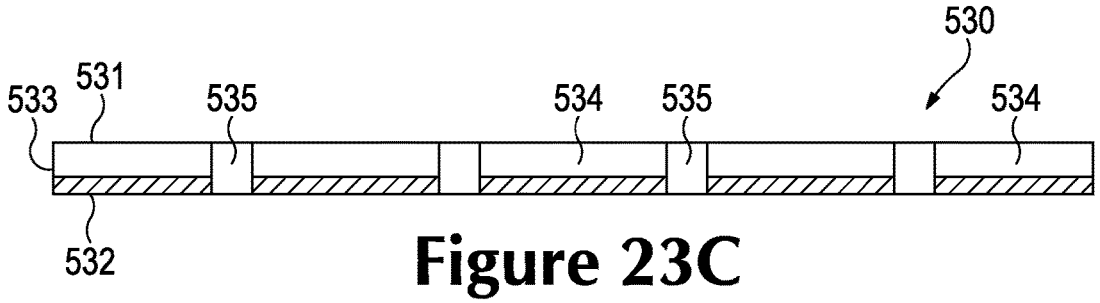
Figure 23D:
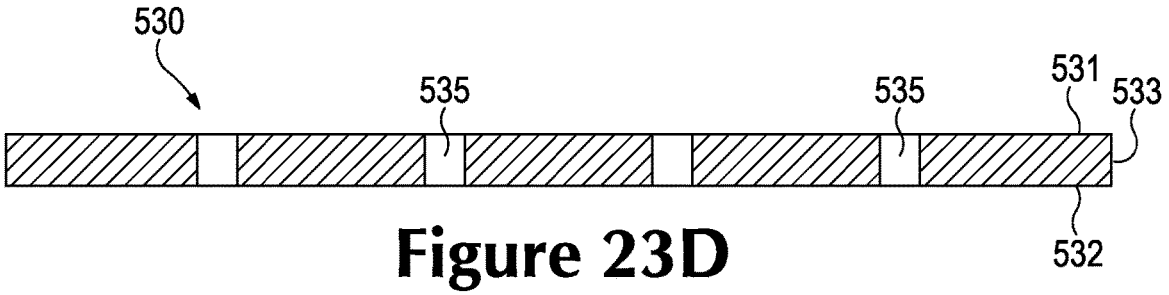

Pad component 530 is depicted individually in FIGS. 22-23D. When incorporated into cushioning element 500, pad component 530 is located between and secured to each of material layers 510 and 520. More particularly, pad component 530 has a first surface 531 secured to first material layer 510, an opposite second surface 532 secured to second material layer 520, and a side surface 533 that extends between surfaces 531 and 532 and forms a peripheral edge. In other configurations, however, pad component 530 may be unsecured to one or both of material layers 510 and 520.

First surface 531 defines a plurality of elongate grooves 534 that extend throughout a length of pad component 530 and toward second surface 532. For purposes of reference in the various figures, grooves 534 are depicted as being stippled (i.e., speckled or dotted) to assist with distinguishing grooves 534 from other features of pad component 530. Although grooves 534 are depicted as being aligned with each other, having a squared shape, and being formed in first surface 531, grooves 534 may have various other configurations. For example, grooves 534 may be unaligned with each other, grooves 534 may have any practical shape, and grooves 534 may be formed in first surface 531, second surface 532, or both of surfaces 531 and 532. Moreover, grooves 534 may have any of the numerous features and variations discussed above for grooves 234 and 235, and grooves 534 may have any of the configurations for grooves 234 and 235 depicted in FIGS. 15A-15J and 16A-16J, for example. Accordingly, grooves 534 may have numerous configurations.

In addition to grooves 534, pad component 530 defines various elongate voids 535 that extend through pad component 530 and from first surface 531 to second surface 532. In effect, voids 535 form apertures or holes in pad component 530. Although voids 535 are depicted as being aligned (i.e., extending in a common direction and being either parallel or offset between zero and thirty degrees) with each other and perpendicular to grooves 534, voids 535 may have a variety of other configurations, some of which are discussed below. As depicted, voids 535 have a length that extends across a majority of a width of pad component 530. End areas of voids 535 are, however, generally spaced inward from side surface 533. In configurations where voids 535 extend entirely across pad component 530, voids 535 will effectively subdivide pad component 530 into two or more separate sections, similar to the configuration of pad component 230 depicted in FIG. 15G. As such, spacing end areas of voids 535 inward from side surface 533 retains a one-piece configuration for pad component 530. An advantage of the one-piece configuration is that a single element (i.e., the entirety of pad component 530), rather than multiple separate elements, is positioned relative to material layers 510 and 520 during the manufacturing process for cushioning element 500.

A variety of materials may be utilized for pad component 530, including various polymer foam materials that return to an original shape after being compressed. Examples of suitable polymer foam materials for pad component 530 include polyurethane, ethylvinylacetate, polyester, polypropylene, and polyethylene foams. Moreover, both thermoplastic and thermoset polymer foam materials may be utilized. In some configurations of cushioning element 500, pad component 530 may be formed from a polymer foam material with a varying density, or solid (i.e., substantially non-foamed) polymer or rubber materials may be utilized. Fluid-filled chambers may also be utilized as pad component 530. Also, different pad components 530 may be formed from different materials, or may be formed from similar materials with different densities, degrees of foaming, or other properties.

The compressible polymer foam materials forming pad component 530 attenuate impact forces that compress or otherwise contact cushioning element 500. When incorporated into apparel 100 or another article of apparel, for example, the polymer foam materials of pad component 530 may compress to protect a wearer from contact with other athletes, equipment, or the ground. By selecting specific thicknesses, materials, and densities for each of the various pad component 530, the degree of impact force attenuation may be varied throughout apparel 100 to impart a desired degree of cushioning or protection. Accordingly, cushioning element 500 may be utilized to provide cushioning or protection to areas of individual 10 or other wearers that are covered by cushioning element 500.

Figure 24A:
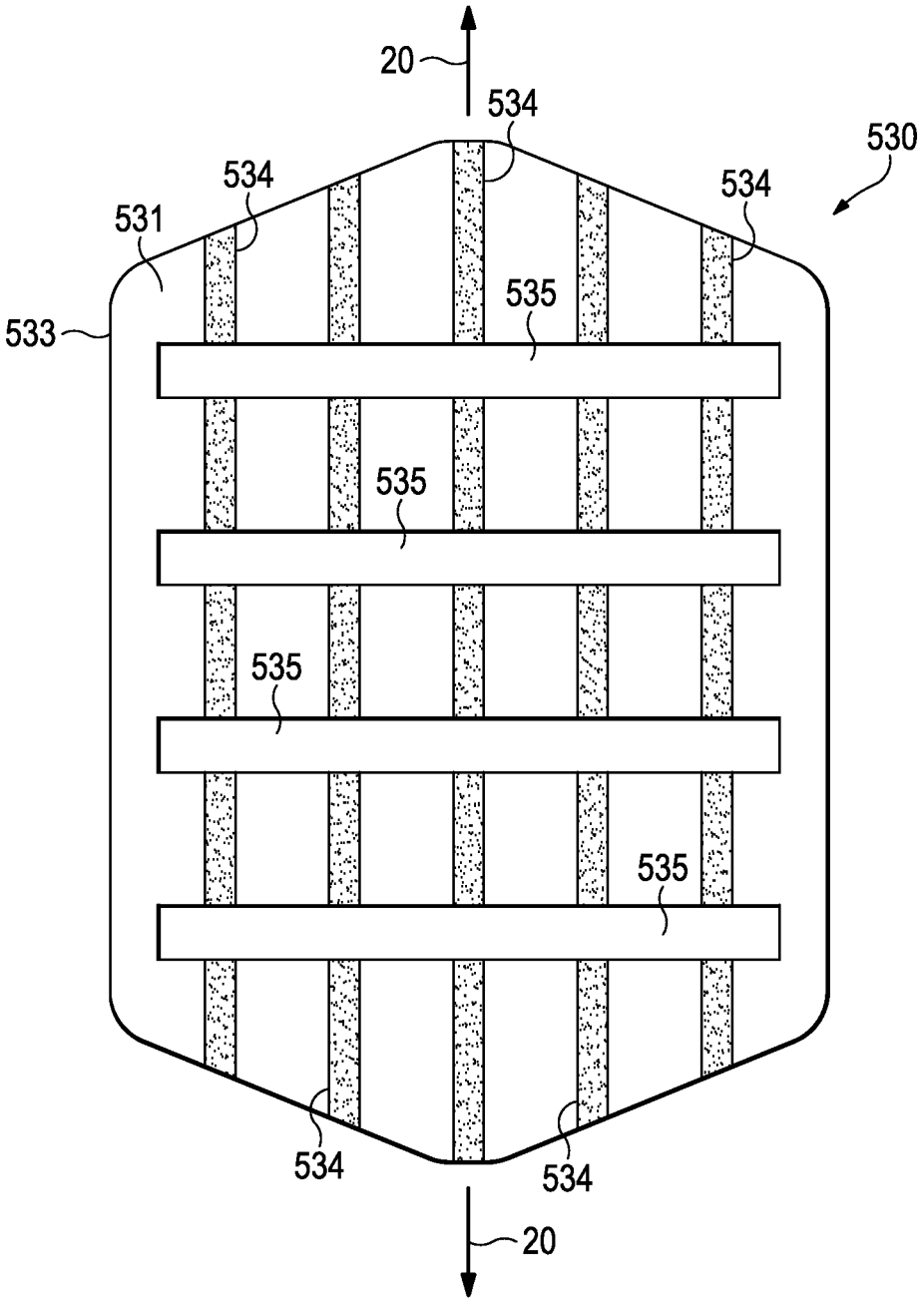
FIG. 24A is a top plan view of the second pad component in a stretched configuration.
Figure 24B:
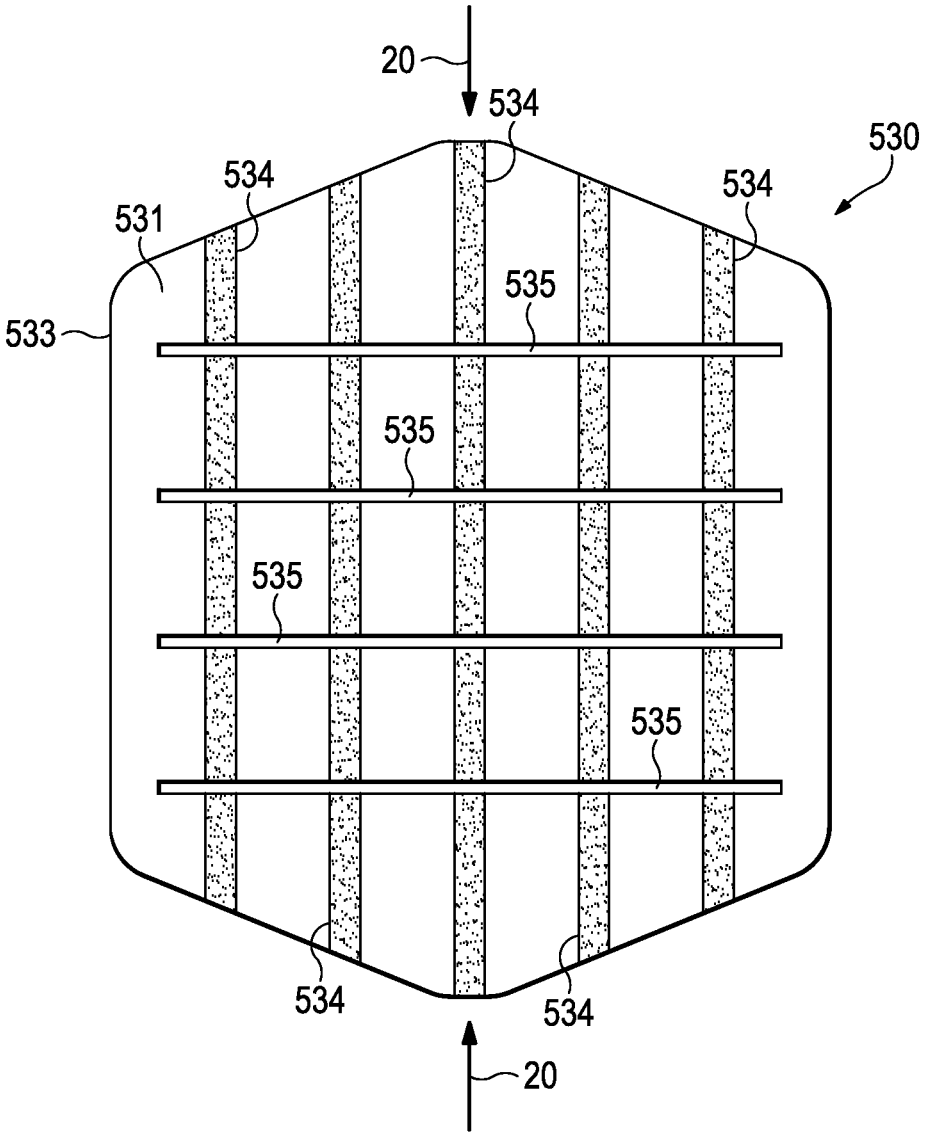
FIG. 24B is a top plan view of the second pad component in a compressed configuration.

In addition to attenuating impact forces, cushioning element 500 has an advantage of simultaneously providing one or more of flex, stretch, compressibility, breathability, relatively low overall mass, and launderability. Given the presence of grooves 534, pad component 530 flexes, stretches, and breathes in the manner shown in FIGS. 10A-10C. The presence of voids 535 complements these properties. Referring to FIG. 24A, for example, force 20 is shown as stretching pad component 530. In this configuration, voids 535 expand in size more than other areas of pad component 530 to impart greater stretch. Referring to FIG. 24B, force 20 is shown as compressing pad component 530. In this configuration, voids 535 decrease in size or otherwise compress more than other areas of pad component 530 to impart greater compressibility. This combination of stretch and compressibility may, for example, enhance the ability of cushioning element 500 to conform with movements of the body of individual 10. That is, as individual 10 performs various actions (e.g., running, jumping, crouching, twisting) cushioning element 500 may stretch and compress, thereby not hindering movements of the body of individual 10. Additionally, voids 535 impart greater breathability to allow heat and moisture to exit cushioning element 500.

A variety of techniques may be utilized to manufacture cushioning element 500, including the general manufacturing process discussed above for cushioning element 200. Additionally, various processes may be utilized to form pad component 530. In one process, polymer resin with a blowing agent may be located in a mold having the shape of pad component 530. An advantage to this process is that a single process may be used to form the polymer foam material of pad component 530, as well as the various grooves 534 and voids 535. In another process, a preformed layer of polymer foam may be obtained, and a router or other cutting device may be used to form grooves 534 and voids 535. For example, a programmable, multi-function fabrication table may be utilized to form both grooves 534 and voids 535, such as an M Series flatbed cutter manufactured by Gerber Scientific Products of Tolland, Conn., United States of America. In other processes, grooves 534 and voids 535 may be formed from a heated element that presses into a preformed layer of polymer foam, or a computer-controlled machine tool may be utilized. As yet further examples, a three-dimensional printer may be utilized to form pad component 530.

Further Cushioning Element Configurations

Aspects of cushioning element 500 may vary, depending upon the intended use for cushioning element 500 and the product in which cushioning element 500 is incorporated. Moreover, changes to the dimensions, shapes, and materials utilized within cushioning element 500 may vary the overall properties of cushioning element 500. That is, by changing the dimensions, shapes, and materials utilized within cushioning element 500, the compressibility, impact force attenuation, flex, stretch, compressibility, breathability, and overall mass of cushioning element 500 may be tailored to specific purposes or products. A plurality of variations for cushioning element 500 are discussed below. Any of these variations, as well as combinations of these variations, may be utilized to tailor the properties of cushioning element 500 to an intended use. Moreover, any of these variations may be manufactured through the process or variations of the process discussed above.

Various aspects relating to first material layer 510 and second material layer 520 may also vary significantly. As discussed above, material layers 510 and 520 may be formed from various textiles, polymer sheets, leather, synthetic leather, or combinations of materials, for example. Moreover, breathability may be enhanced when the materials are air-permeable. In general, textiles are permeable to both heat and moisture. Polymer sheets, leather, synthetic leather, or combinations of materials, however, may not exhibit significant permeability. As with the configuration of cushioning element 200 depicted in FIG. 14J, various perforations, holes, or apertures may be formed in one or both of material layers 510 and 520 to enhance breathability. In some configurations, first material layer 510 may be entirely absent from cushioning element 500, similar to FIG. 14K.

Figure 25A:
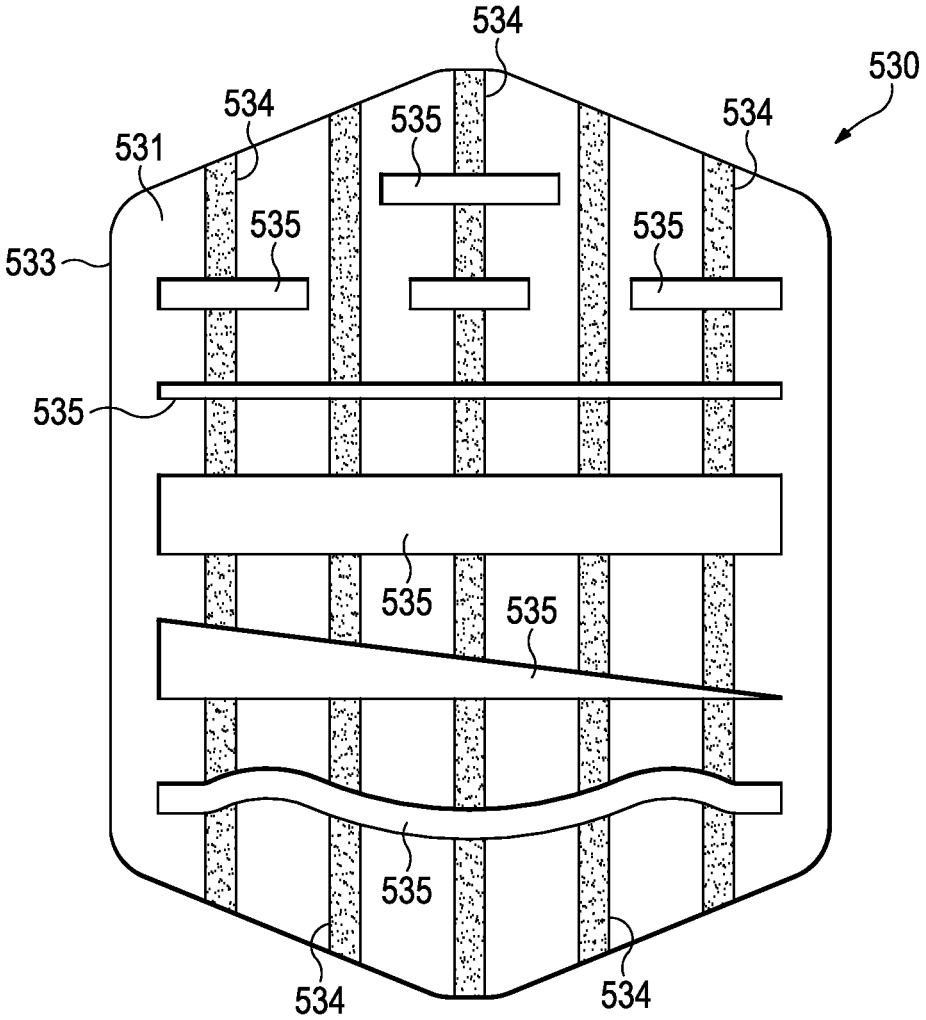
FIGS. 25A-25H are top plan views corresponding with FIG. 22 and depicting further configurations of the second pad component.

Aspects relating to pad component 530 may also vary to tailor cushioning element 500 to an intended use or enhance the properties of cushioning element 500. As an example, grooves 534 may have any of the variations for grooves 235 and 235 discussed above. Referring to FIG. 25A, various aspects of voids 535 are modified to illustrate variations. More particularly, an individual void 535 may have (a) a lesser length, (b) an arrangement that is aligned with other voids 535, (c) a lesser width, (d) a greater width, (e) a tapered or non-rectangular shape, or (f) a non-linear shape. Regarding length, voids 535 may extend across a majority of a width of pad component 530 to maximize the stretch and compressibility properties shown in FIGS. 24A and 24B. By altering the length, however, the degree of stretch and compressibility may be varied in cushioning element 500 or specific areas of cushioning element 500. The width of voids 535 may also vary from one millimeter to twenty millimeters or more. One consideration with width relates to the ability of objects to protrude through voids 535. By forming voids 535 to have a lesser relative width, the probability of an object protruding through or into voids 535 is decreased. Regarding shape, voids 535 may be rectangular, triangular, non-regular or any shape that imparts a desired degree of flex, stretch, compressibility, and breathability. Moreover, the shapes of voids 535 may be varied for aesthetic reasons.

Figure 25B:
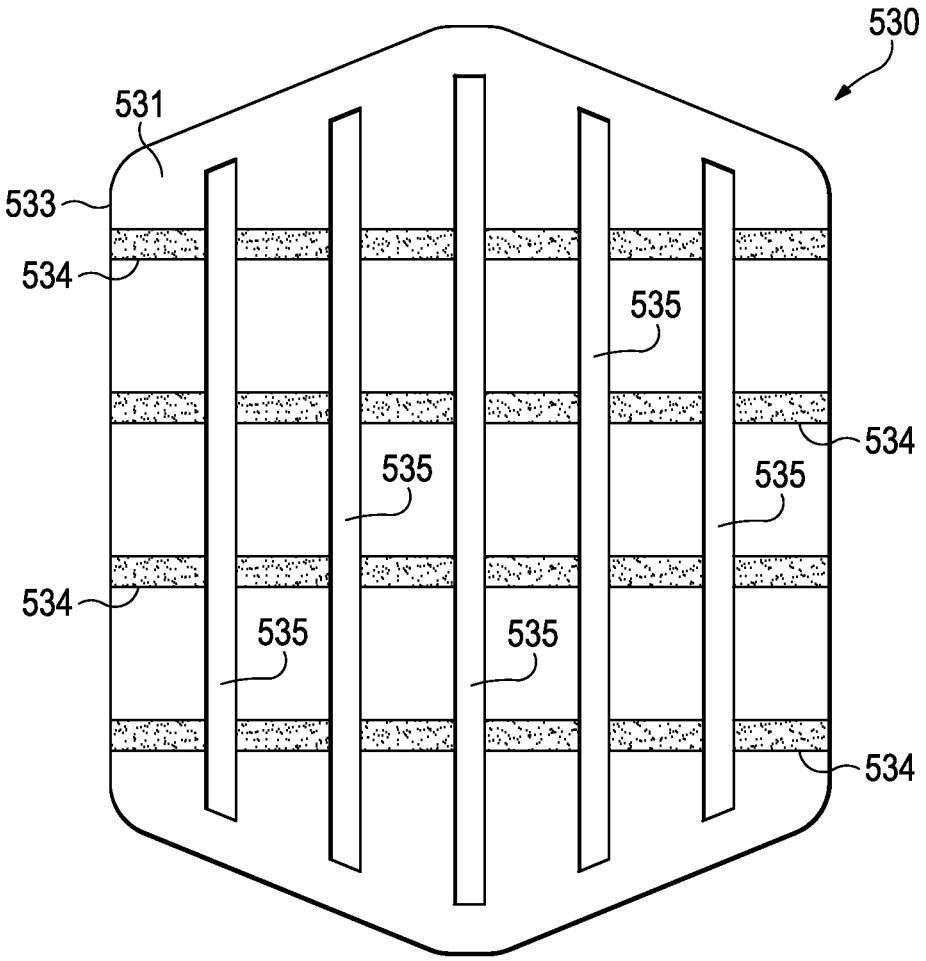
Figure 25C:
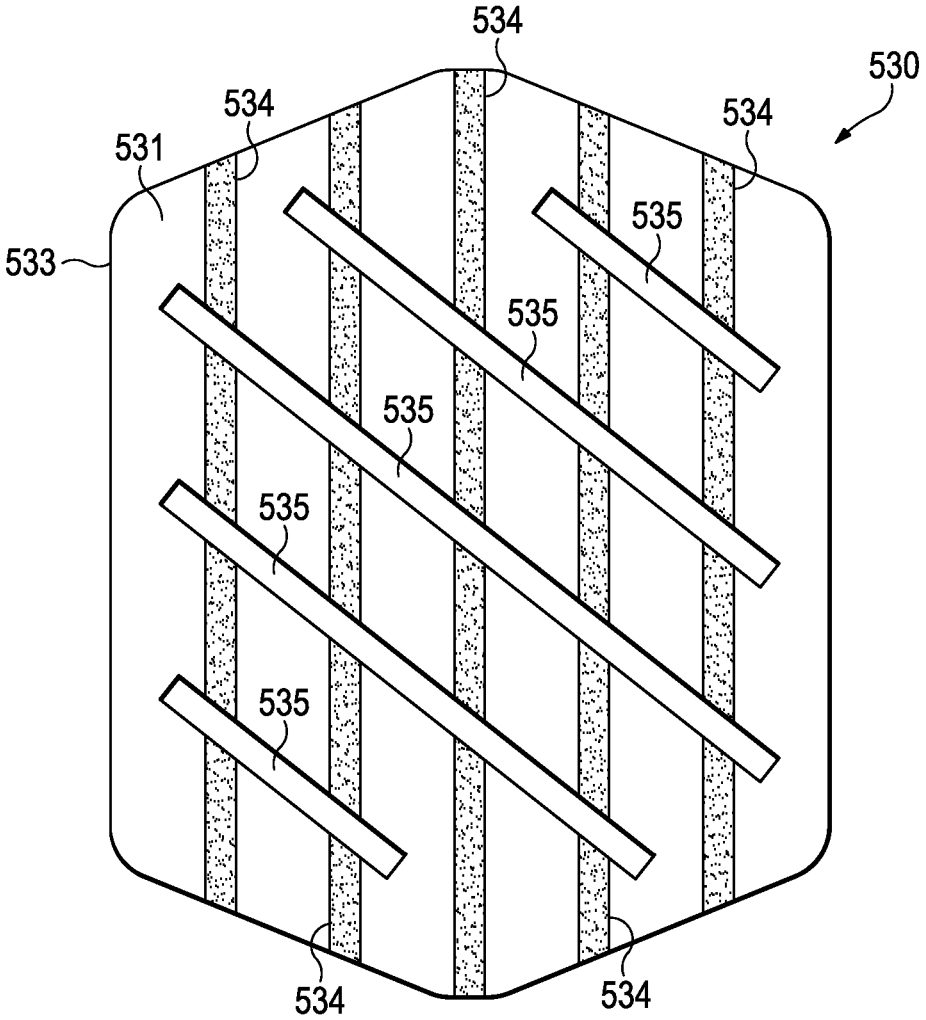
Figure 25D:
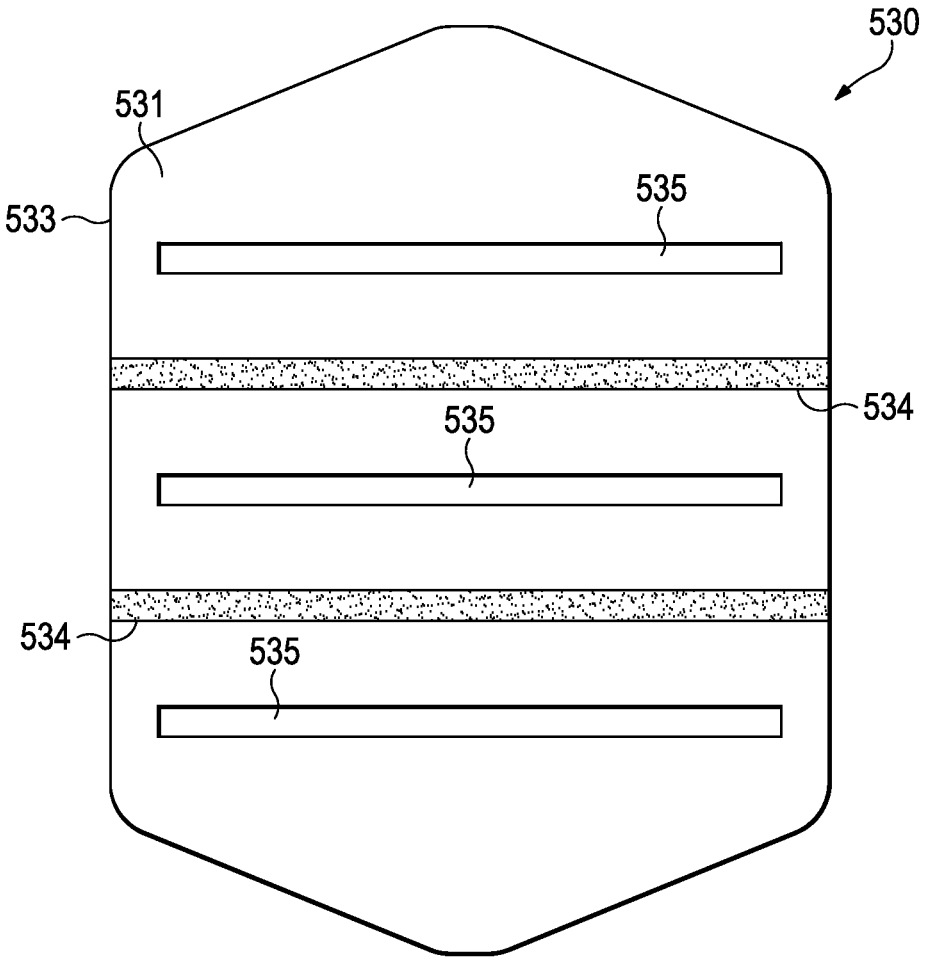
Figure 25E:
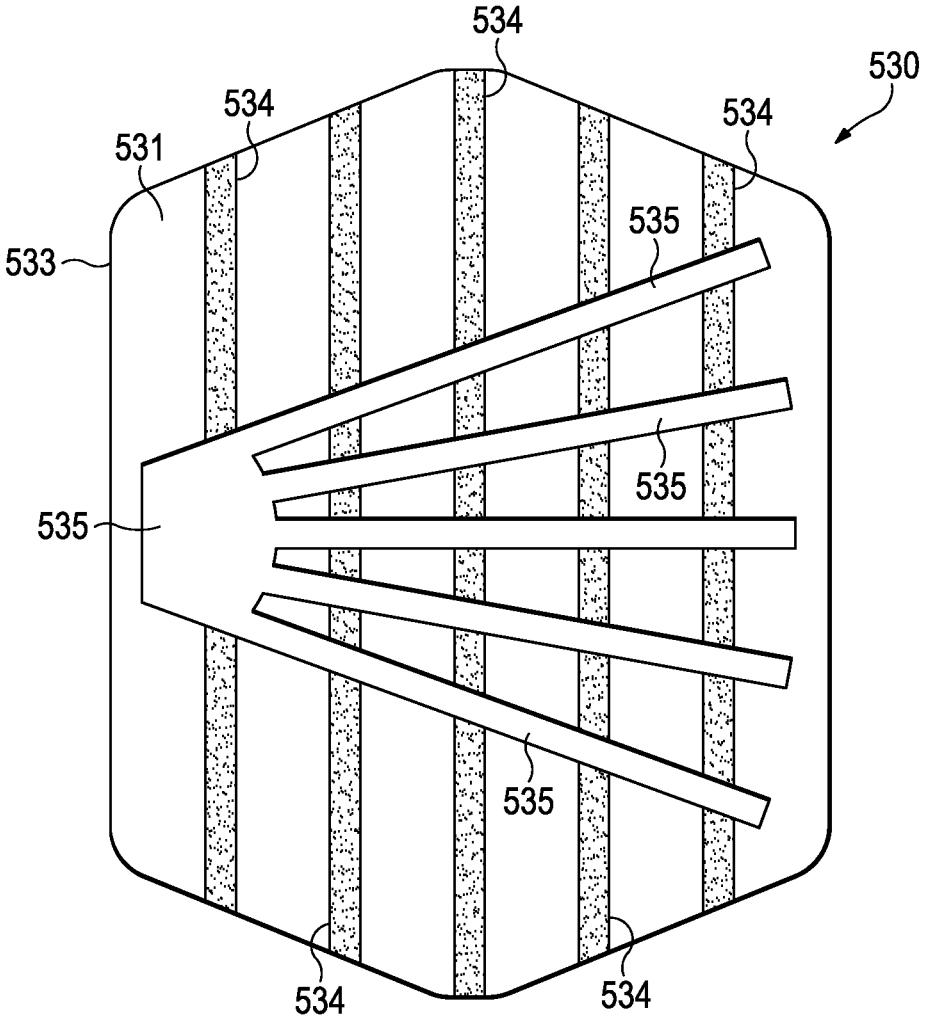
Figure 25F:
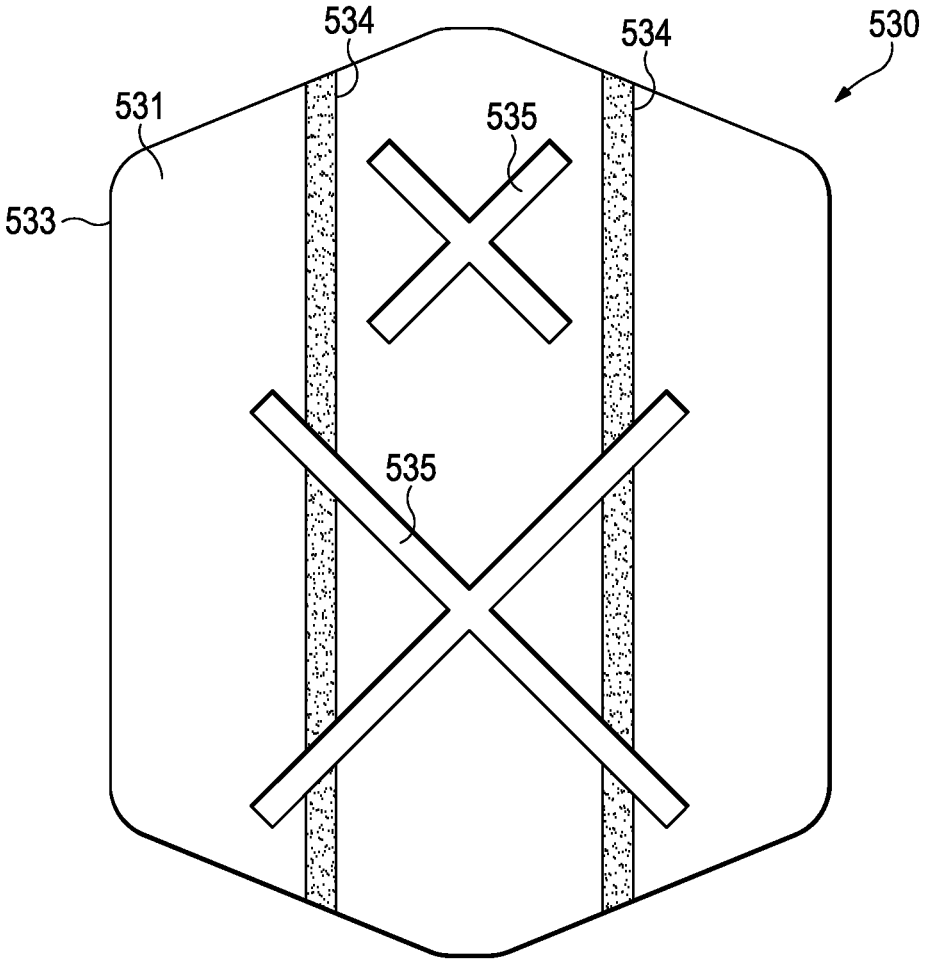

The arrangement of grooves 534 and voids 535 may also vary significantly. Referring to FIG. 25B, grooves 534 extend across the width of pad component 530, whereas voids 535 extend through a majority of the length of pad component 530. Although grooves 534 and voids 535 may be arranged to be perpendicular to each other, grooves 534 and voids 535 may also be offset at other angles, as depicted in FIG. 25C. Similarly, grooves 534 and voids 535 may also be parallel to or aligned with each other, as depicted in FIG. 25D. Although voids 535 may be arranged to be parallel to each other, voids 535 may also be non-parallel. As an example, FIG. 25E depicts voids 535 as radiating outward from a common area. In addition, FIG. 25F depicts various voids 535 as intersecting each other to form two X-shaped structures. Accordingly, numerous aspects relating to the shape, orientation, and arrangement of grooves 534 and voids 535 may vary considerably.

Figure 25G:
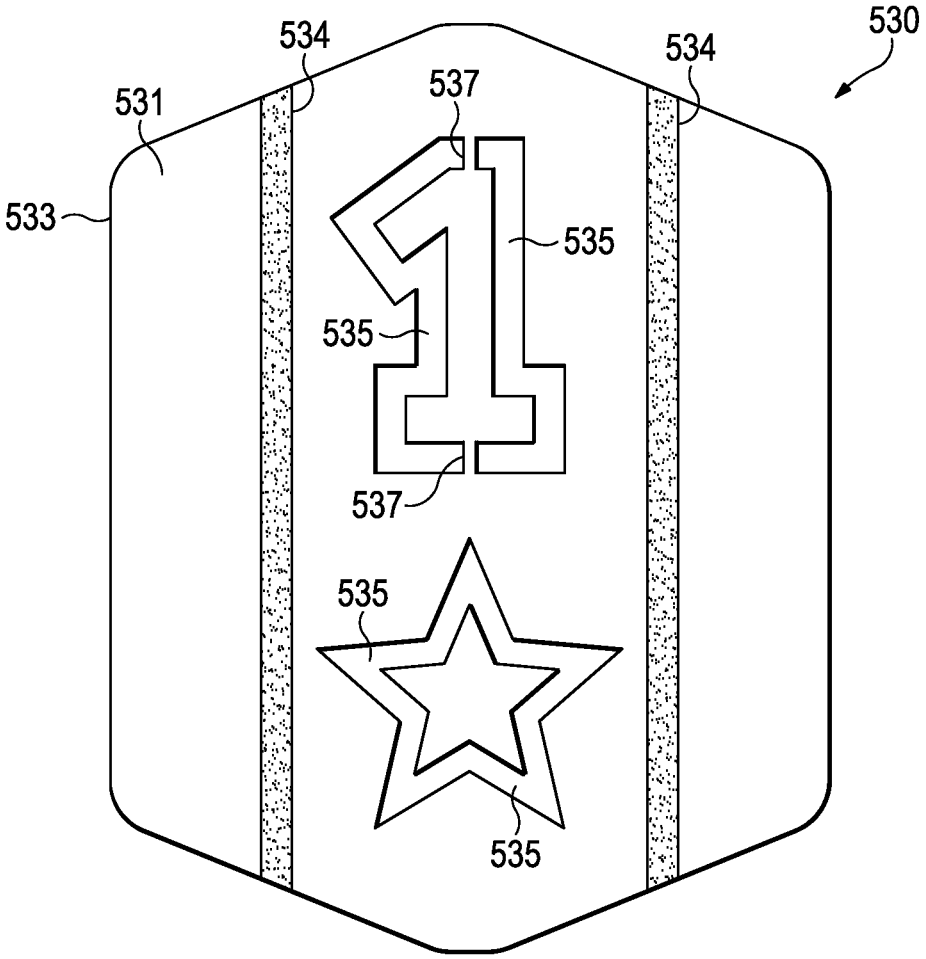

Another configuration of pad component 530 is depicted in FIG. 25G, in which voids 535 form shapes representing the number one and a star. Voids 535 may, therefore, form relatively complex shapes that provide information or fashion indicia. As examples, voids 535 may (a) display an athlete's assigned number, (b) form a team name, (c) represent a trademark or other identifying information for a manufacturer of apparel 100, or (d) show an abstract depiction for aesthetic purposes. As the complexity of the information or indicia increases, however, one consideration relates to segregating separate sections of pad component 530 with voids 535. Referring again to FIG. 25G, two separate voids 535 outline the number one, which forms a pair of connecting portions 537 at upper and lower areas of the number one to ensure that a central area of the number one remains connected to a remainder of pad component 530. The void 535 outlining the star, however, does not form structures similar to connecting portions 537. As a result, a central area of the star is separate from a remainder of pad component 530. During manufacturing, additional steps may be necessary to ensure that the central area of the star remains properly positioned relative to the remainder of pad component 530.

Figure 25H:
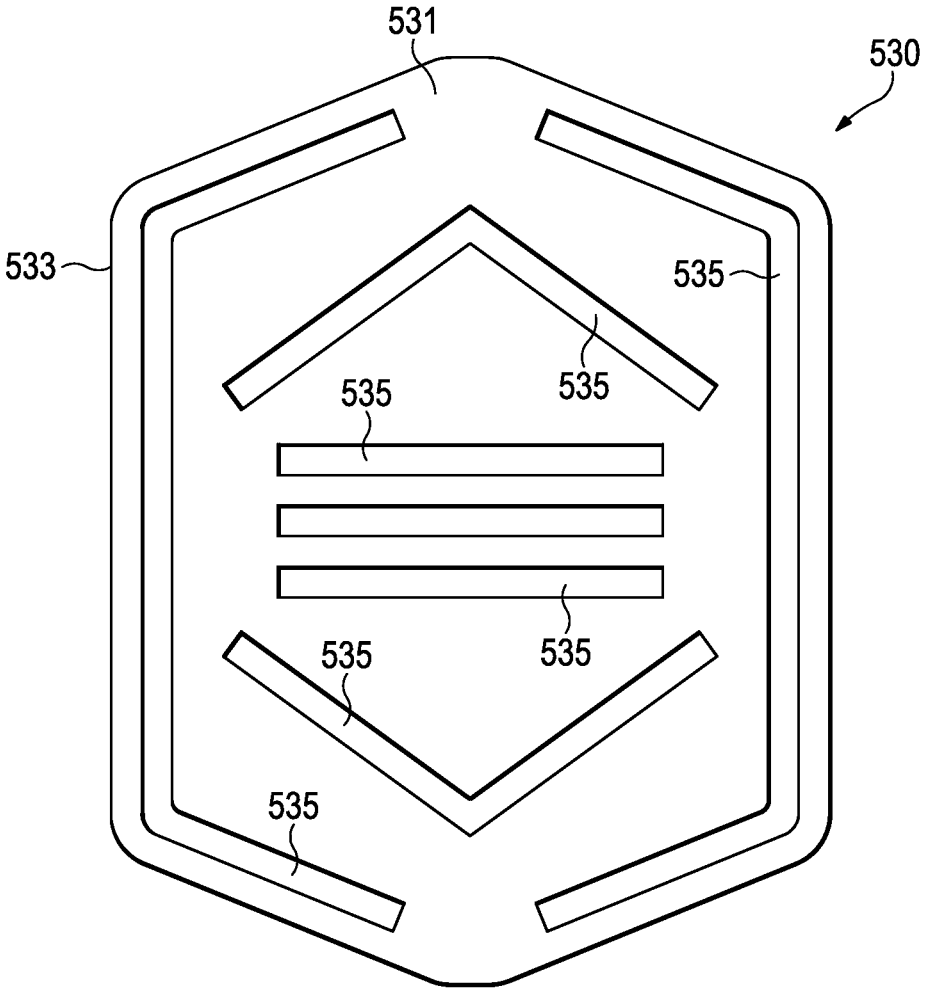

In each of the various configurations discussed above, both grooves 534 and voids 535 are present in pad component 530. In some configurations, however, grooves 534 may be absent from pad component 530. Referring to FIG. 25H, for example, voids 535 extend through various areas of pad component 530 and provide stretch, compressibility, and breathability throughout cushioning element 500 without grooves 534.

Figure 26:
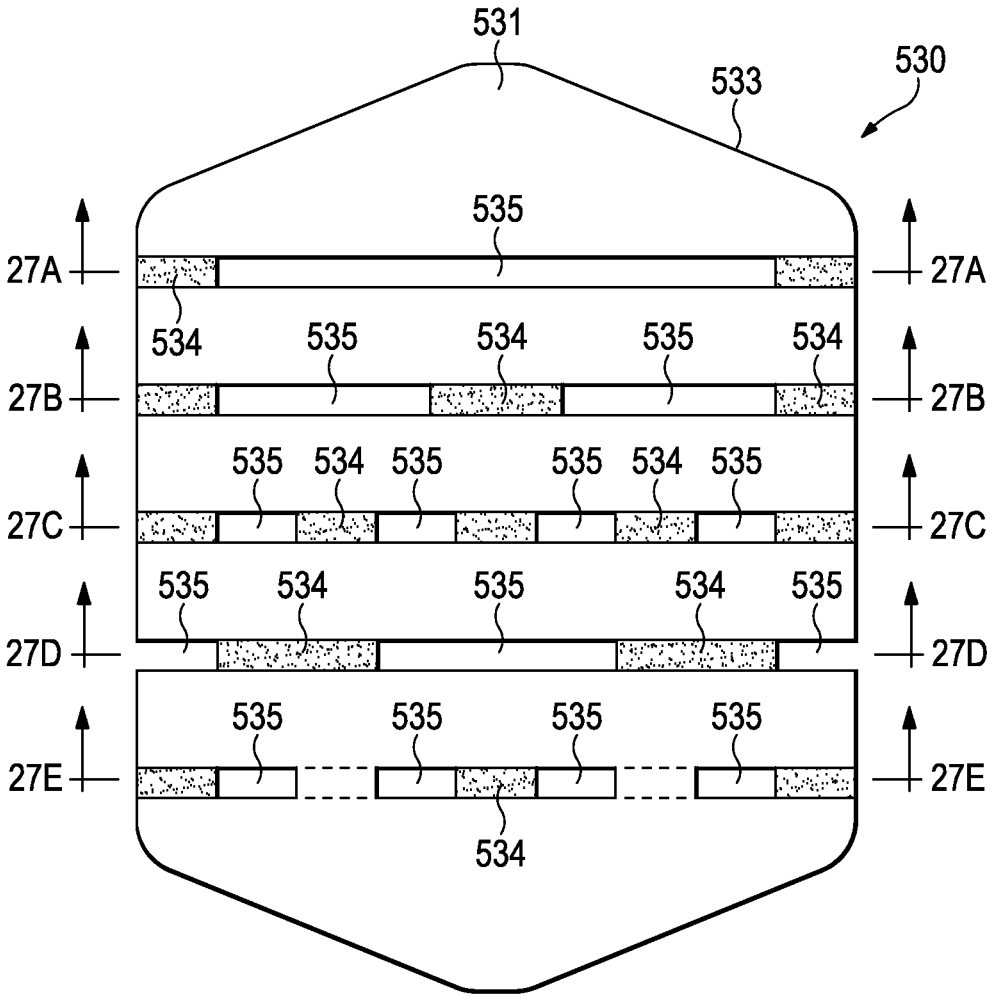
FIG. 26 is a top plan view corresponding with FIG. 22 and depicting another configuration of the second pad component.
Figure 27A:
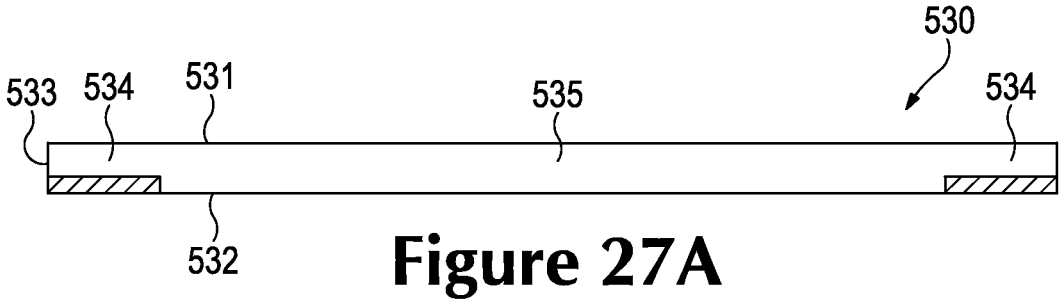
FIGS. 27A-27E are cross-sectional views, as defined by section lines 27A-27E in FIG. 26.
Figure 27B:
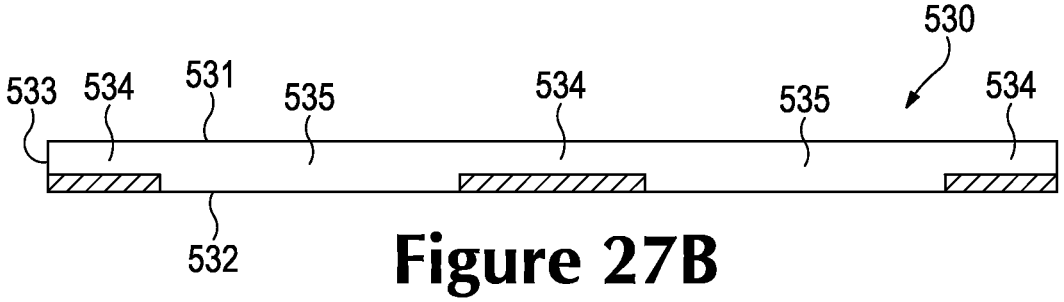
Figure 27C:
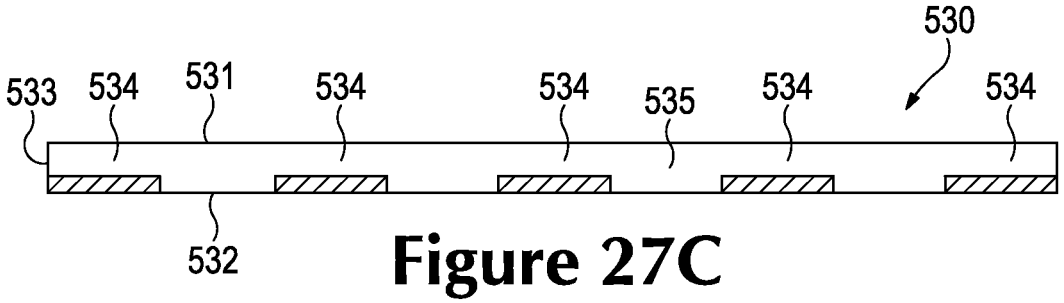
Figure 27D:
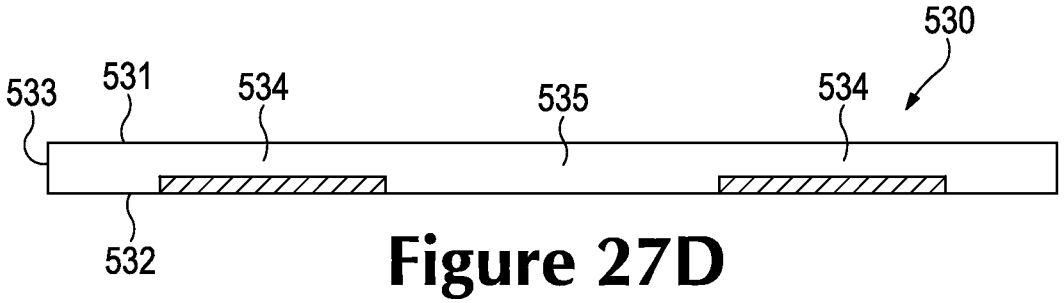
Figure 27E:
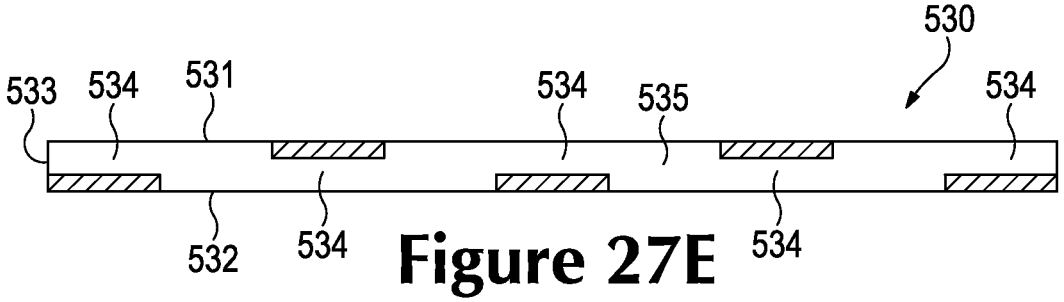
Figure 28:
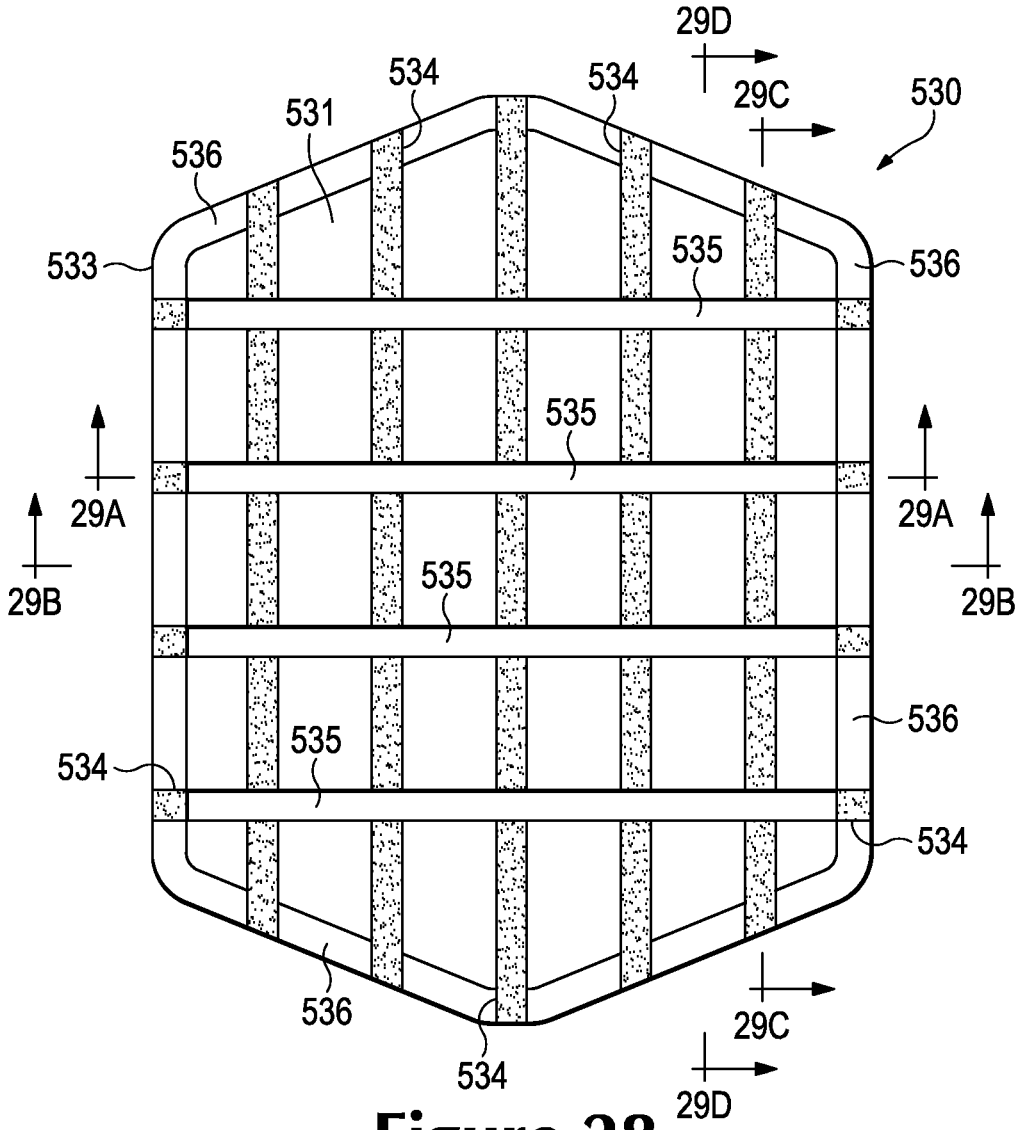
FIG. 28 is a top plan view corresponding with FIG. 22 and depicting another configuration of the second pad component.
Figure 29A:
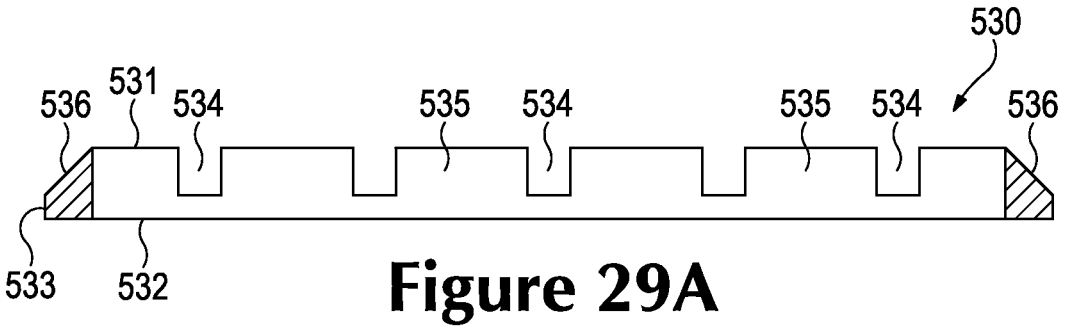
FIGS. 29A-29D are cross-sectional views, as defined by section lines 29A-29D in FIG. 28.
Figure 29B:
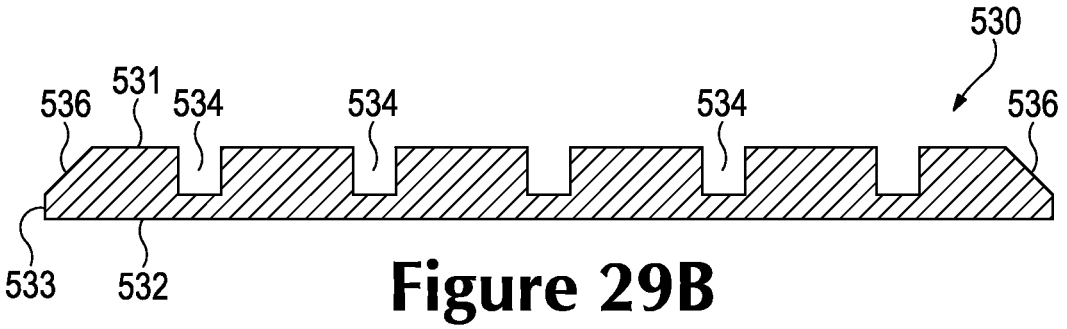
Figure 29C:
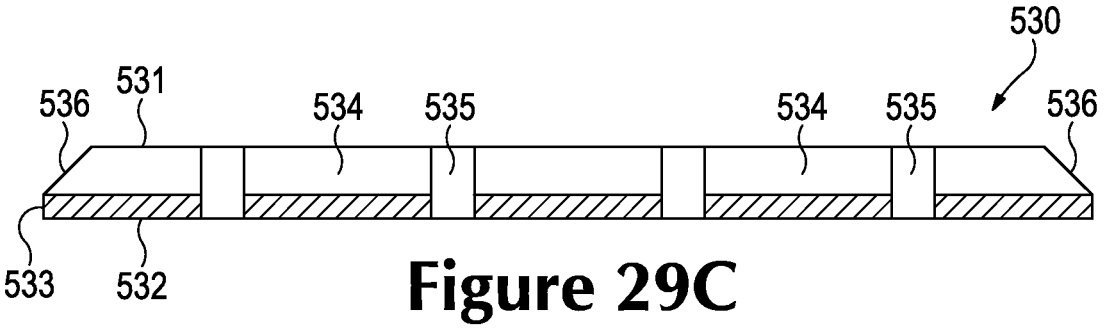
Figure 29D:
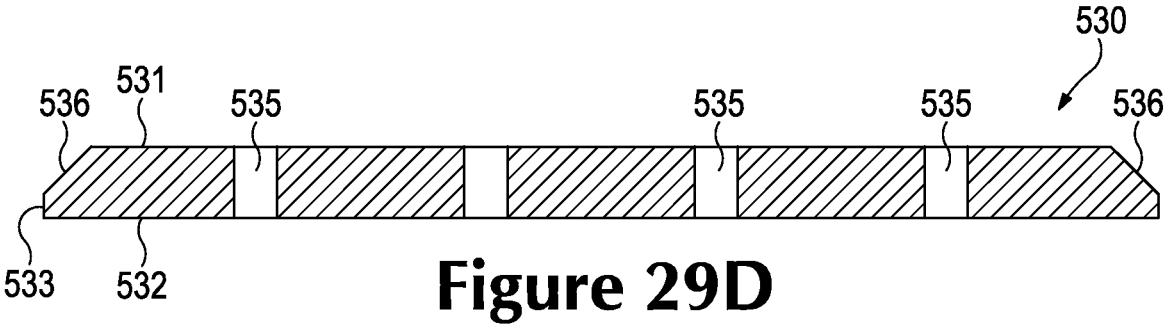

Grooves 534 and voids 535 cross or otherwise intersect each other in many of the prior examples of pad component 530 discussed above. Referring to FIG. 26, however, areas of grooves 534 and voids 535 are aligned with each other. Another manner of considering this structure is that grooves 534 and voids 535 are superimposed or otherwise overlay each other. In any event, FIG. 26 depicts configurations where (a) grooves 534 extend from the end areas of various voids 535, (b) grooves 534 and voids 535 alternate across pad component 530, (c) voids 535 extend inward from side surface 533 and to end areas of grooves 534, and (d) grooves 534 alternate between being formed in first surface 531 and second surface 532. Any of these various configurations may be utilized to modify the properties or aesthetics of pad component 530, as well as decreasing the probability of an object protruding through or into voids 535. Moreover, forming grooves 534 within areas of voids 535 may enhance the structural integrity of pad component 530.

Figure 30A:
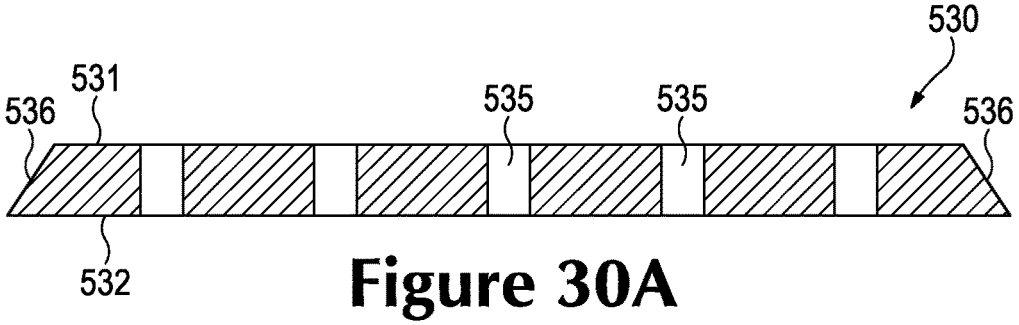
FIGS. 30A-30D are cross-sectional views corresponding with FIG. 29D and depicting further configurations of the second pad component.
Figure 30B:
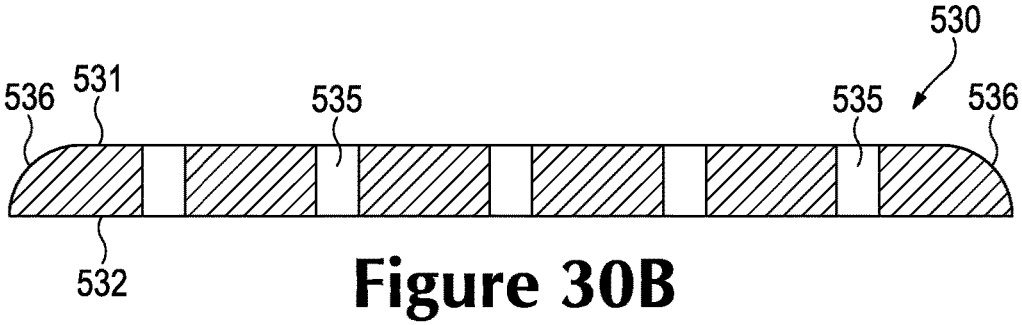
Figure 30C:
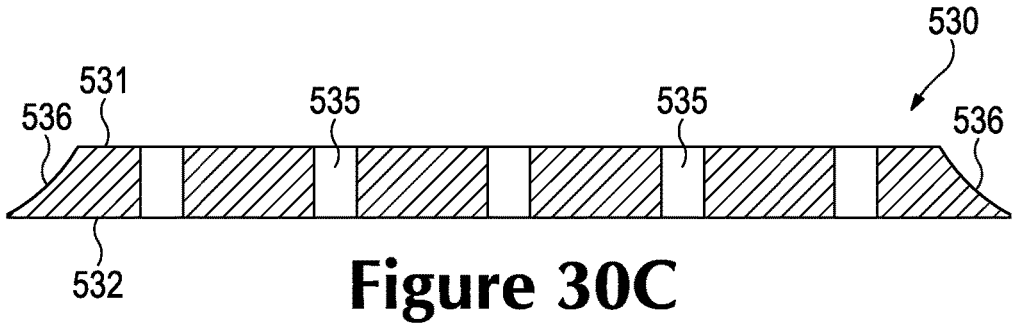
Figure 30D:
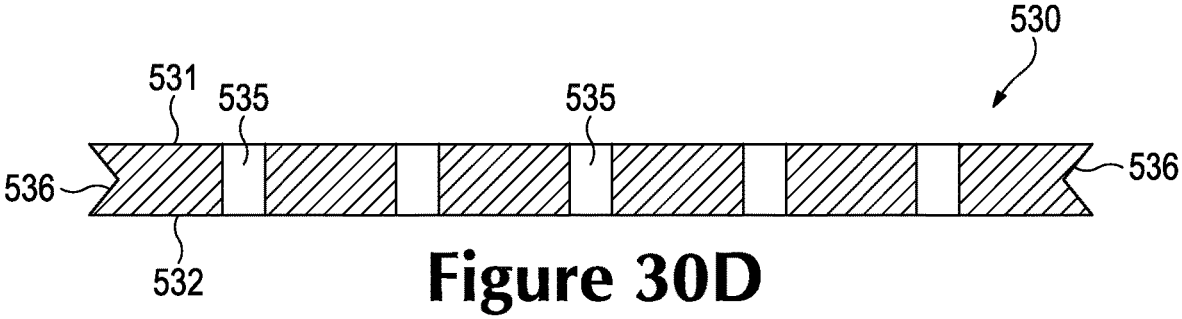

Another configuration is depicted in FIGS. 28 and 29A-29D, wherein pad component 530 includes a beveled edge 536 that extends around pad component 530 and forms an angled transition between surfaces 531 and 533. Although grooves 534 and voids 535 may be absent from the area of beveled edge 536, grooves 534 are depicted as extending through beveled edge 536 and voids 535 are depicted as extending to beveled edge 536. In other configurations, however, voids 535 may extend into the area of beveled edge 536 or end areas of grooves 534 and voids 535 may be spaced from beveled edge 536. An advantage of forming pad component 530 to include beveled edge 536 relates to the transition between first surface 531 and side surface 533. More particularly, beveled edge 536 forms a smoother or less abrupt transition between cushioning elements 500 and areas of apparel 100 where cushioning elements 500 are absent. As noted above, apparel 100 may be worn under other articles of apparel or may be worn in combination with other pieces of equipment (e.g., athletic or protective equipment). In either of these scenarios, beveled edge 536 may ensure that the apparel or equipment covering cushioning elements 500 smoothly transitions to areas where cushioning elements 500 are absent. In further configurations, as respectively depicted in FIGS. 30A-30D, beveled edge 536 may (a) extend to second surface 532, rather than side surface 533, (b) exhibit an outwardly-protruding and rounded configuration, (c) exhibit an inwardly-protruding and rounded configuration, or (d) form an indentation in a side of pad component 530. The specific configuration for beveled edge 536 may depend upon whether apparel 100 is intended to be worn over or under other articles of apparel or equipment. Moreover, a configuration similar to FIG. 30D may allow equipment to interface and effectively join with cushioning element 500. That is, a portion of the equipment may extend into the indented area formed by beveled edge 536.

Figure 31A:
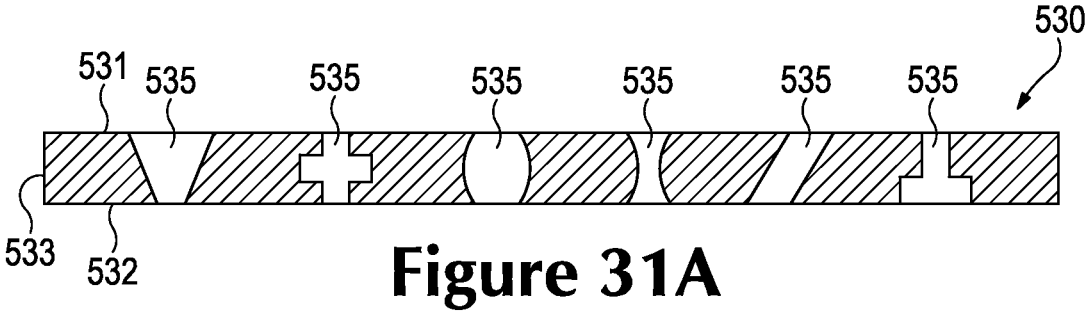
FIGS. 31A-31E are cross-sectional views corresponding with FIG. 23D and depicting further configurations of the second pad component.

A variety of other aspects relating to pad component 530 may also vary to modify the properties or aesthetics of cushioning element 500. Referring to FIG. 31A, voids 535 are depicted as having various example configurations that are tapered, cross-shaped, protruding or curving outwardly and inwardly, slanted, and T-shaped. Voids 535 may be any of these shapes, as well as other shapes, to impart desired properties to cushioning element 500, such as flex, stretch, compressibility, and breathability, for example. Through selecting a shape for one or more of voids 535, therefore, particular properties may be imparted to cushioning element 500. For example, tapered and T-shaped voids 535 may permit cushioning element 500 to flex more in one direction than in an opposite direction. Moreover, various non-uniform shapes for voids 535 (e.g., tapered, cross-shaped, protruding or curving, slanted, and T-shaped) may be utilized to limit the ability of objects to protrude through voids 535, thereby contacting the individual wearing apparel 100, while imparting the desired properties to cushioning element 500. Similarly, different grooves 534 and voids 535 may have different widths or shapes to further vary the properties of cushioning element 500. Although many of the concepts presented above are discussed in relation to voids 535, any of these concepts may also be applied to grooves 534.

Figure 31B:
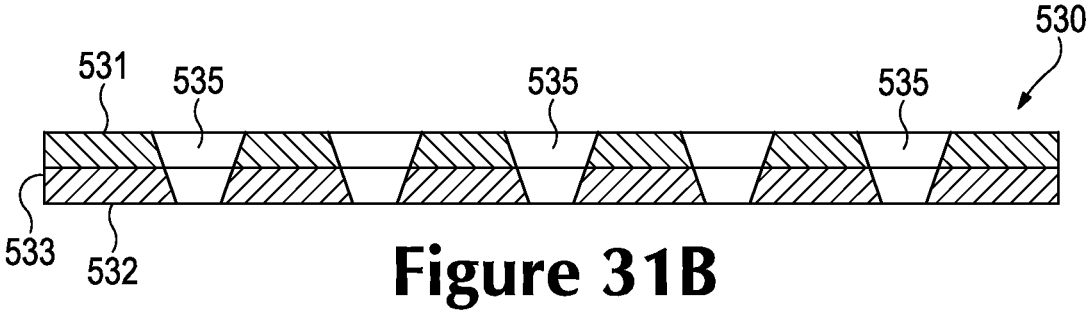

Another aspect relating to pad component 530 that may modify the properties or aesthetics of cushioning element 500 relates to forming a layered structure, as depicted in FIG. 31B. As an example, the layers may be different types of polymer foam or densities of polymer foam, or the layers may be different materials, such as polymer foam and rubber. The layers may also have different colors to impart aesthetic qualities to cushioning element 500. For example, voids 535 may extend through one layer and into the other layer to expose the color of the underlying layer. Moreover, voids 535 are depicted as being tapered so that the color of the underlying layer may be seen, thereby enhancing the aesthetic attributes of cushioning element 500. A similar concept may apply to grooves 534, which may extend through one layer and into the other layer to expose the color of the underlying layer.

Figure 31C:
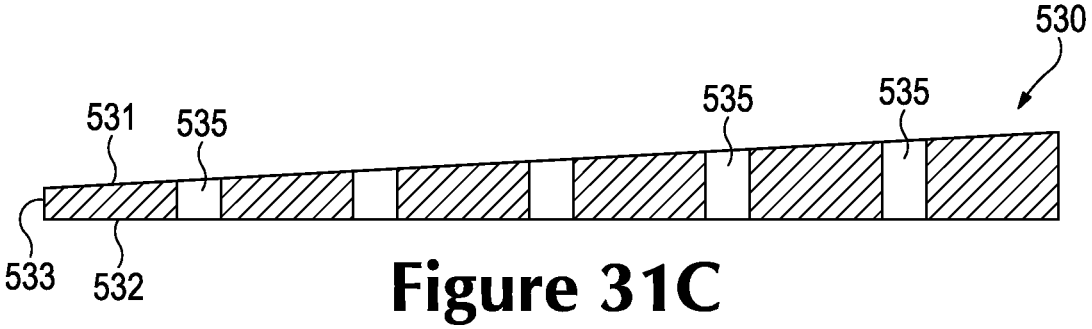
Figure 31D:
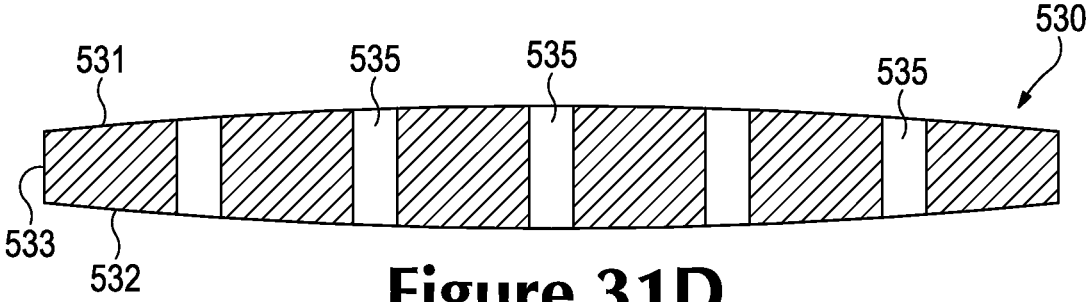
Figure 31E:
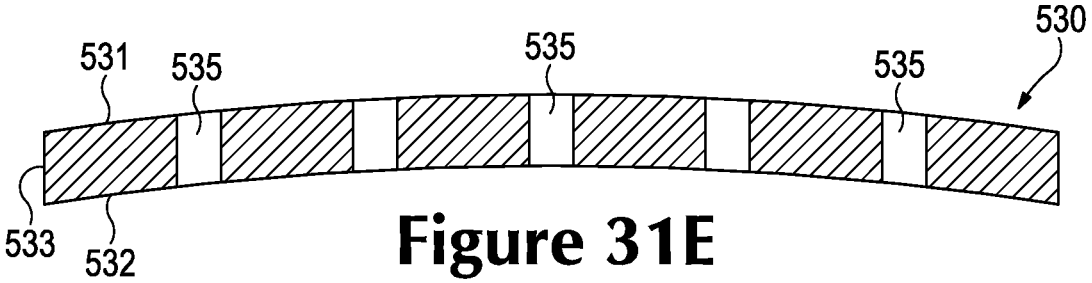

Although the thickness of pad component 530 may be constant, pad component 530 may also have varying or tapered thicknesses, as depicted in FIG. 31C, to further modify the properties or aesthetics of cushioning element 500. In some configurations of cushioning element 500, a central area of pad component 530 may have greater thickness than a peripheral area of pad component 530, as depicted in FIG. 31D. Additionally, pad component 530 may have a rounded or contoured shape, as depicted in FIG. 31E, to better conform with contours of individual 10.

Figure 32:
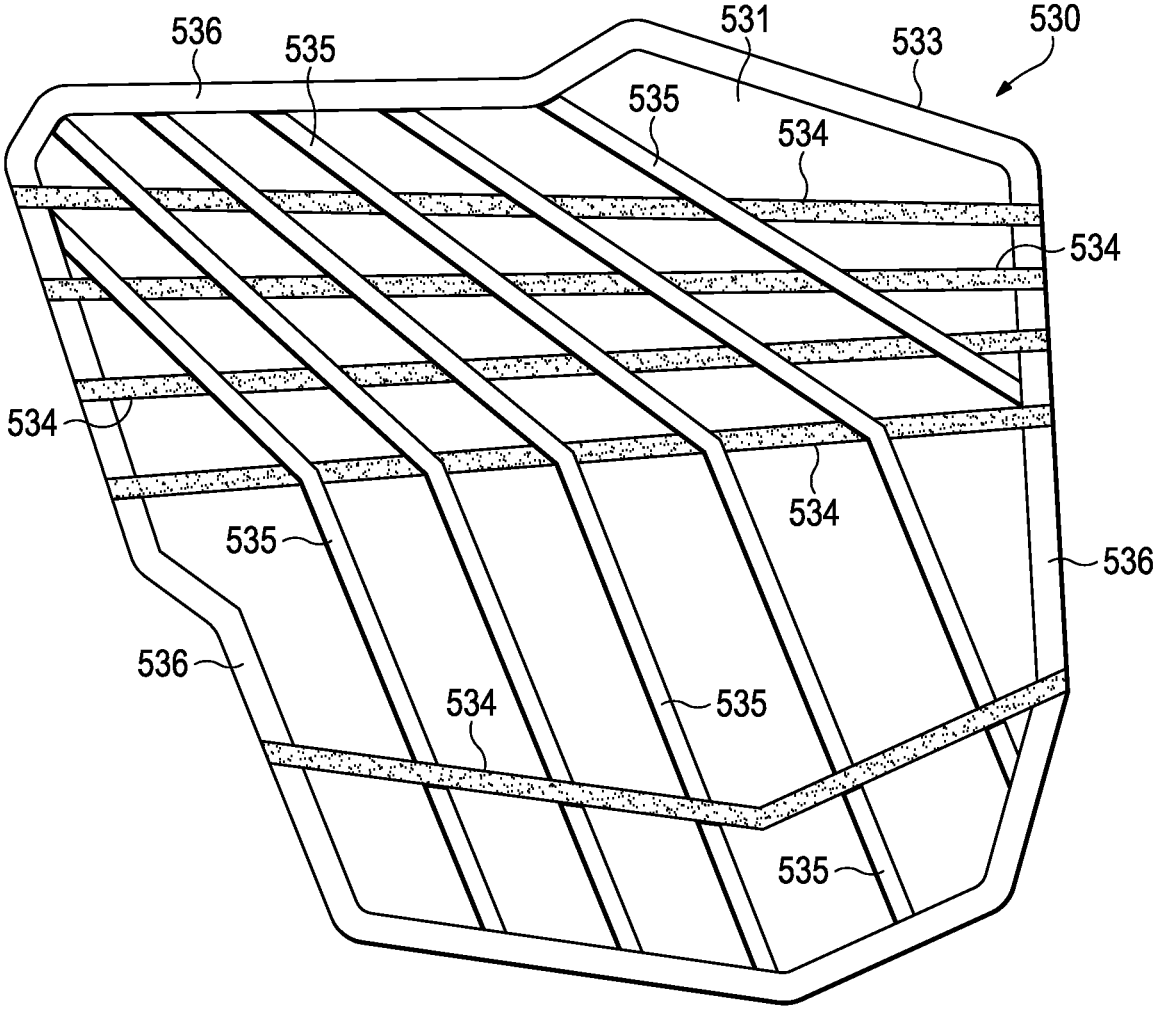
FIGS. 32 and 33 are top plan views corresponding with FIG. 22 and depicting further configurations of the second pad component.
Figure 33:
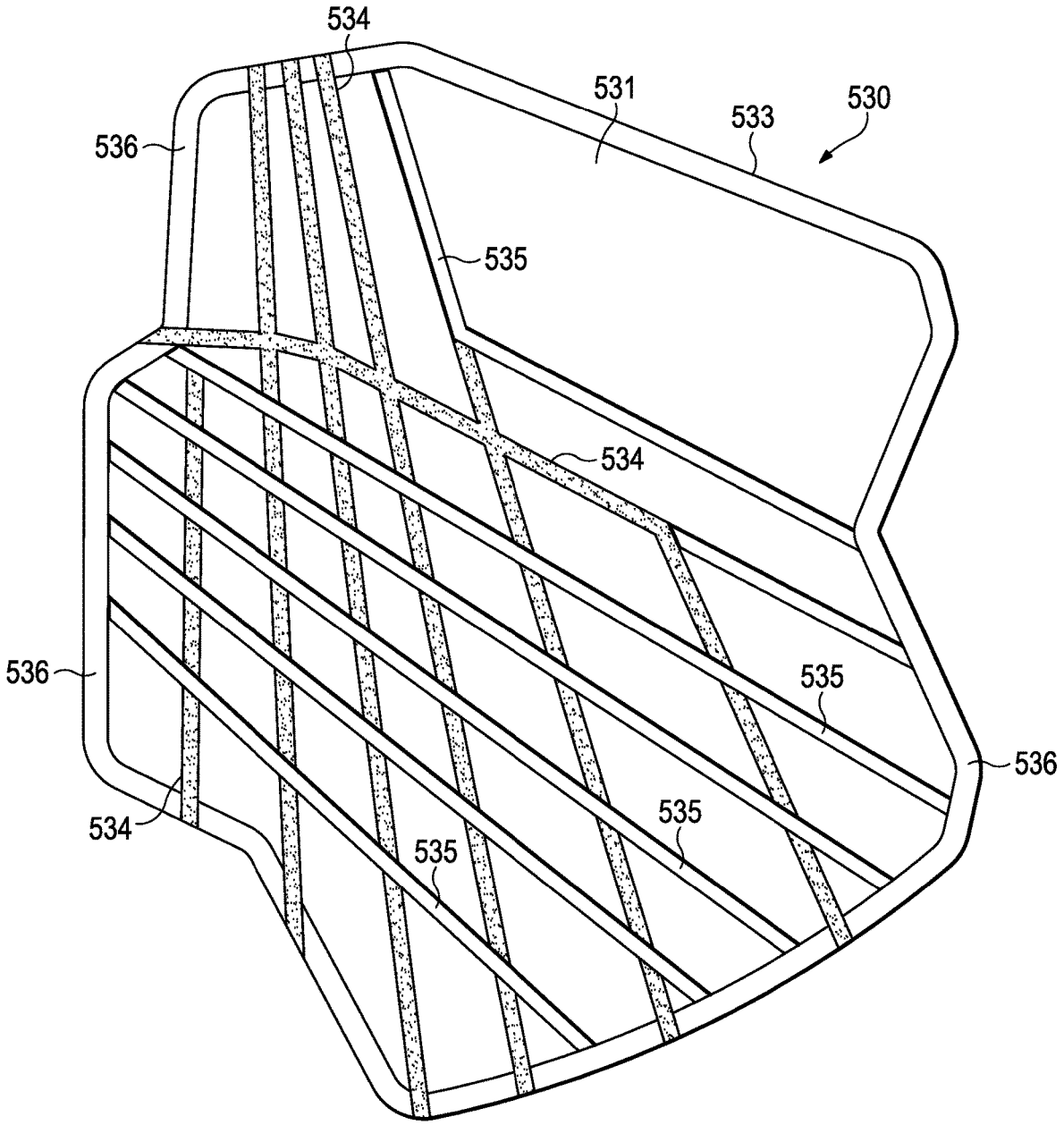

Further configurations of pad component 530 are depicted in FIGS. 32 and 33. These configurations of pad component 530 may be utilized, for example, in a thigh area or a hip area of apparel 100. As with configurations of pad component 530 discussed above, these configurations include grooves 534 and voids 535 that cross each other and extend in various directions, as well as having beveled edge 536. Moreover, these configurations of pad component 530 incorporate combinations and orientations of grooves 534 and voids 535 in specific areas in order to impart varying degrees of flex, stretch, compressibility, and breathability, for example. Accordingly, many of the features and variations discussed above may be incorporated into one pad component 530 to provide different combinations of properties to different areas of cushioning element 500.

Based upon the above discussion, various properties of cushioning element 500 may vary. Depending upon the specific type of apparel or location in the apparel, the properties may impart different degrees of impact force attenuation, flex, stretch, compressibility, breathability, or other properties. As such, the variations discussed above may be utilized individually or in combination to impart particular characteristics or combinations of properties to cushioning element 500.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of apparel for attenuation of an impact force, the article of apparel comprising:

a pad component having a first surface and an opposite second surface, the first surface and the second surface defining a pad component thickness, the pad component further comprising at least a first rectangular elongate groove and a second rectangular elongate groove that each partially extends through the pad component thickness from the first surface toward the second surface, the pad component further comprising a length and a width, wherein the first rectangular elongate groove and the second rectangular elongate groove each includes a length measured from a respective first position to a respective second position, the length of the first rectangular elongate groove being the same as the length of the second rectangular elongate groove, wherein each of the first rectangular elongate groove and the second rectangular elongate groove comprises a pair of longitudinal edges and a pair of transverse edges positioned orthogonally to the pair of longitudinal edges; and wherein a first distance between the respective first positions is shorter than a second distance between the respective second positions; and a plurality of rectangular elongate voids, each of the plurality of rectangular elongate voids extending completely through the pad component from the first surface to the second surface, wherein each of the plurality of rectangular elongate voids comprises a length and a width, the length of the each of the plurality of rectangular elongate voids being larger than the width of the each of the plurality of rectangular elongate voids, wherein the length each of the plurality of rectangular elongate voids extends across a majority of the width of the pad component, and further wherein each of the plurality of rectangular elongate voids comprises a pair of longitudinal edges and a pair of transverse edges positioned orthogonally to the pair of longitudinal edges.

2. The article of apparel of claim 1, wherein the first rectangular elongate groove and at least one of the plurality of rectangular elongate voids intersect to form an angle.

3. The article of apparel of claim 2, wherein the angle is 90 degrees.

4. The article of apparel of claim 2, wherein the angle is an acute angle.

5. The article of apparel of claim 1, wherein the length of at least one of the plurality of rectangular elongate voids is longer than the length of another of the plurality of rectangular elongate voids.

6. The article of apparel recited in claim 1, wherein terminal ends of the first rectangular elongate groove and the second rectangular elongate groove are located at a peripheral edge of the pad component, and end areas of the plurality of rectangular elongate voids are spaced inward from the peripheral edge.

7. The article of apparel of claim 1, wherein the pad component further comprises a first layer having a first attenuation coefficient and a second layer having a second coefficient.

8. The article of apparel recited in claim 1, wherein at least one of the plurality of rectangular elongate voids has a non-uniform width.

9. The article of apparel of claim 1, wherein the pad component includes a polymer foam material.

10. An article of apparel incorporating at least one cushioning element for attenuating impact forces, the article of apparel comprising:

a first material layer and a second material layer; and a pad component located between the first material layer and the second material layer, the pad component including a first surface and an opposite second surface, the first surface facing the first material layer, and the second surface facing the second material layer, and the pad component further comprising a length and a width and including:

(a) a plurality of rectangular elongate grooves that extend partially into the pad component from the first surface, wherein each rectangular elongate groove of the plurality of rectangular elongate grooves includes a pair of longitudinal edges and a pair of transverse edges positioned orthogonally to the pair of longitudinal edges; and (b) a plurality of rectangular elongate voids, each of the plurality of rectangular elongate voids extending through the pad component from the first surface to the second surface, wherein each of the plurality of rectangular elongate voids comprises a pair of longitudinal edges having a length and a pair of transverse edges having a width, the pair of transverse edges positioned orthogonal to the pair of longitudinal edges, wherein the length of the pair of longitudinal edges of the plurality of rectangular elongate voids extends across a majority of the width of the pad component;

wherein at least one of the plurality of rectangular elongate grooves and at least one of the plurality of rectangular elongate voids intersect to form an acute angle.

11. The article of apparel of claim 10, wherein the pad component includes a first layer and a second layer with different properties, the first layer forming the first surface and the second layer forming the second surface, and the plurality of rectangular elongate grooves extending into the first layer.

12. The article of apparel of claim 10, wherein the pad component includes a first layer and a second layer with different properties, the first layer forming the first surface and the second layer forming the second surface, and the plurality of rectangular elongate grooves extending through the first layer and into the second layer.

13. The article of apparel of claim 10, wherein the first material layer is joined to the second material layer around at least a portion of a periphery of the pad component.

14. The article of apparel recited in claim 13, wherein the pad component includes a bevel between the first surface and the portion of the periphery of the pad component.

15. An article of apparel incorporating at least one cushioning element for attenuating impact forces, the at least one cushioning element comprising:

a pad component having a first surface and an opposite second surface, the first surface and the second surface defining a pad component thickness, the first surface facing toward an exterior surface of the article of apparel, and the second surface facing toward an interior surface of the article of apparel, wherein the pad component further comprises at least a first rectangular elongate groove and a second rectangular elongate groove that each partially extends through the pad component thickness from the first surface toward the second surface, each of the first rectangular elongate groove and the second rectangular elongate groove comprising a pair of longitudinal edges and a pair of transverse edges positioned orthogonal to the pair of longitudinal edges, the pad component further comprising a length and a width, wherein the first rectangular elongate groove includes a first longitudinal axis oriented parallel to the pair of longitudinal edges;

a plurality of rectangular elongate voids, each of the plurality of rectangular elongate voids extending completely through the pad component from the first surface to the second surface, wherein each of the plurality of rectangular elongate voids comprises a pair of longitudinal edges and a pair of transverse edges positioned orthogonal to the pair of longitudinal edges, wherein a length of the pair of longitudinal edges of the plurality of rectangular elongate voids extends across a majority of the width of the pad component;

wherein an elongate void of the plurality of rectangular elongate voids includes a second longitudinal axis; and wherein the first longitudinal axis and the second longitudinal axis intersect to form an angle.

16. The article of apparel of claim 15, wherein the angle is 90 degrees.

17. The article of apparel of claim 15, wherein the angle is an acute angle.

18. The article of apparel of claim 15, wherein the pad component further includes a first material layer and a second material layer, the first material layer being secured to the first surface and the second material layer being secured to the second surface.

19. The article of apparel of claim 18, wherein the first material layer and the second material layer are textile materials, the first material layer forming at least a portion of the exterior surface of the article of apparel, and the second material layer forming at least a portion of the interior surface of the article of apparel.

20. The article of apparel of claim 15, wherein the pad component includes a first foam layer and a second foam layer with different properties, the first foam layer forming the first surface and the second foam layer forming the second surface, the first rectangular elongate groove and the second rectangular elongate groove extending through the first foam layer and into the second foam layer.

* * * * *